US010974792B2

(12) United States Patent
Taylor

(10) Patent No.: US 10,974,792 B2
(45) Date of Patent: Apr. 13, 2021

(54) MOORING TENSIONER AND METHODS THEREOF

(71) Applicant: Flintstone Technology Limited, Dundee (GB)

(72) Inventor: Richard Taylor, Dundee (GB)

(73) Assignee: FLINTSTONE TECHNOLOGY LIMITED, Dundee (GB)

( * ) Notice: Subject to any disclaimer, the term of this patent is extended or adjusted under 35 U.S.C. 154(b) by 21 days.

(21) Appl. No.: 16/319,439

(22) PCT Filed: Jul. 28, 2017

(86) PCT No.: PCT/GB2017/052213

§ 371 (c)(1),
(2) Date: Jan. 21, 2019

(87) PCT Pub. No.: WO2018/025018

PCT Pub. Date: Feb. 8, 2018

(65) Prior Publication Data

US 2019/0291824 A1 Sep. 26, 2019

(30) Foreign Application Priority Data

| | | |
|---|---|---|
| Aug. 1, 2016 | (GB) | 1613248 |
| Oct. 10, 2016 | (GB) | 1617187 |
| May 12, 2017 | (GB) | 1707671 |

(51) Int. Cl.

| | |
|---|---|
| ***B63B 21/00*** | (2006.01) |
| ***B63B 21/50*** | (2006.01) |
| ***B63B 21/04*** | (2006.01) |

(52) U.S. Cl.

CPC ..... *B63B 21/50* (2013.01); *B63B 21/04* (2013.01); *B63B 2021/505* (2013.01)

(58) Field of Classification Search

CPC ..... B63B 21/04; B63B 2021/04; B63B 21/08; B63B 21/10; B63B 21/18; B63B 21/20;

(Continued)

(56) References Cited

U.S. PATENT DOCUMENTS 4,090,462 A 5/1978 Mount
4,889,065 A * 12/1989 van den Haak ..... B63B 21/22 114/293

(Continued)

FOREIGN PATENT DOCUMENTS

EP 0 081 258 A1 6/1983
EP 1 283 158 A 2/2003

(Continued)

OTHER PUBLICATIONS

Patents Act 1977: Search Report under Section 17(5), UKIPO Application No. 1613248.2, dated Jan. 23, 2017, 4 pp.

(Continued)

*Primary Examiner* — Daniel V Venne
(74) *Attorney, Agent, or Firm* — Myers Bigel, P.A.

(57) ABSTRACT

There is disclosed an apparatus for mooring a structure, the apparatus includes a first portion for receiving a portion of a line, such as a mooring line, extending from a structure. A guide portion for guiding a/the portion of a line received by the first portion, the guide portion being movably connected to the first portion and a second portion for connecting or coupling the apparatus to a seabed or a further structure located thereon, the second portion being movably connected to the first portion and/or guide portion.

20 Claims, 29 Drawing Sheets

(58) Field of Classification Search
CPC ..... B63B 2021/203; B63B 21/50; B63B 2021/505
USPC ... 440/230.1, 230.2, 230.22, 230.24, 230.25, 440/230.26, 230.29; 114/230.1, 230.2, 114/230.22, 230.24, 230.25, 230.26, 114/230.29
See application file for complete search history.

(56) References Cited

U.S. PATENT DOCUMENTS

| | | | | |
|---|---|---|---|---|
| 5,097,787 | A * | 3/1992 | Bruce | F16G 15/00 114/293 |
| 6,216,628 | B1 * | 4/2001 | Poldervaart | B63B 21/50 114/230.2 |
| 6,467,423 | B1 * | 10/2002 | Poldervaart | B63B 21/50 114/293 |
| 10,577,056 | B2 * | 3/2020 | Lisland | B63B 21/10 |
| 2002/0189522 | A1 | 12/2002 | Dove et al. | |
| 2005/0072347 | A1 | 4/2005 | Niebur | |
| 2014/0017014 | A1 | 1/2014 | Pollack | |

FOREIGN PATENT DOCUMENTS

| | | | |
|---|---|---|---|
| EP | 1 318 072 | A2 | 6/2003 |
| GB | 2 096 963 | A | 10/1982 |
| GB | 2512312 | A | 10/2014 |
| GB | 2517873 | B | 6/2015 |
| KR | 10-2016-0084396 | A | 7/2016 |
| WO | WO 2004/055394 | A1 | 7/2004 |
| WO | WO 2010/085156 | A1 | 7/2010 |
| WO | WO 2012/088511 | A1 | 6/2012 |
| WO | WO 2013/186553 | A1 | 12/2013 |
| WO | WO 2014/083056 | A1 | 6/2014 |
| WO | WO 2014/155094 | A1 | 10/2014 |
| WO | WO 2015/071318 | A1 | 5/2015 |
| WO | WO 2015/150770 | A1 | 10/2015 |
| WO | WO 2018/197881 | A1 | 11/2018 |
| WO | WO 2018/197882 | A1 | 11/2018 |

OTHER PUBLICATIONS

Patents Act 1977: Search Report under Section 17(5), UKIPO Application No. 1617187.8, dated Jan. 29, 2018, 3 pp.

Patents Act 1977: Search Report under Section 17(5), UKIPO Application No. 1707671.2, dated Feb. 1, 2018, 5 pp.

International Search Report and Written Opinion of the International Searching Authority, International Application No. PCT/GB2017/052213, dated Dec. 7, 2017, 18 pp.

* cited by examiner

| Wrap Angle (degrees) | Factor (T2/T1) |
|---|---|
| 0 | 2.0 |
| 10 | 1.99 |
| 20 | 1.97 |
| 30 | 1.93 |
| 40 | 1.87 |
| 45 | 1.84 |
| 50 | 1.81 |
| 60 | 1.73 |
| 70 | 1.64 |
| 80 | 1.53 |
| 90 | 1.41 |

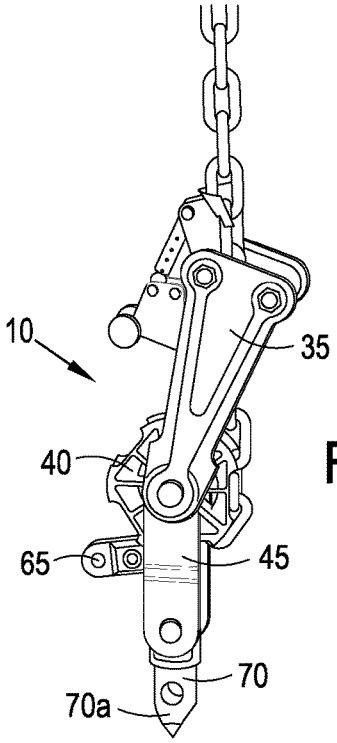
Figure 5(a)
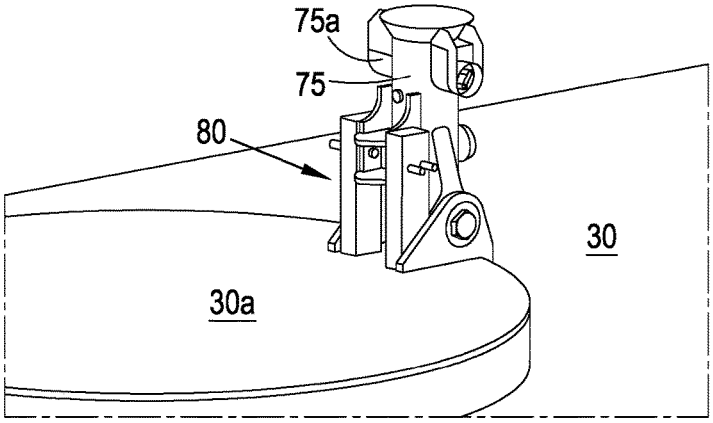
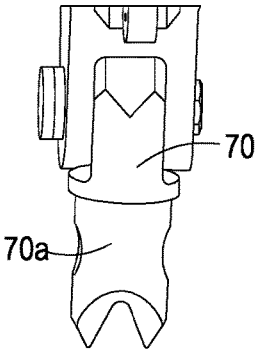
Figure 5(b)
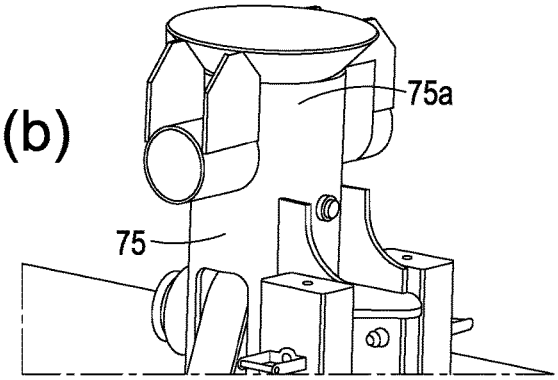

MOORING TENSIONER AND METHODS THEREOF

RELATED APPLICATIONS

This application is a 35 U.S.C. § 371 national stage application of PCT Application No. PCT/GB2017/052213, filed on Jul. 28, 2017, which claims priority from Great Britain Patent Application No. 1707671.2, filed on May 12, 2017; Great Britain Patent Application No. 1617187.8, filed on Oct. 10, 2016, and Great Britain Patent Application No. 1613248.2, filed on Aug. 1, 2016, the contents of which are incorporated herein by reference in their entireties. The above-referenced PCT International Application was published in the English language as International Publication No. WO 2018/025018 A1 on Feb. 8, 2018.

FIELD OF INVENTION

The present invention relates to an apparatus for mooring a structure, e.g. to a seabed or the like, and associated devices, systems and methods.

BACKGROUND TO INVENTION

Offshore structures, such as floating structures or floating platforms, can be moored by mooring lines. This can include attaching the mooring lines to the structure to be moored and applying a pre-determined tension to each of the mooring lines. The necessary tension can be applied to the mooring lines, e.g. by using winches that may be provided on the structure to be moored. Such winches can be costly and may only be used intermittently, e.g. during the initial mooring of the structure, relocation of the structure and in response to changing conditions at the mooring site. The installation of a winch on each structure to be moored can become cost and/or time intensive.

In order to connect a line or lines for the installation, mooring or anchoring of equipment used subsea or underwater, e.g. in oil, gas, offshore wind and tidal energy industries, there needs to be a means of connecting and disconnecting the line or lines.

A coupling apparatus may be used for connecting the mooring lines from the structure to a seabed. The apparatus may include a guide that can direct a free end of a mooring line towards a surface or seabed to enable adjustment of the tension in the mooring lines, e.g. by a winch located on a vessel. During tensioning of the mooring line, bending strain can act on the mooring line due it being pulled and bend around the guide of the apparatus. This can lead to increased wear and/or damages of the mooring line and/or apparatus. In order to minimise the strain on the mooring line, the size of the coupling apparatus may be increased to accommodate larger angles for guiding the mooring line towards the surface. However, this can lead to an increased costs and weight of the coupling apparatus.

EP 1 318 072 A2 (DEEPMOOR LIMITED) discloses a floating platform having a mooring line which passes through a coupling apparatus tethered to a suction anchor. The coupling apparatus allows an effective length of the mooring line between a platform and the anchor to be adjusted using a vessel independent of the platform. The vessel pulls the mooring line through the coupling apparatus, reducing the effective length of mooring line, until the floating platform is in a desired position. The coupling apparatus includes a locking device to prevent the effective length of the mooring line from changing once the floating platform is in the desired position.

The installation and maintenance of a mooring apparatus in an offshore or underwater environment may require high levels of skill, the use of divers, operators, and/or Remotely Operated underwater Vehicles (ROVs), and may incur significant expense and risk. The general manoeuvrability and capabilities of ROVs is limited, and thus undertaking intricate tasks in an underwater environment may be prohibitively complex and time consuming.

This background serves only to set a scene to allow a skilled reader to better appreciate the following description. Therefore, none of the above discussion should necessarily be taken as an acknowledgement that that discussion is part of the state of the art or is common general knowledge. One or more aspects/embodiments of the invention may or may not address one or more of the background issues.

It is an object of at least one embodiment of at least one aspect of the present invention to obviate or at least mitigate at least one of the problems in the prior art.

It is an object of at least one embodiment of at least one aspect of the present invention to provide a technically simple and/or commercially more cost effective method of mooring and mooring apparatus than in the prior art.

SUMMARY OF INVENTION

According to a first aspect of the present invention there is provided an apparatus for mooring a structure, e.g. to a seabed, river or lake bed, ocean floor or the like. The apparatus may be, be utilised as or comprise an underwater apparatus for mooring a structure or a subsea apparatus for mooring a structure. A structure may be or comprise a structure to be moored or a structure that may be moored, e.g. in use. The apparatus may be configured to permit tensioning of a line coupled and/or connected to a structure. A line may be or comprise a mooring line, offshore mooring line, underwater mooring line or subsea mooring line.

The apparatus may comprise a first portion, e.g. for receiving a portion of a line extending from a structure.

The apparatus may comprise a guide portion, e.g. for guiding a/the portion of a line received by the first portion. The guide portion may be movably, e.g. pivotably or rotatably, connected or connectable to the first portion.

The apparatus may comprise a second portion, e.g. for connecting or coupling the apparatus to a seabed or a further structure located thereon. The second portion may be movably, e.g. pivotably or rotatably, connected or connectable to the first portion and/or guide portion.

The apparatus may comprise or define an axis, e.g. a rotational axis. The first portion, the second portion and/or the guide portion may be arranged to be movable, e.g. rotatable or pivotable, around or about the axis of the apparatus. In other words, the first portion, the guide portion and/or the second portion may be coaxially arranged relative to each other. The coaxial arrangement of the first portion, guide portion and/or second portion may permit the first portion, guide portion and/or second portion to be aligned relative to each other during pull-in and/or tensioning a line, e.g. a line or a portion thereof, which may be received in or threaded through the apparatus or a portion thereof, e.g. in use. This may reduce out of plane strain acting on the apparatus and/or a line, e.g. in use, e.g. during pull-in and/or tensioning of a line, e.g. a line or a portion thereof, which may be received in or threaded through the apparatus or a portion thereof. This may lead to a reduction of losses, e.g. due to friction between a line under tension and the apparatus, e.g. during pull-in and/or tensioning of a line. It other words, the coaxial arrangement may facilitate pull-in and/or tensioning of a line.

The apparatus may comprise a line engaging device. The line engaging device may be or comprised in a chain stopper or means for engaging a chain. The line engaging device may be or comprise a means for engaging a chain as described in WO 2015/150770 (by the present applicant), which is hereby incorporated by reference. The line engaging device may be configured to permit movement of a line, e.g. a line or a portion thereof, which may be received in or threaded through the apparatus, in a first direction relative to the apparatus, e.g. in a direction towards the guide portion. The line engaging device may be configured to prohibit movement of a line, e.g. a line or a portion thereof, which may be received or threaded through the apparatus, in a second direction relative to the apparatus, e.g. in a direction towards a structure. The line engaging device may be movably connected or connectable to the first portion. For example, the line engaging device may be connected to the first portion so that the line engaging device may be movable, e.g. rotatable or privotable and/or slidable, relative to the first portion.

The line engaging device may be connected or connectable to the first portion to be movable, actuatable and/or operable between a first position and a second position. The line engaging device may be configured to be movable, operable and/or actuatable from the first position to the second position, e.g. when tension is applied to at least one end, e.g. a free end, or at least two ends, e.g. a free end and a distal end, of a line, e.g. a line or a portion thereof, which may be received in or threaded through the apparatus. The line engaging device may be configured to be movable, operable and/or actuatable from the second position to the first position, e.g. when tension is released from at least one end, e.g. a free end, of a line, e.g. a line or a portion thereof, which may be received in or threaded through the apparatus. For example, in use, a distal end of a line, which may be connected or connectable to a structure may be tensioned or be under tension.

The apparatus may be or be configured to be operable, movable and/or actuatable between a first configuration and a second configuration. In the first configuration of the apparatus, the line engaging device may be in the first position. In the second configuration of the apparatus, the line engaging device may be in the second position. In the first configuration of the apparatus, the first and second portions may be arranged relative to each other such that a longitudinal axis of the first portion may be substantially in line, collinear or coaxial with a longitudinal axis of the second portion. The apparatus may be configured or arranged such that in the first configuration of the apparatus, a/the longitudinal axis of the apparatus may be substantially in line, collinear or coaxial with a longitudinal axis of a line or a portion thereof extending from a structure. The apparatus may be configured or arranged such that in the first configuration of the apparatus the axis may be substantially co-planar with a longitudinal axis of a line or portion thereof extending from a structure and/or the axis extends in a direction substantially perpendicular to a longitudinal axis of a line or portion thereof extending from a structure. In the first configuration of the apparatus, out of plane strain acting on the apparatus and/or a line may be reduced.

In the first configuration, the line engaging means may be configured to engage or be engageable with a line or portion thereof, e.g. to prevent movement of a line in the second direction.

In the second configuration of the apparatus, the first portion and second portion may be arranged relative to each other such that a/the longitudinal axis of the first portion may extend at an angle relative to a/the longitudinal axis of the second portion. The apparatus may be configured such that in the second configuration of the apparatus a/the longitudinal axis of the first portion extends at an angle, e.g. an acute angle, relative to a longitudinal axis of a line or portion thereof extending from a structure. This may reduce out of plane strain acting on the apparatus and/or a line e.g. in use, e.g. during pull-in and/or tensioning of a line, e.g. a line or a portion thereof, which may be received in or threaded through the apparatus or a portion thereof. This may lead to a reduction of losses, e.g. due to friction between a line under tension and the apparatus, e.g. during pull-in and/or tensioning of a line.

In the second configuration, the line engaging means may be configured to disengage or be disengageable, e.g. partially or fully disengage or be disengageable, from a line or portion thereof, e.g. to prohibit movement of a line or portion thereof in the first direction.

The apparatus may be configured or arranged, e.g. the guide portion may be connected or connectable to the first portion, such that the axis of the apparatus may extend in a direction substantially perpendicular to a/the longitudinal axis of the first portion. The apparatus may be configured or arranged, e.g. the guide portion may be connected or connectable to the first portion, such that a/the longitudinal axis of the first portion may intersect the axis of the apparatus.

The second portion may be configured to receive, mount and/or support a mounting element of a line, e.g. a mounting element connected to at least one end, e.g. a free end, of a line, e.g. a line or a portion thereof, which may be received in or threaded through the apparatus. For example, the second portion may mount a mounting element of a line, when tension on at least one end of a line is released. This may permit secure parking or holding of an end of a line, e.g. a free end of a line.

The second portion may be configured to align a mounting element connected to at least one end, e.g. a free end, of a line, e.g. a line or a portion thereof, which may be received in or threaded through the apparatus, relative to the apparatus. The second portion may be configured to align at least one end, e.g. a free end, of a line, e.g. a line or a portion thereof, which may be received in or threaded through the apparatus, relative to the apparatus. This may maintain a line or an end of a line, e.g. a free end of a line, in alignment relative to the apparatus. For example in cases where the line may be or comprise a chain, the configuration of the second portion may prevent misalignment or bending of parts of a chain. This may reduce strain, damage and/or wear of a line/chain. The configuration of the second portion may facilitate connection of a wire, e.g. work wire, to a line, e.g. a mounting element of a line, e.g. during a pull-in and/or tensioning process.

The apparatus may comprise a groove or recess and/or a protrusion. The groove or recess and/or protrusion may be part of or comprised in the second portion. The groove or recess and/or protrusion may be shaped for mounting and/or supporting a mounting element of a line, e.g. a mounting element connected to at least one end, e.g. a free end, of a line, e.g. a line or a portion thereof, which may be received in or threaded through the apparatus. The groove or recess and/or protrusion may be arranged and/or shaped to cooperate with a further protrusion of a mounting element, e.g. a mounting element connected to at least one end, e.g. a free end, of a line, e.g. a line or a portion thereof, which may be received in or threaded through the apparatus, e.g. to enable mounting of a mounting element on the apparatus, e.g. the second portion.

The apparatus may comprise a first connector portion. The first connector portion may be part of or comprised in the second portion. The first connector portion may be (provided) for complementary mating with a corresponding second connector portion. The first connector portion may be part of or comprised in a subsea or underwater connector, e.g. a subsea or underwater mooring connector. The first connector portion may be moveably, e.g. rotatably or pivotably, connected or connectable to the second portion.

The second portion may be configured to connect or couple the apparatus to another line or a portion thereof e.g. a line extending from a seabed or a further structure located thereon. The second portion may be configured to be moveably, e.g. rotatably or pivotably, connected or connectable to another line or a portion thereof, e.g. a line extending from a seabed or a further structure located thereon.

According to a second aspect of the present invention there may be provided a system for mooring a structure. The system may comprise an apparatus for mooring a structure. The apparatus may be or comprise an apparatus for mooring a structure according to the first aspect.

The system may comprise a line. The line may be or comprise a mooring line, offshore mooring line, underwater mooring line or subsea mooring line. A portion of the line may be threaded or threadable through the apparatus, e.g. in use. The line may be or comprise a chain, wire or rope or the like. A first end, e.g. a distal end, of the line may be configured to be connected or connectable to a structure. The structure may be part of or comprised in the system. The structure may be or comprise a floating structure, offshore structure, vessel, floating platform, subsea structure, underwater structure or buoy.

The line may comprise a second end, e.g. a free end. The second end of the line may be configured to be connected or connectable to a mounting element. The mounting element may be part of or comprised in the system and/or line. The mounting element may be configured to be mounted or mountable on or to the second portion of the apparatus. The mounting element comprises a further protrusion. The further protrusion may be configured, arranged and/or shaped to cooperate with a/the groove and/or protrusion of the second portion of the apparatus, e.g. to enable mounting of the mounting element on or to the apparatus. The further protrusion may be configured, arranged and/or shaped to cooperate with a/the groove and/or protrusion of the apparatus, e.g. the second portion of the apparatus, e.g. to enable alignment of the mounting element and/or the second end of the line relative to the apparatus, e.g. the second portion of the apparatus.

The system may comprise another line. The other line may be or comprise another mooring line, offshore mooring line, underwater mooring line or subsea mooring line. A first end of the other line may be configured to be connected or connectable to a seabed or a further structure located thereon. A second end of the other line may be configured to be connected, coupled, coupleable or connectable to the second portion of the apparatus.

The system comprises a connector. The connector may be or comprise a mooring connector, underwater mooring connector or subsea mooring connector. The connector may be or comprise a subsea connector as described in WO 2013/186553 (by the present applicant), which is hereby incorporated by reference. A first connector portion may be configured to be connected or connectable to the apparatus, e.g. the second portion of the apparatus. A second connector portion may be configured to be connected or connectable to a seabed or a further structure located thereon. The first portion of the connector may be configured for complementary mating with the second portion of the connector.

According to a third aspect of the present invention there is provided a method for mooring a structure. The method may comprise providing an apparatus according to the first aspect and/or a system according to the second aspect. The method may comprise locating the apparatus at a site or location e.g. a subsea or underwater site or location. The method may comprise connecting the structure to the apparatus or a portion thereof. The step of connecting may comprise comprises connecting the first end, e.g. the distal end, of a/the line to the structure and/or threading the second end, e.g. the free end, of the line through the apparatus and/or connecting.

The method may comprise connecting or coupling the apparatus to a seabed or a further structure located thereon.

The method may comprise adjusting and/or varying a tension in the line. The method may comprise applying tension to the second end of the line, e.g. by moving or pulling-in of the second end of the line or a yet further line connected to the second end of the line.

The method may comprise moving or pulling the second end of the line or a/the yet further line connected to the second end of the line, e.g. to adjust tension in the line and/or length of the line or a portion of the line extending between the apparatus and the structure, e.g. by using a pulling and/or tensioning arrangement, e.g. a winch and/or motor or the like, or an Remotely Operated Vehicle (ROV). The pulling or tensioning arrangement may be provided on a yet further structure, e.g. a vessel, floating platform, offshore structure or the like. The step of moving or pulling the first end of the line may comprise moving, actuating and/or operating the apparatus from first configuration into the second configuration.

According to a fourth aspect of the present invention there is provided a portion, e.g. for use in an apparatus for mooring a structure and/or a system for mooring a structure. The apparatus may be or comprise an apparatus for mooring a structure according to the first aspect. The system may be or comprise a system for mooring a structure according to the second aspect. The portion may be configured to receive, support and/or mount a mounting element of a line. The portion may comprise any features of the second portion of the apparatus according to the first aspect and/or the system according to the second aspect.

According to a fifth aspect of the present invention there is provided a mounting element of a line. The mounting element may be configured to be mounted or for mounting on a portion, e.g. of an apparatus for mooring a structure according to the fourth aspect.

According to a sixth aspect of the present invention there is provided a method of installing a mooring line or mooring line assembly comprising:

providing first and second mooring lines;

providing a retention, clamping and/or tensioning device for retaining, clamping and/or tensioning the first and second lines together so as to provide a mooring line assembly;

connecting a distal end of one of the mooring lines to an anchor.

The mooring line assembly may be referred to as a pre-set mooring line assembly.

Connecting one end of the mooring line to a subsea anchor may be preceded by lowering the mooring line assembly within a body of water.

Advantageously the distal end of the one of the mooring lines comprises a first, e.g. male, connector portion. The anchor may comprise a second (complementary), e.g. female, connector portion, which may mate, e.g. connectably or seacurably, with the first connector portion.

The female connector portion may be provided on one end of a yet further line, another end of the yet further line being connected to the anchor.

A holder may be provided on the anchor to releasably hold the female connector portion, e.g. in a first disposition, e.g. a vertical disposition. This arrangement may facilitate lowering the male connector portion, e.g. vertically, into the female connector portion.

The female connector may be released from the holder if and/or when tension is applied to the yet further line. The other mooring line may pass or be threaded through the retaining, clamping and/or tensioning device.

According to a seventh aspect of the present invention there is provided a method of mooring, such as offshore mooring, such as mooring of a buoyant structure, the method comprising:

installing a mooring line assembly according to the sixth aspect of the present invention;

connecting a distal end of the other one of the mooring lines to a/the structure.

The method may also comprise the step of adjusting tension on the mooring line(s), e.g. by putting on an another end of one of the lines, e.g. which end comprises one of the distal ends.

According to a eighth aspect of the present invention there is provided a method of installing a mooring line assembly comprising:

providing a first mooring line;

providing a retention, clamping and/or tensioning device for retaining, clamping and/or tensioning the first line so as to provide a mooring line assembly;

connecting the retention, clamping and/or tensioning device to an anchor.

Advantageously the retention, clamping and/or tensioning device comprises a first, e.g. male, connector portion. The anchor may comprise a second (complementary), e.g. female connector portion, which may mate, e.g. connectably or securably mate, with the first connector portion.

The female connector portion may be provided on one end of a yet further line, another end of the yet further line being connected to the anchor.

A holder may be provided on the anchor to releasably hold the female connector portion, e.g. in a first disposition, e.g. a vertical disposition. This arrangement may facilitate lowering the male connector portion, e.g. vertically, into the female connector portion.

The female connector may be released from the holder if and/or when tension is applied to the yet further line.

The mooring line may pass or be threaded through the retaining, clamping and/or tensioning device.

According to a ninth aspect of the present invention there is provided a method of mooring, such as offshore mooring, such as mooring of a buoyant structure, the method comprising:

installing a mooring line assembly according to the eighth aspect of the present invention;

connecting a distal end of the first mooring line to a/the structure.

According to a tenth aspect of the present invention there is provided a mooring line assembly according to the sixth or eighth aspects of the present invention.

According to a eleventh aspect of the present invention there is provided a mooring system comprising a mooring line assembly according to the tenth aspect of the present invention.

The following statements may apply to any of the sixth to eleventh aspects of the present invention.

According to an embodiment of the present invention there is provided (a tensioner) an apparatus, device, e.g. the retention, clamping and/or tensioning device, for mooring a structure, e.g. to a seabed, river or lake bed, ocean floor or the like. The apparatus may be utilised as or comprise an underwater apparatus for mooring a structure or a subsea apparatus for mooring a structure. A structure may be or comprise a structure to be moored or a structure that may be moored, e.g. in use. The apparatus may be configured to permit tensioning of a/one of the/the (first mooring) line(s) coupled and/or connected to a/the structure. A/one of the lines of the first/the (first mooring) line(s) line may be or comprise a mooring line, offshore mooring line, underwater mooring line or subsea mooring line.

The apparatus may comprise a first portion, e.g. for receiving a portion of a/one of the/the (first mooring) line(s) extending from a/the structure.

The apparatus may comprise a guide portion, e.g. for guiding a/the portion of a line received by the first portion. The guide portion may be movably, e.g. pivotably or rotatably, connected or connectable to the first portion.

The apparatus may comprise a second portion, e.g. for connecting or coupling the apparatus to a seabed or a further structure located thereon. The second portion may be movably, e.g. pivotably or rotatably, connected or connectable to the first portion and/or guide portion.

The apparatus may comprise or define an axis, e.g. a rotational axis. The first portion, the second portion and/or the guide portion may be arranged to be movable, e.g. rotatable or pivotable, around or about the axis of the apparatus. In other words, the first portion, the guide portion and/or the second portion may be coaxially arranged relative to each other. The coaxial arrangement of the first portion, guide portion and/or second portion may permit the first portion, guide portion and/or second portion to be aligned relative to each other during pull-in and/or tensioning a line, e.g. a line or a portion thereof, which may be received in or threaded through the apparatus or a portion thereof, e.g. in use. This may reduce out of plane strain acting on the apparatus and/or a line, e.g. in use, e.g. during pull-in and/or tensioning of a line, e.g. a line or a portion thereof, which may be received in or threaded through the apparatus or a portion thereof. This may lead to a reduction of losses, e.g. due to friction between a line under tension and the apparatus, e.g. during pull-in and/or tensioning of a line. It other words, the coaxial arrangement may facilitate pull-in and/or tensioning of a line.

The apparatus may comprise a line engaging device or chain stopper. The line engaging device may be or comprised in a chain stopper or means for engaging a chain. The line engaging device may be or comprise a means for engaging a chain as described in WO 2015/150770 (by the present Applicant), the content of which is hereby incorporated by reference. The line engaging device may be configured to permit movement of a/one of the/the (first mooring) line(s), e.g. a line or a portion thereof, which may be received in or threaded through the apparatus, in a first direction relative to the apparatus, e.g. in a direction towards the guide portion. The line engaging device may be configured to prohibit movement of a/one of the/the (first mooring) line(s), e.g. a line or a portion thereof, which may be received or threaded through the apparatus, in a second direction relative to the apparatus, e.g. in a direction towards a structure. The line engaging device may be movably connected or connectable to the first portion. For example, the line engaging device may be connected to the first portion so that the line engaging device may be movable, e.g. rotatable or privotable and/or slidable, relative to the first portion.

The line engaging device may be connected or connectable to the first portion to be movable, actuatable and/or operable between a first position and a second position. The line engaging device may be configured to be movable, operable and/or actuatable from the first position to the second position, e.g. when tension is applied to at least one end, e.g. a free end, or at least two ends, e.g. a free end and a distal end, of a/one of the/the (first mooring) line(s), e.g. a line or a portion thereof, which may be received in or threaded through the apparatus. The line engaging device may be configured to be movable, operable and/or actuatable from the second position to the first position, e.g. when tension is released from at least one end, e.g. a free end, of alone of the/the (first mooring) line(s), e.g. a line or a portion thereof, which may be received in or threaded through the apparatus. For example, in use, a distal end of a/one of the/the (first mooring) line(s), which may be connected or connectable to a structure may be tensioned or be under tension.

The apparatus may be or be configured to be operable, movable and/or actuatable between a first configuration and a second configuration. In the first configuration of the apparatus, the line engaging device may be in the first position. In the second configuration of the apparatus, the line engaging device may be in the second position. In the first configuration of the apparatus, the first and second portions may be arranged relative to each other such that a longitudinal axis of the first portion may be substantially in line, collinear or coaxial with a longitudinal axis of the second portion. The apparatus may be configured or arranged such that in the first configuration of the apparatus, a/the longitudinal axis of the apparatus may be substantially in line, collinear or coaxial with a longitudinal axis of a line or a portion thereof extending from a structure. The apparatus may be configured or arranged such that in the first configuration of the apparatus the axis may be substantially co-planar with a longitudinal axis of a/one of the/the (first mooring) line(s) or portion thereof extending from a structure and/or the axis extends in a direction substantially perpendicular to a longitudinal axis of a line or portion thereof extending from a structure. In the first configuration of the apparatus, out of plane strain acting on the apparatus and/or a line may be reduced.

In the first configuration, the line engaging means may be configured to engage or be engageable with a/one of the/the (first mooring) line(s) or portion thereof, e.g. to prevent movement of a/one of the/the (first mooring) line(s) in the second direction.

In the second configuration of the apparatus, the first portion and second portion may be arranged relative to each other such that a/the longitudinal axis of the first portion may extend at an angle relative to a/the longitudinal axis of the second portion. The apparatus may be configured such that in the second configuration of the apparatus a/the longitudinal axis of the first portion extends at an angle, e.g. an acute angle, relative to a longitudinal axis of a/one of the/the (first mooring) line(s) or portion thereof extending from a structure. This may reduce out of plane strain acting on the apparatus and/or a/one of the/the (first mooring) line(s) e.g. in use, e.g. during pull-in and/or tensioning of a/one of the/the (first mooring) line(s), e.g. a/one of the/the (first mooring) line(s) or a portion thereof, which may be received in or threaded through the apparatus or a portion thereof. This may lead to a reduction of losses, e.g. due to friction between a line under tension and the apparatus, e.g. during pull-in and/or tensioning of a/one of the/the (first mooring) line(s).

In the second configuration, the line engaging means may be configured to disengage or be disengageable, e.g. partially or fully disengage or be disengageable, from a/one of the/the (first mooring) line(s) or portion thereof, e.g. to prohibit movement of a/one of the/the (first mooring) line(s) or portion thereof in the first direction.

The apparatus may be configured or arranged, e.g. the guide portion may be connected or connectable to the first portion, such that the axis of the apparatus may extend in a direction substantially perpendicular to a/the longitudinal axis of the first portion. The apparatus may be configured or arranged, e.g. the guide portion may be connected or connectable to the first portion, such that a/the longitudinal axis of the first portion may intersect the axis of the apparatus.

The second portion may be configured to receive, mount and/or support a mounting element of a/one of the/the (first mooring) line(s), e.g. a mounting element connected to at least one end, e.g. a free end, of a/one of the/the (first mooring) line(s), e.g. a/one of the/the (first mooring) line(s) or a portion thereof, which may be received in or threaded through the apparatus. For example, the second portion may mount a mounting element of a/the line, when tension on at least one end of a line is released. This may permit secure parking or holding of an end of a/one of the/the (first mooring) line(s), e.g. a free end of a line.

The second portion may be configured to align a mounting element connected to at least one end, e.g. a free end, of a/one of the/the (first mooring) line(s), e.g. a/one of the/the (first mooring) line(s) or a portion thereof, which may be received in or threaded through the apparatus, relative to the apparatus. The second portion may be configured to align at least one end, e.g. a free end, of a/one of the/the (first mooring) line(s), e.g. a/one of the/the (first mooring) line(s) or a portion thereof, which may be received in or threaded through the apparatus, relative to the apparatus. This may maintain a/one of the/the (first mooring) line(s) or an end of a line, e.g. a free end of a/one of the/the (first mooring) line(s), in alignment relative to the apparatus. For example in cases where the line may be or comprise a chain, the configuration of the second portion may prevent misalignment or bending of parts of a chain. This may reduce strain, damage and/or wear of a line/chain. The configuration of the second portion may facilitate connection of a wire, e.g. work wire, to a line, e.g. a mounting element of a line, e.g. during a pull-in and/or tensioning process.

The apparatus may comprise a groove or recess and/or a protrusion. The groove or recess and/or protrusion may be part of or comprised in the second portion. The groove or recess and/or protrusion may be shaped for mounting and/or supporting a mounting element of a/one of the/the (first mooring) line(s), e.g. a mounting element connected to at least one end, e.g. a free end, of a/one of the/the (first mooring) line(s), e.g. a/one of the/the (first mooring) line(s) or a portion thereof, which may be received in or threaded through the apparatus. The groove or recess and/or protrusion may be arranged and/or shaped to cooperate with a further protrusion of a mounting element, e.g. a mounting element connected to at least one end, e.g. a free end, of a/one of the/the (first mooring) line(s), e.g. a/one of the/the (first mooring) line(s) or a portion thereof, which may be received in or threaded through the apparatus, e.g. to enable mounting of a mounting element on the apparatus, e.g. the second portion.

In an embodiment the apparatus may comprise a first connector portion. The first connector portion may be part of or comprised in the second portion. The first connector portion may be (provided) for complementary mating with a corresponding second connector portion. The first connector portion may be part of or comprised in a subsea or underwater connector, e.g. a subsea or underwater mooring connector. The first connector portion may be moveably, e.g. rotatably or pivotably, connected or connectable to the second portion.

In an embodiment the second portion may be configured to connect or couple the apparatus to another line or a portion thereof e.g. a line extending from a seabed or a further structure located thereon. The second portion may be configured to be moveably, e.g. rotatably or pivotably, connected or connectable to another line or a portion thereof, e.g. a line extending from a seabed, e.g. a/the and/or a further structure located thereon.

According to an embodiment of the present invention there may be provided a system for mooring a structure. The mooring system may comprise an apparatus for mooring a structure. The apparatus may be or comprise an apparatus for mooring a structure according to the eleventh aspect of the present invention.

The system may comprise a/one of the/the (first mooring) line(s). The/one of the/the (first mooring) line(s) may be or comprise a mooring line, offshore mooring line, underwater mooring line or subsea mooring line. A portion of the line may be threaded or threadable through the apparatus, e.g. in use. The line may be or comprise a chain, wire or rope or the like. A first end, e.g. a distal end, of the line may be configured to be connected or connectable to a structure. The structure may be part of or comprised in the system. The structure may be or comprise a floating structure, offshore structure, vessel, floating platform, subsea structure, underwater structure or buoy.

The line may comprise a second end, e.g. a free end. The second end of the line may be configured to be connected or connectable to a mounting element. The mounting element may be part of or comprised in the system and/or line. The mounting element may be configured to be mounted or mountable on or to the second portion of the apparatus. The mounting element comprises a further protrusion. The further protrusion may be configured, arranged and/or shaped to cooperate with a/the groove and/or protrusion of the second portion of the apparatus, e.g. to enable mounting of the mounting element on or to the apparatus. The further protrusion may be configured, arranged and/or shaped to cooperate with a/the groove and/or protrusion of the apparatus, e.g. the second portion of the apparatus, e.g. to enable alignment of the mounting element and/or the second end of the line relative to the apparatus, e.g. the second portion of the apparatus.

The system may comprise another/the one of the line(s). The other/the one of the line(s) may be or comprise another mooring line, offshore mooring line, underwater mooring line or subsea mooring line. A first end of the other/the one of the line(s) may be configured to be connected or connectable to a seabed, e.g. to an/the anchor or a further structure located thereon. A second end of the other/the one of the line(s) may be configured to be connected, coupled, coupleable or connectable to the second portion of the apparatus.

The system comprises a connector. The connector may be or comprise a mooring connector, underwater mooring connector or subsea mooring connector. The connector may be or comprise a subsea connector as described in WO 2013/186553 (by the present Applicant), the content of which is hereby incorporated by reference. A first connector portion may be configured to be connected or connectable to the apparatus, e.g. the second portion of the apparatus. A second connector portion may be configured to be connected or connectable to a seabed, e.g. to an anchor, or a further structure located thereon. The first portion of the connector may be configured for complementary mating with the second portion of the connector.

According to an embodiment of the present invention there is provided a method for mooring a structure. The method may comprise providing a mooring line assembly according to the tenth aspect and/or a mooring system according to the eleventh aspect.

The method may comprise connecting or coupling the assembly to a seabed, e.g. an anchor, or a further structure located thereon.

The method may comprise locating the assembly at a site or location e.g. a subsea or underwater site or location. The method may comprise (thereafter) connecting the structure to the assembly or a portion thereof. The step of connecting may comprise connecting the first end, e.g. the distal end, of a/one of the/the (first mooring) line(s) to the structure and/or threading the second end, e.g. the free end, of the line through the apparatus.

The method may thereafter comprise adjusting and/or varying a tension in a/one of the/the (first mooring) line(s). The method may comprise applying tension to the second end of the line, e.g. by moving or pulling-in of the second end of the line or a yet further line connected to the second end of a/one of the/the (first mooring) line(s).

The method may comprise moving or pulling the second end of a/one of the/the (first mooring) line(s) or a/the yet further line connected to the second end of the line, e.g. to adjust tension in the line and/or length of the line or a portion of the line extending between the apparatus and the structure, e.g. by using a pulling and/or tensioning arrangement, e.g. a winch and/or motor or the like, or an Remotely Operated Vehicle (ROV). The pulling or tensioning arrangement may be provided on a yet further structure, e.g. a vessel, floating platform, offshore structure or the like. The step of moving or pulling the first end of a/one of the/the (first mooring) line(s) may comprise moving, actuating and/or operating the apparatus from first configuration into the second configuration.

According to an embodiment of the present invention there is provided a portion, e.g. for use in an apparatus for mooring a structure and/or a system for mooring a structure. The apparatus may be or comprise an apparatus for mooring a structure. The system may be or comprise a system for mooring a structure. The portion may be configured to receive, support and/or mount a mounting element of a line. The portion may comprise any features of the second portion of the apparatus hereinbefore disclosed.

According to another embodiment of the present invention there is provided a mounting element of a line. The mounting element may be configured to be mounted or for mounting on a portion, e.g. of an apparatus for mooring a structure.

According to a twelfth aspect of the present invention there is provided a method of installing a mooring line or mooring line assembly comprising the steps of:

- providing a mooring line;
- providing a retention and tensioning device comprising a first portion of a connector,
  - the first portion of the connector adapted to be retained by a second portion of the connector and the device adapted to apply and/or maintain a tension in the mooring line; and loading the device with a first portion of the mooring line.

The first portion of the mooring line may be an end portion of the mooring line.

The step of loading of the device with a first portion of the mooring line may comprise retainably loading the device with a first portion of the mooring line.

The device and the mooring line, when the device is loaded with and/or connected to the mooring line and/or when the mooring line is under tension, may be considered to be the mooring line assembly.

At least a portion of the mooring line, and in particular at least one end of the mooring line, may comprise a chain. At least a portion of the mooring line may be a chain, wire, rope, or the like, or may comprise at least in part a polymeric material, e.g. polyester, or the like.

The method may comprise a step of providing, or installing, a subsea anchor. The anchor may be, or may comprise, a pile, such as a suction pile or the like. The anchor may be a subsea formation. The anchor may be adapted for use on a seabed. The anchor may be at least partially submerged. The anchor may be installed on or below the subsea. The anchor may be installed by a vessel, such as a pile vessel. The step of installing the subsea anchor may comprise a step of driving the anchor into the seabed by means of a pile, such as a suction pile or the like. The step of installing the subsea anchor may comprise a step of removing a pile. The anchor may be a Suction Embedded Plate Anchor (SEPLA), or the like.

The method may comprise a step of providing a buoyant structure. The buoyant structure may be a structure to be moored. The structure may be a ship, a rig, a floating platform, or the like. The buoyant structure may be wind turbine, or a portion thereof. The structure may be a buoy, such as a submersible buoy, a semisubmersible buoy, a submerged turret production buoy, a submerged turret loading buoy or the like.

The method may comprise a step of lowering the mooring line assembly within a body of water. The method may comprise the step of lowering the mooring line and/or the device from a vessel and/or a first line. The method may comprise the step of extending the mooring line and/or the first line from the vessel.

The method may comprise a step of retaining the first portion of the connector by the second portion of the connector. The first portion of the connector may be positioned at a distal end of the device. The first portion of the connector may comprise a first, e.g. male, connector portion. The subsea anchor may comprise a second (complementary), e.g. female, connector portion, which may mate, e.g. connectably, securably, or retainably, with the first connector portion.

The second connector portion may be provided on one end of a second line, another end of the second line being connected to the anchor. The second connector may be provided on, or may comprise, at least one single axis joint or a dual axis joint, such as a universal joint.

A holder may be provided on the anchor to releasably hold the female connector portion, e.g. in a first disposition, e.g. a vertical disposition. This arrangement may facilitate lowering the male connector portion, e.g. vertically, into the female connector portion.

The method may comprise a step of raising and/or laterally moving the device and/or the mooring line assembly within a body of water. The raising of the device and/or the mooring line assembly may be achieved by applying a pulling force, directly or indirectly, to the mooring line and/or the mooring line assembly. The raising of the device and/or the mooring line assembly may be achieved by hauling in or winching the mooring line onto/into a vessel, or otherwise applying a tension to the mooring line.

The raising of the device and/or the mooring line assembly may be achieved by relocating the vessel to which the mooring line and/or first and/or second line is directly or indirectly attached.

In the case of a Suction Embedded Plate Anchor (SEPLA), or the like, the step of raising the device and/or the mooring line assembly within a body of water may detach the second connector from a docking station, cradle, or the like. The second connector may remain connected to an anchor, such as a plate anchor, or the like.

The method may comprise a step of directly or indirectly attaching a second portion of the mooring line to the buoyant structure. The mooring line may be attached to the buoyant structure by means of a connector apparatus and/or methods of use as described in WO 2014/155094 A1 (by the present Applicant), the content of which is hereby incorporated by reference. The mooring line may be attached to the buoyant structure by means of a connector apparatus and/or methods of use of the apparatus as described GB 1706745.5 (by the present Applicant), the content of which is hereby incorporated by reference. The mooring line may be attached to the buoyant structure by means of a connector apparatus and/or methods of use of the apparatus as described GB 1706743.0 (by the present Applicant), the content of which is hereby incorporated by reference.

The method may comprise a step of connecting the first portion of the mooring line to a third line. The first portion of the mooring line may comprise a mounting element. The mounting element may be configured to permit connecting of the mounting element and/or the first portion of the mooring line to the third line. At least a portion of the third line may be a chain, wire, rope, or the like, or may comprise at least in part a polymeric material, e.g. polyester, or the like.

The method may comprise a step of applying a tension, directly or indirectly, to the third line. The method may further comprise a step of applying a tension, directly or indirectly, to the mooring line. Tension may be applied to the third line and/or the mooring line by means of a winch, motor, pulley or the like located on the vessel. Another line may be used in place of, or in addition to, the third line.

The method may comprise a step of adapting the device such that a line engaging device restrict or inhibits movement of at least a portion of the mooring line relative to the device in a first direction. The device may be adapted to automatically, or semi-automatically, restrict or inhibit movement of at least a portion of the mooring line relative to the device in a first direction. The method may further comprise a step of locking or adapting the device to restrict or inhibit movement of at least a portion of the mooring line relative to the device in a first direction. The first direction may be a direction away from the device. The at least a portion of the mooring line may be the second portion of the mooring line. The device may be adapted to permit unidirectional movement of the mooring line through and/or around or about the device.

The method may comprise a step of removing a portion of the mooring line, such as the first portion of the mooring line. The removal may be by means of cutting or the like. Beneficially, removal of an excess portion of the mooring line prevents further entanglement with the device the anchor, ROVs, divers, or the like.

The method may comprise a step of detaching the first, second or third line from the device and/or the mooring line assembly.

The method may comprise a step of attaching a portion of the mooring line, such as the first portion of the mooring line, to a floatation device, such as a buoy or the like. Beneficially, the floatation device module holds an excess portion of the first mooring line away from the device.

It should be understood that any or all of the steps described herein may be implemented together, in isolation, in any practical order, and that each step may independently be executed by one or more operators, and/or using one or more vessels, wherein the operators and/or vessels may vary between steps.

According to a thirteenth aspect of the present invention there is provided a method of installing a mooring line or mooring line assembly comprising the steps of:

providing a first line;

providing a retention and tensioning device comprising a first portion of a connector, the first portion of the connector adapted to be retained by a second portion of the connector and the device adapted to apply and/or maintain a tension in a mooring line; and connecting the device to the first line.

The step of connecting the device to the first line may comprise directly or indirectly connecting the device to the first line.

The method may further comprise the step of loading, such as retainably loading, the device with a portion of the mooring line.

The indirect connection of the device to the first line may be via the mooring line.

The following statements may apply to the twelfth and/or thirteenth aspects of the present invention.

According to an embodiment of the present invention there is provided a device, e.g. the retention and tensioning device.

The device may comprise a first portion of a connector.

The first portion of the connector may be a subsea, mooring or underwater connector. The connector may comprise the first portion, a second portion and/or means for connecting the first portion and the second portion, and/or means for rotationally aligning the first portion with the second portion.

The first and/or second portions may be adapted to be connected to a respective line, such as a respective mooring line or chain. The second portion may be adapted to sit in, be received by, and/or releasably retained in or by, a cradle.

The means for rotationally aligning the first and second portion may comprise means carried by or provided on the first and/or second portion. The means for rotationally aligning may comprise a first alignment member at least partly spanning across a bore, such as an internal bore, of the first or second portion. The first alignment member may be partially transverse to the bore with respect to a longitudinal axis of the first or second portion.

The means for rotationally aligning may comprise a second alignment member, such as a rotational alignment member, provided by the other of the first or second portion. The first and second alignment members may co-act when the first and second portions are brought together or mated.

The first portion may comprise a male part.

The second portion may comprise a female part.

The means for connecting may comprise means for releasably connecting.

The means for rotationally aligning the first portion and the second portion may comprise first and second means carried by, or provided on, the first and second portions, respectively. The first and second means may comprise the first and second alignment members, respectively.

The first and second means may co-act, in use, when the first and second portions are brought together or mated.

The first means may comprise at least one first surface. The second means may comprise at least one second surface. An at least one first surface(s) and a second surface may abut one another and/or rotate with respect to one another around a longitudinal axis and/or ride-over one another when the first and second portions are longitudinally brought together or mated.

The first means may comprise at least a first prong or tooth, and advantageously first and second prongs or teeth. The first and second prongs or teeth may be diametrically or width-wise opposite one another, i.e. disposed on opposite sides of or along a common diameter or width. Each prong or tooth may be disposed on a respective radial portion of an end of the first means. A slot or recess portion may be provided between the first and second prongs or teeth.

The male part may comprise a cylindrical portion, e.g. a cylindrical mid-portion. The female part may comprise a bore, e.g. a cylindrical bore, e.g. within which the cylindrical portion is received in a substantially tight or snug fit.

The second means may comprise an elongate or cross member or alignment bar. The elongate member may at least partly span, e.g. diametrically span, the female part, e.g. the bore. The elongate member may comprise an outer (upper) facing curved surface and may be substantially cylindrical or elliptical in cross-section.

In use, insertion of the male part into the female part may cause the first means and second means to rotationally co-act or ride over one another, thereby relatively (longitudinally) rotating the male part and the female part into a pre-selected or pre-determined rotational disposition.

The first prong or tooth, and where provided second prong or tooth, may provide the at least one first surface, which may comprise an outer surface thereof.

The/each prong or teeth/tooth may comprise one or more of:

a first chamfered, sloping or angled side surface, a second chamfered, sloping or angled side surface (preferably disposed symmetrically with the first side surface), a flat/planar inner surface which may comprise a surface of the slot, and a curved outer surface. The flat planar inner surface may taper or flare outwards towards an end of the prong or tooth.

A first side surface of a first tooth may be continuous with a first side surface of a second tooth. A second side surface of a first tooth may be continuous with a second side surface of the second tooth.

The elongate member may provide the at least second surface, which may comprise an outer surface thereof, e.g. said outer (upper) facing curved surface.

Once in the pre-selected rotational disposition the first and second prongs may be disposed on respective first and second sides of the elongate member. A portion of the male part between the prongs or teeth (e.g. a root or web portion), e.g. base of the slot portion may be adjacent or in contact, e.g. abutting contact, with the elongate member.

The means for connecting the first portion and the second portion may comprise a first aperture in the male part, e.g. diametrically or width-wise spanning the cylindrical portion of the male part.

The means for connecting the first portion and the second portion may comprise at least one second aperture, e.g. a pair of diametrically opposed apertures, in the female part.

The means for connecting the first portion and the second portion may comprise a pin, e.g. a load (bearing) pin, removably receivable within the first and second apertures when such are aligned.

Beneficially, the first and second apertures are aligned in said pre-selected rotational disposition.

In use, an ROV (remotely operated vehicle) may be used to mate and/or release the first and second parts, e.g. subsea/underwater, and/or to insert and/or remove the pin.

The pin may have a tapered end, which may facilitate insertion thereof into the apertures.

The device, e.g. the retention and tensioning device, may comprise an apparatus for mooring a structure.

The apparatus may comprise a first portion, e.g. for receiving a portion of a line extending from a structure.

The apparatus may comprise a guide portion, e.g. for guiding a/the portion of a line received by the first portion. The guide portion may be movably, e.g. pivotably or rotatably, connected or connectable to the first portion.

The apparatus may comprise a second portion, e.g. for connecting or coupling the apparatus to a seabed or a further structure located thereon. The second portion may be movably, e.g. pivotably or rotatably, connected or connectable to the first portion and/or guide portion.

The apparatus may comprise or define an axis, e.g. a rotational axis. The first portion, the second portion and/or the guide portion may be arranged to be movable, e.g. rotatable or pivotable, around or about the axis of the apparatus. In other words, the first portion, the guide portion and/or the second portion may be coaxially arranged relative to each other. The coaxial arrangement of the first portion, guide portion and/or second portion may permit the first portion, guide portion and/or second portion to be aligned relative to each other during pull-in and/or tensioning a line, e.g. a line or a portion thereof, which may be received in or threaded through the apparatus or a portion thereof, e.g. in use. This may reduce out of plane strain acting on the apparatus and/or a line, e.g. in use, e.g. during pull-in and/or tensioning of a line, e.g. a line or a portion thereof, which may be received in or threaded through the apparatus or a portion thereof. This may lead to a reduction of losses, e.g. due to friction between a line under tension and the apparatus, e.g. during pull-in and/or tensioning of a line. It other words, the coaxial arrangement may facilitate pull-in and/or tensioning of a line.

The apparatus may comprise a line engaging device. The line engaging device may be or comprised in a chain stopper or means for engaging a chain. The line engaging device may be or comprise a means for engaging a chain as described in WO 2015/150770 (by the present applicant), which is hereby incorporated by reference. The line engaging device may be configured to permit movement of a line, e.g. a line or a portion thereof, which may be received in or threaded through the apparatus, in a first direction relative to the apparatus, e.g. in a direction towards the guide portion. The line engaging device may be configured to prohibit movement of a line, e.g. a line or a portion thereof, which may be received or threaded through the apparatus, in a second direction relative to the apparatus, e.g. in a direction towards a structure. The line engaging device may be movably connected or connectable to the first portion. For example, the line engaging device may be connected to the first portion so that the line engaging device may be movable, e.g. rotatable or pivotable and/or slidable, relative to the first portion.

The line engaging device may be connected or connectable to the first portion to be movable, actuatable and/or operable between a first position and a second position. The line engaging device may be configured to be movable, operable and/or actuatable from the first position to the second position, e.g. when tension is applied to at least one end, e.g. a free end, or at least two ends, e.g. a free end and a distal end, of a line, e.g. a line or a portion thereof, which may be received in or threaded through the apparatus. The line engaging device may be configured to be movable, operable and/or actuatable from the second position to the first position, e.g. when tension is released from at least one end, e.g. a free end, of a line, e.g. a line or a portion thereof, which may be received in or threaded through the apparatus. For example, in use, a distal end of a line, which may be connected or connectable to a structure may be tensioned or be under tension.

The apparatus may be or be configured to be operable, movable and/or actuatable between a first configuration and a second configuration. In the first configuration of the apparatus, the line engaging device may be in the first position. In the second configuration of the apparatus, the line engaging device may be in the second position. In the first configuration of the apparatus, the first and second portions may be arranged relative to each other such that a longitudinal axis of the first portion may be substantially in line, collinear or coaxial with a longitudinal axis of the second portion. The apparatus may be configured or arranged such that in the first configuration of the apparatus, a/the longitudinal axis of the apparatus may be substantially in line, collinear or coaxial with a longitudinal axis of a line or a portion thereof extending from a structure. The apparatus may be configured or arranged such that in the first configuration of the apparatus the axis may be substantially co-planar with a longitudinal axis of a line or portion thereof extending from a structure and/or the axis extends in a direction substantially perpendicular to a longitudinal axis of a line or portion thereof extending from a structure. In the first configuration of the apparatus, out of plane strain acting on the apparatus and/or a line may be reduced.

In the first or second configuration, the line engaging means may be configured to engage or be engageable with a line or portion thereof, e.g. to prevent movement of a line in the second direction.

In the second configuration of the apparatus, the first portion and second portion may be arranged relative to each other such that a/the longitudinal axis of the first portion may extend at an angle relative to a/the longitudinal axis of the second portion. The apparatus may be configured such that in the second configuration of the apparatus a/the longitudinal axis of the first portion extends at an angle, e.g. an acute angle, relative to a longitudinal axis of a line or portion thereof extending from a structure. This may reduce out of plane strain acting on the apparatus and/or a line e.g. in use, e.g. during pull-in and/or tensioning of a line, e.g. a line or a portion thereof, which may be received in or threaded through the apparatus or a portion thereof. This may lead to a reduction of losses, e.g. due to friction between a line under tension and the apparatus, e.g. during pull-in and/or tensioning of a line.

In the first or second configuration, the line engaging means may be configured to disengage or be disengageable, e.g. partially or fully disengage or be disengageable, from a line or portion thereof, e.g. to prohibit movement of a line or portion thereof in the first direction.

The apparatus may be configured or arranged, e.g. the guide portion may be connected or connectable to the first portion, such that the axis of the apparatus may extend in a direction substantially perpendicular to a/the longitudinal axis of the first portion. The apparatus may be configured or arranged, e.g. the guide portion may be connected or connectable to the first portion, such that a/the longitudinal axis of the first portion may intersect the axis of the apparatus.

The second portion may be configured to receive, mount and/or support a mounting element of a line, e.g. a mounting element connected to at least one end, e.g. a free end, of a line, e.g. a line or a portion thereof, which may be received in or threaded through the apparatus. For example, the second portion may mount a mounting element of a line, when tension on at least one end of a line is released. This may permit secure parking or holding of an end of a line, e.g. a free end of a line.

The second portion may be configured to align a mounting element connected to at least one end, e.g. a free end, of a line, e.g. a line or a portion thereof, which may be received in or threaded through the apparatus, relative to the apparatus. The second portion may be configured to align at least one end, e.g. a free end, of a line, e.g. a line or a portion thereof, which may be received in or threaded through the apparatus, relative to the apparatus. This may maintain a line or an end of a line, e.g. a free end of a line, in alignment relative to the apparatus. For example in cases where the line may be or comprise a chain, the configuration of the second portion may prevent misalignment or bending of parts of a chain. This may reduce strain, damage and/or wear of a line/chain. The configuration of the second portion may facilitate connection of a wire, e.g. work wire, to a line, e.g. a mounting element of a line, e.g. during a pull-in and/or tensioning process.

The apparatus may comprise a groove or recess and/or a protrusion. The groove or recess and/or protrusion may be part of or comprised in the second portion. The groove or recess and/or protrusion may be shaped for mounting and/or supporting a mounting element of a line, e.g. a mounting element connected to at least one end, e.g. a free end, of a line, e.g. a line or a portion thereof, which may be received in or threaded through the apparatus. The groove or recess and/or protrusion may be arranged and/or shaped to cooperate with a further protrusion of a mounting element, e.g. a mounting element connected to at least one end, e.g. a free end, of a line, e.g. a line or a portion thereof, which may be received in or threaded through the apparatus, e.g. to enable mounting of a mounting element on the apparatus, e.g. the second portion.

The apparatus may comprise a first connector portion. The first connector portion may be part of or comprised in the second portion. The first connector portion may be (provided) for complementary mating with a corresponding second connector portion. The first connector portion may be part of or comprised in a subsea or underwater connector, e.g. a subsea or underwater mooring connector. The first connector portion may be moveably, e.g. rotatably or pivotably, connected or connectable to the second portion.

The second portion may be configured to connect or couple the apparatus to another line or a portion thereof e.g. a line extending from a seabed or a further structure located thereon. The second portion may be configured to be moveably, e.g. rotatably or pivotably, connected or connectable to another line or a portion thereof, e.g. a line extending from a seabed or a further structure located thereon.

The apparatus for mooring a structure may be hingedly or pivotably connected to the first portion of the connector.

It should be understood that the features defined above in accordance with any aspect of the present invention or below in relation to any specific embodiment of the invention may be utilised, either alone or in combination with any other defined feature, in any other aspect or embodiment of the invention.

BRIEF DESCRIPTION OF DRAWINGS

These and other aspects of the present invention will now be described, by way of example only, with reference to the accompanying drawings, in which:

FIG. 1(*c*) a table of a wrap angle and tension factor;

FIG. 2(*b*) a part-sectional view of the apparatus in FIG. 2(*a*);

FIG. 3(*b*) an isometric view of the apparatus of FIG. 2(*a*) in a second configuration of the apparatus;

FIG. 4(*b*) a side view of the apparatus of FIG. 2(*a*) in the second configuration in which the first portion of the apparatus is shown as effectively transparent;

FIG. 4(*c*) a part cutaway view of the apparatus of FIG. 2(*a*) in the second configuration in which a part of the first portion of the apparatus is shown as effectively transparent;

FIGS. 5(*a*) and (*b*) isometric views of the apparatus for mooring a structure according to another described example(s);

DETAILED DESCRIPTION OF DRAWINGS

Figures 1A, 1B, 1C:
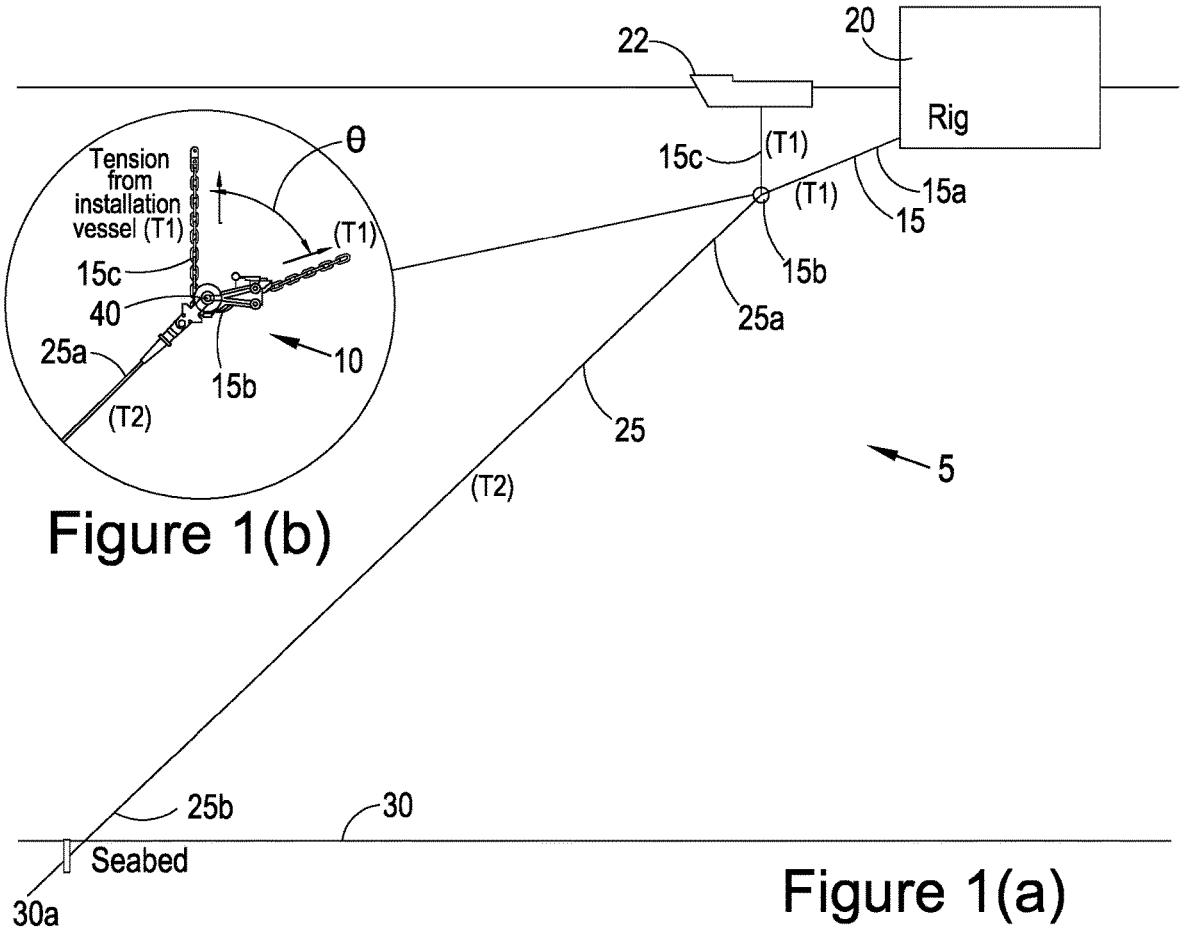
FIGS. 1(*a*) and (*b*) schematic views of a system for mooring a structure according to one or more described example(s)

An exemplary system 5 for mooring a structure is shown in FIGS. 1(*a*) and 1(*b*). The system 5 includes an apparatus for mooring a structure. The apparatus may be configured to permit tensioning of a line, such as a mooring line, offshore mooring line, underwater mooring line or subsea mooring line or the like, connected to the structure. The apparatus may be provided in the form of a mooring tensioner 10 and the line may be provided in the form of a chain 15. It will be appreciated that in other examples the line may be provided in the form of a rope, synthetic, e.g. polyester, wire or the like. A first end, e.g. a distal end, 15*a* of the chain 15 is connected to the structure, which in this example is provided in the form of a floating platform or rig 20. It will be appreciated that in other examples, the structure may be a floating structure, offshore structure, vessel, plat form, subsea structure, underwater structure or buoy, such a submersible buoy, semisubmersible buoy or submerged turret production buoy or submerged turret loading buoy, or the like.

In the example of FIGS. 1(*a*) and 1(*b*), a portion 15*b* of the chain 15 is threaded through the mooring tensioner 10 and guided towards a vessel 22. A second end, e.g. a free end, 15*c* of the chain 15 is shown as being coupled to the vessel 22 and/or a pulling or tensioning arrangement, such as a winch and/or motor or the like, for adjustment of a tension and/or length of the chain 15.

As can be seen in the exemplary mooring tensioner 10 shown in FIG. 1(*b*), a first end 25*a* of a further mooring line 25 can be connected to the mooring tensioner, while the second end 25*b* of the further mooring line 25 is connected to a seabed 30, e.g. to a further structure 30*a* located on the seabed 30. The further structure 30*a* may be provided in the form of a drag embedment anchor, vertically loaded anchor, driven pile, suction pile, suction anchor, suction embedded plate anchor or other types of anchors or structures. It will be appreciated that in other examples the mooring tensioner may be directed connected/connectable to the seabed 30 and/or the further structure 30*a* located thereon.

An exemplary mooring tensioner 10 is shown in FIGS. 1(*b*), 2(*a*) to 6(*b*). The mooring tensioner 10 includes a first portion 35 for receiving the portion 15*b* of the chain 15 that extends from the rig 20 to the mooring tensioner 10. The exemplary mooring tensioner 10 includes a guide portion for guiding the portion 15*b* of the chain 15 received by the first portion 35. The guide portion may be provided in the form of a chain wheel or sheave 40. In this example the chain wheel or sheave 40 is a five pocket chain wheel. It will be appreciated that in other examples other wheels, such as wheels without any pockets or a more or less than five pockets, may be utilised as a guide portion. The chain wheel 40 is movably connected, such as rotatably or pivotably connected, to the first portion 35. The mooring tensioner 10 includes a second portion 45 for connecting or coupling the mooring tensioner 10 to the seabed 30 and/or the further structure 30*a* located thereon. It will be appreciated that the second portion 45 may be configured to connect the mooring tensioner 10 directly or indirectly to the seabed 30 and/or the further structure 30*a* located thereon, as will be described below. The second portion 45 is movably connected, such as pivotably or rotatably connected, to the first portion 35 and/or the chain wheel 40.

The mooring tensioner 10 includes an axis A, which may be provided in the form of a rotational axis A. The axis A may be provided by an elongate member, which may be in the form of a first load pin or pin 47. The first portion 35, the second portion 45 and/or the chain wheel 40 are arranged to be movable, such as rotatable or pivotable, around or about the axis A, e.g. the pin 47, of the mooring tensioner 10. In other words, the first portion 35, the chain wheel 40 and/or the second portion 45 are coaxially arranged relative to each other. The coaxial arrangement of the first portion 35, chain wheel 40 and/or second portion 45 may permit the first portion 35, chain wheel 40 and/or second portion 45 to be aligned relative to each other during pull-in/tensioning of the chain 15, e.g. by the pulling and/or tensioning arrangement. This may reduce out of plane strain acting on the mooring tensioner 10 and the chain 15, e.g. during pulling-in/tensioning of the chain 15.

Referring back to FIGS. 1(*a*) to 1(*c*), tension T2 acting on the further mooring line can be greater than tension T1 on the chain 15, which may be applied by or due to the vessel 22 and/or the rig 20. The extent to which the load/tensioning from the vessel 22 can be increased can depend of a wrap angle θ of the chain 15 around the chain wheel 40. As can be seen from the table in FIG. 1(*c*), the factor of the tensions T2/T1 applied to the mooring tensioner 10 decreases with increasing wrap angle θ of the chain around the chain wheel 40. This may lead to a reduction in the tension that needs to be applied from the vessel in order to generate the required pre-tension in the mooring line and/or may allow smaller, more readily available and/or cheaper vessels to be used.

The exemplary mooring tensioner 10 shown in FIGS. 1(*b*) to 6(*b*) includes a line engaging device, which may be provided in the form of a chain stopper 50. The chain stopper 50 may be or include one or more features of the chain engaging means disclosed in WO 2015/150770 (by the present applicant), which is hereby incorporated by reference. The chain stopper 50 can be configured to permit movement of the chain 15 a portion thereof in a first direction relative to the mooring tensioner 10, e.g. in a direction towards the chain wheel 45. The chain stopper 50 can be configured to prohibit movement of the chain 15 or a portion thereof in a second direction relative to the mooring tensioner 10, e.g. in a direction towards the rig 20. The chain stopper 50 may be or act as a one-way ratchet or the like.

Figure 4A:
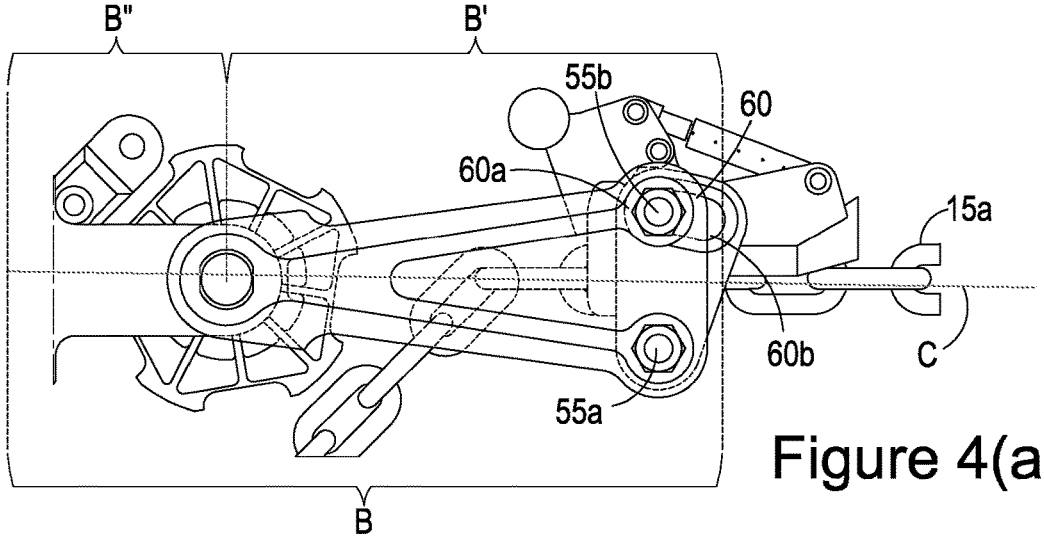
FIG. 4(*a*) a side view of the apparatus of FIG. 2(*a*) in the first configuration in which a first portion of the apparatus is shown as effectively transparent.
Figure 4B:
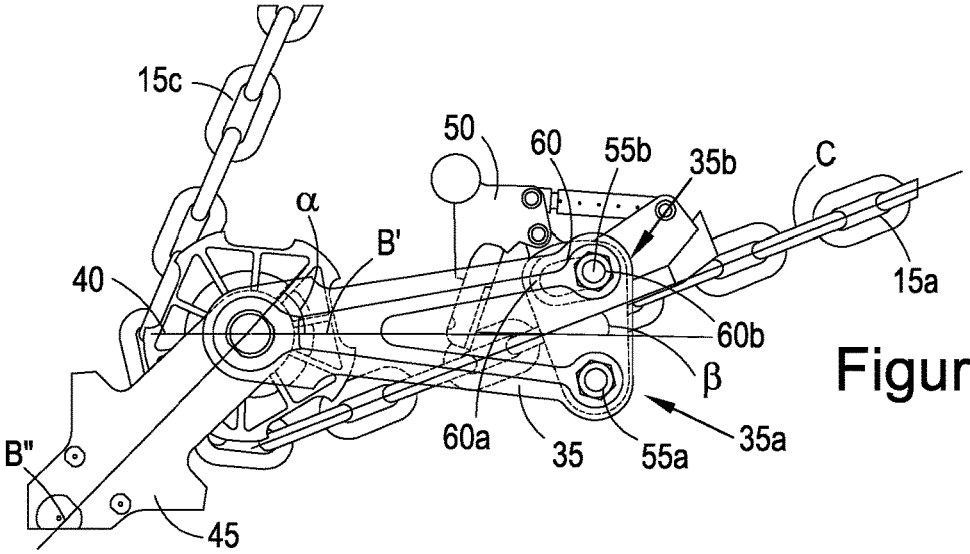
Figure 4C:
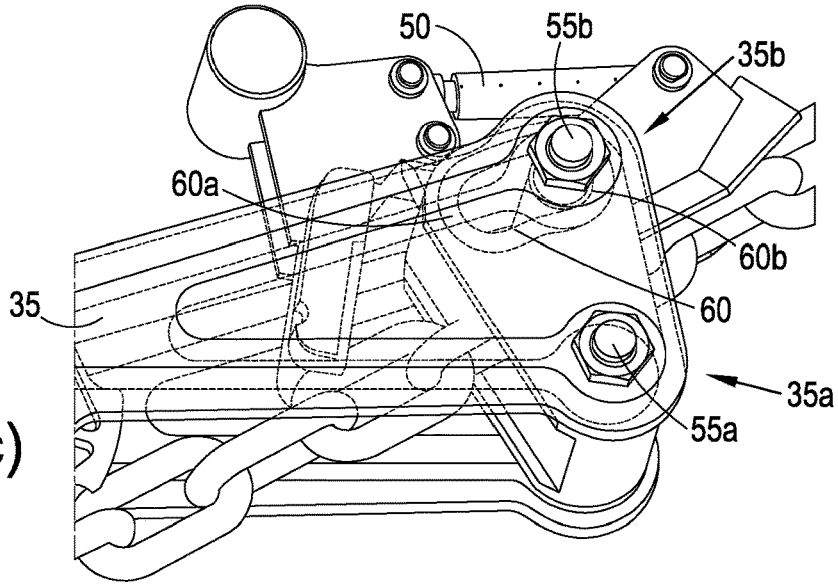

The chain stopper 50 is movably connected to the first portion 35. For example, the chain stopper 50 is connected to the first portion 35 so that chain stopper 50 is rotatable or privotable and/or slidable relative to the first portion 35. As can be seen in FIGS. 4(*a*) to 4(*c*), the chain stopper 50 is rotatably or pivotably connected to the first portion 35 at a first attachment region 35*a*, e.g. by a second elongate member, which may be provided in the form of a second pin or load pin 55*a*. The chain stopper 50 is slidably connected to the first portion 35 at a second attachment region 35*b*, e.g. by a third elongate member, which may be provided in form of a third pin or load pin 55*b* The chain stopper 50 includes a slot 60 provided in the chain stopper 50 through which the third pin extends. It will be appreciated that in other examples the slot may be provided in the first portion of the mooring tensioner additionally to or instead of the slot in the chain stopper.

Figure 3A:
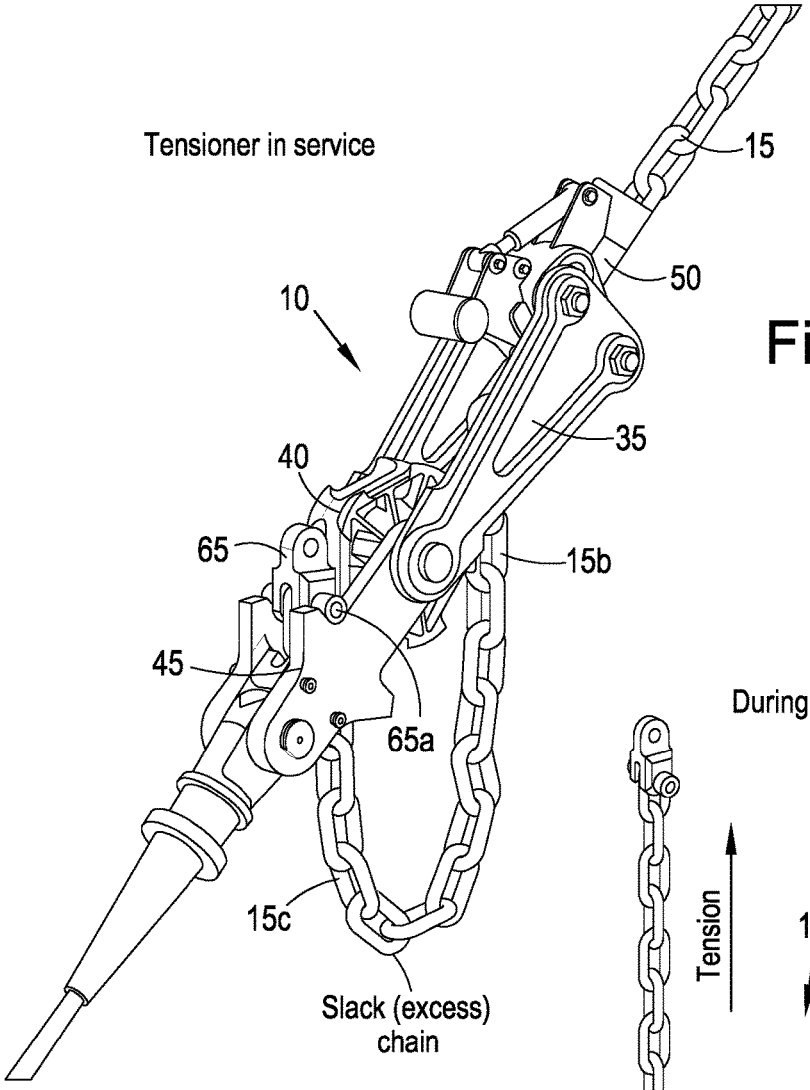
FIG. 3(*a*) an isometric view of the apparatus of FIG. 2(*a*) in a first configuration of the apparatus.
Figure 3B:
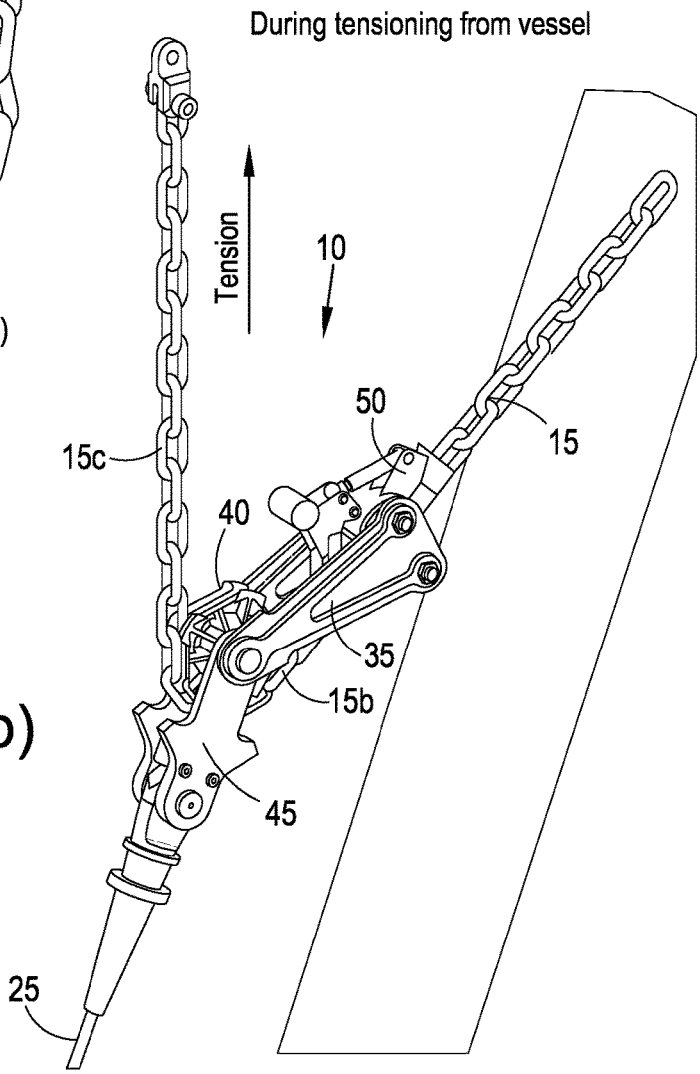

The chain stopper 50 is connected to the first portion 35 to be movable between a first position, shown in FIGS. 3(*a*) and 4(*a*), and a second position, shown in FIGS. 3(*b*) and 4(*b*). In the first position of the chain stopper 50, the third pin 55*b* is located at a first end 60*a* of the slot 60. In the second position of the chain stopper 50, the third pin 55*b* is located at a second end 60*b* of the slot 60. When tension is applied to the second end 15*c* of the chain 15, e.g. by the pulling and/or tensioning arrangement on the vessel 22, the chain stopper 50 is configured to move from the first position to the second position. In other words, due to the applied tension to the second end 15*c* of the chain 15, the third pin 55*b* moves from the first end 60*a* of the slot 60 towards the second end 60*b* of the slot 60. Tension may additionally act on the first end 15*a* of the chain 15 due to its connection to the rig 20.

When the tension is released at the second end 15*c* of the chain 15, the chain stopper 50 is configured to move or return to the first position. In other words, due to the release of tension at the second end 15*c* of the chain 15, the third pin 55*b* moves or returns from the second end 60*b* of the slot 60 towards the first end 60*a* of the slot 60.

The mooring tensioner 10 can be configured to be operable, movable and/or actuatable between a first configuration and a second configuration. In the first configuration of the mooring tensioner 10, the chain stopper 50 is in the first position, as shown in FIGS. 3(*a*) and 4(*a*). In the second configuration of the mooring tensioner 10, the chain stopper 50 is in the second position, as shown in FIGS. 3(*b*) and 4(*b*).

As can be seen in the examples shown in FIGS. 3(*a*) and 4(*a*), in the first configuration of the mooring tensioner 10, the first portion 35 and the second portion 45 are arranged relative to each other such that a longitudinal axis B' of the first portion 35 is substantially in line, collinear or coaxial with a longitudinal axis B" of the second portion 45. The mooring tensioner 10 can be configured such that in the first configuration of the mooring tensioner, a/the longitudinal axis B of the mooring tensioner 10 is substantially in line, collinear or coaxial with a longitudinal axis C of the second end 15*c* of the chain 15.

Additionally or alternatively, the mooring tensioner 10 can be configured such that in the first configuration of the mooring tensioner 10, the axis A of the mooring tensioner 10 is be substantially co-planar with the longitudinal axis C of the second end 15*a* of the chain 15 and/or the axis a of the mooring tensioner 10 extends in a direction substantially perpendicular to the longitudinal axis C of the first end 15*a* of the chain 15. In the first configuration of the mooring tensioner 10, out of plane strain acting on the mooring tensioner 10 and/or the chain 15 may be reduced.

In the first configuration, the chain stopper 50 or a portion thereof can be configured to engage or be engageable with the chain 15 or portion thereof, e.g. to prevent movement of the chain 15 in the second direction.

Referring to FIGS. 3(*b*) and 4(*b*), in the second configuration of the mooring tensioner 10, the first portion 35 and second portion 45 are arranged relative to each other such that the longitudinal axis of the first portion B' extends at an angle α, which may be an acute angle, relative to the longitudinal axis B" of the second portion 45. The mooring tensioner 10 may be configured such that in the second configuration, the longitudinal axis B' of the first portion 35 extends at an angle β, e.g. an acute angle, relative to the longitudinal axis C of the second end 15*c* of the chain 15, as shown in FIG. 4(*b*). This may reduce out of plane strain acting on the mooring tensioner and/or the chain e.g. in use, e.g. during pull-in and/or tensioning of the chain 15. This may lead to a reduction of losses, e.g. due to friction between the chain under tension and the mooring tensioner, e.g. during pull-in and/or tensioning of the chain.

In the second configuration, the chain stopper 50 means can be configured to partially disengage or be disengageable from the chain 15 or portion thereof, e.g. to prohibit movement of chain 15 or portion thereof in the first direction.

As can be seen in the examples shown in FIGS. 1(*b*) to 4(*b*) the chain wheel 40 is be connected or connectable to the first portion 35 such that the axis A of the mooring tensioner 10 extends in a direction substantially perpendicular to the longitudinal axis B' of the first portion 35 and the longitudinal axis B' of the first portion 35 intersect the axis A, e.g. the first pin 47, of the mooring tensioner 10.

Figure 2A:
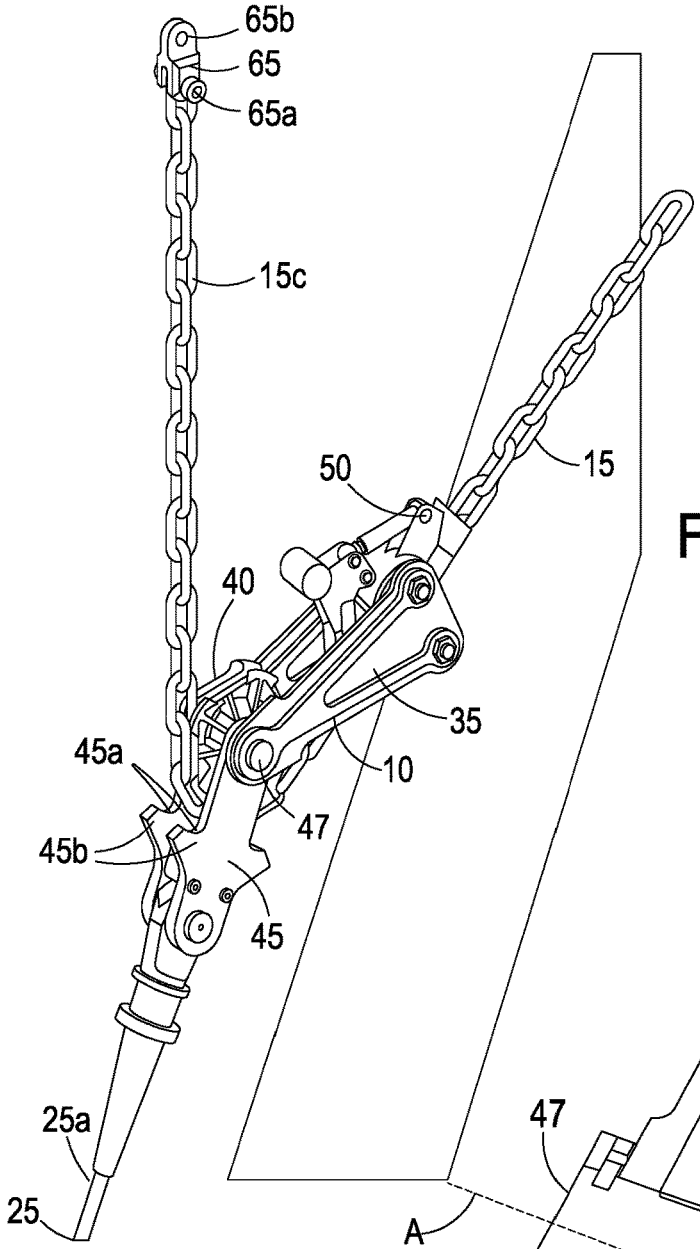
FIG. 2(*a*) an isometric view of an apparatus for mooring a structure according to one or more described example(s)
Figure 2B:
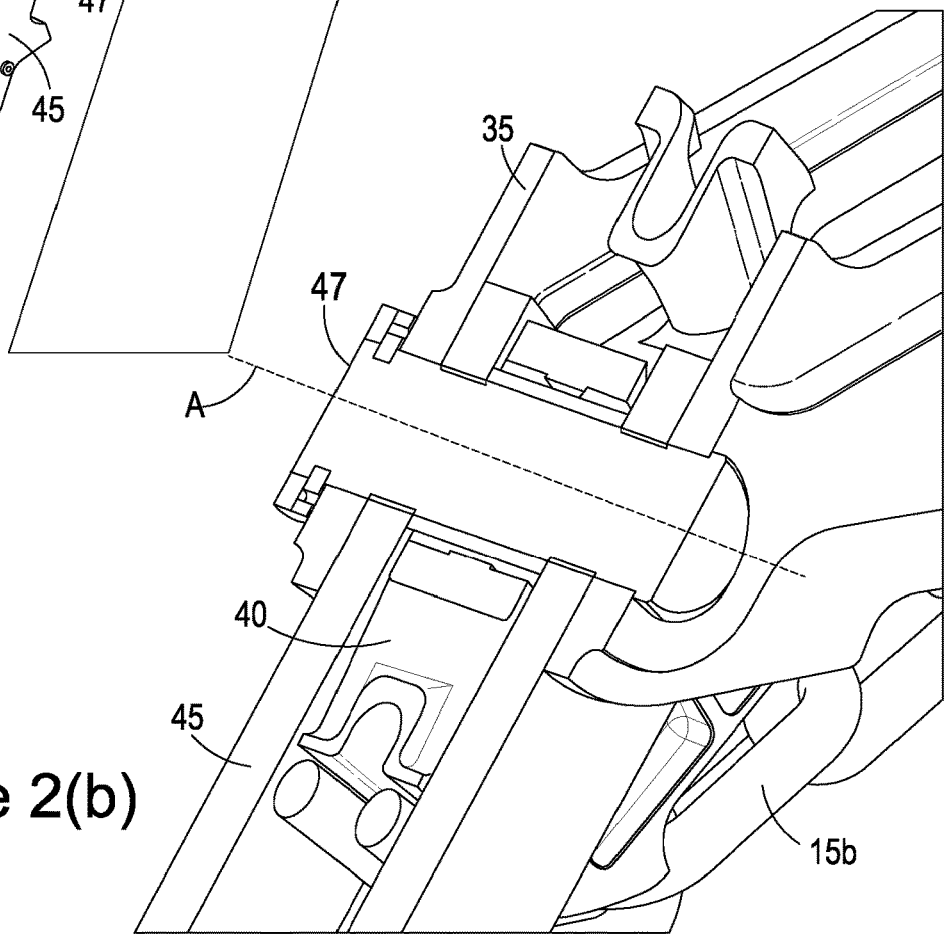

Referring to FIGS. 2(*a*), 3(*a*) and 3(*b*), the second portion 45 can be configured to receive, mount and/or support a mounting element 65, which is connected to the second end 15*c* of the chain 15. For example, the second portion 45 can mount a mounting element of the chain 15, when tension on the second end 15*c* of the chain 15 is released. The second end 15*c* of the chain 15 may become slack, i.e. non-tensioned, as shown in FIG. 3(*a*). The mounting element 65 may permit secure parking or holding of an end of the chain 15 and/or prevent the end of the chain 15 from disengaging from or passing through the mooring tensioner 10. In other words, the mounting element 65 may act as a stopper to prevent the second end of the chain 15*c* from passing through the mooring tensioner 10. The mounting element 65 may facilitate access to an end of the chain 15 for subsequent tensioning of the chain 15. Additionally or alternatively, the mounting element 65 may negate the use of buoyancy element, which may be difficult to install.

The second portion 45 can configured to align the mounting element 65 and/or the second end 15*c* of the chain 15 relative to the mooring tensioner 10, e.g. the second portion 45. This may maintain the chain 15 and/or the second end 15*c* of the chain 15 in alignment relative to the apparatus. The configuration of the mooring tensioner 10, e.g. second portion 45 may prevent misalignment or bending of parts, e.g. one or more link(s), of the chain 15. This may reduce strain acting of, damage and/or wear of the chain 15.

Referring to FIGS. 2(*a*), 3(*a*) and 3(*b*), the mooring tensioner 10, e.g. the second portion 45 includes a groove or recess 45*a* and/or a protrusion 45*b*. In this example the second portion 45 includes a pair of oppositely arranged grooves or recesses 45*a* and/or a pair of oppositely arranged protrusions 45*b*. It will be appreciated that in other examples there may be provided less than two or more than two grooves or recesses and/or protrusions. The grooves or recesses 45*a* and/or protrusions 45*b* are shaped for mounting and/or supporting the mounting element 65. The grooves or recesses 45*a* and/or protrusions 45*b* are arranged and/or shaped to cooperate with a further protrusion 65*a* of a mounting element 65, e.g. to enable mounting of the mounting element 65 on the mooring tensioner 10, e.g. the second portion 45.

The mounting element 65 is configured to permit connecting of the mounting element 65 and/or the second end 15*c* of the chain 15 to a yet further line (not shown), which may be in the form of a wire, e.g. a work wire, rope or the like. For example, in use the yet further line is connected to the pulling and/or tensioning arrangement on the vessel. Tension is applied to the yet further line, e.g. using the pulling and/or tensioning arrangement generates tension, e.g. tension T1 in the work wire and T2 in the mooring line, as for example shown in FIG. 1(*a*). For examples, the mounting element 65 may include a connection element 65*b*, which may be provided in the form of a pad eye or the like.

Figure 6A:
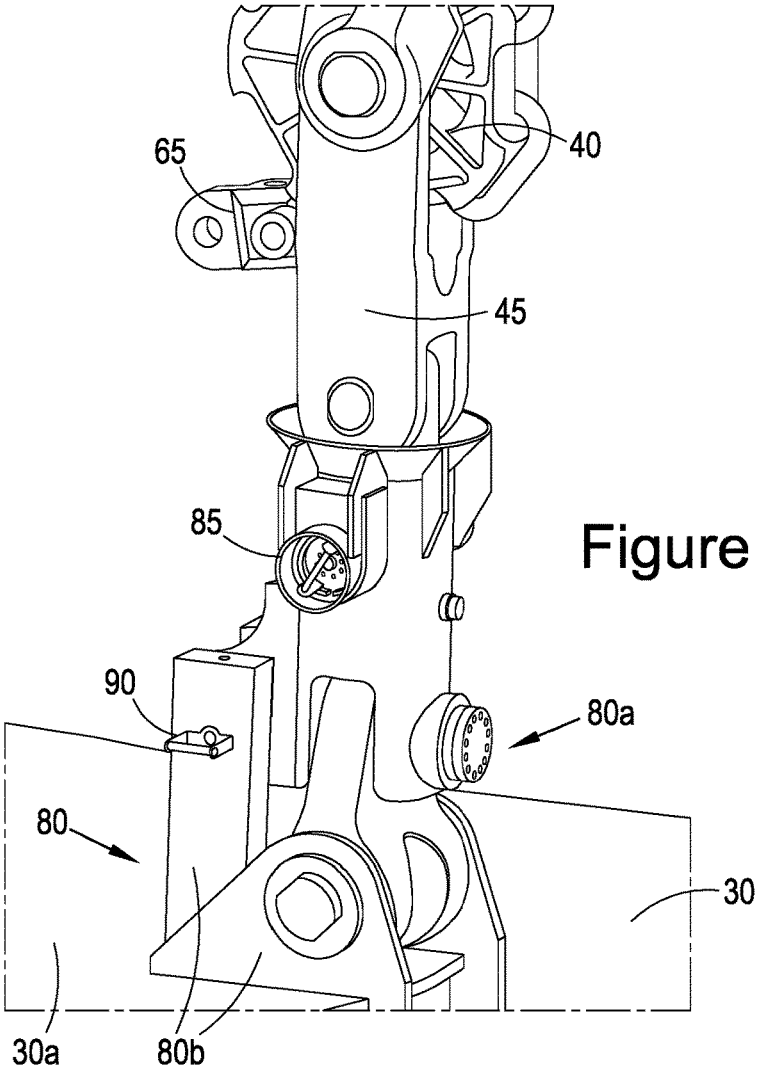
FIGS. 6(*a*) and (*b*) isometric views of the apparatus of FIG. 5(*a*) connected to a further structure on seabed.
Figure 6B:
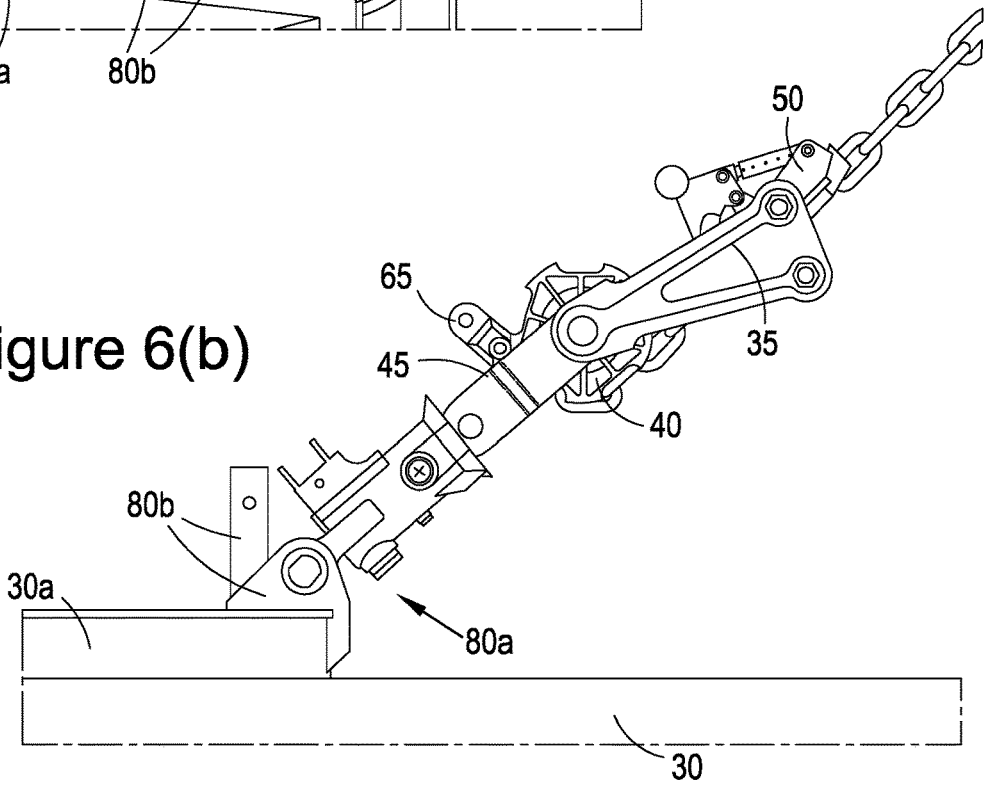
Figure 7A:
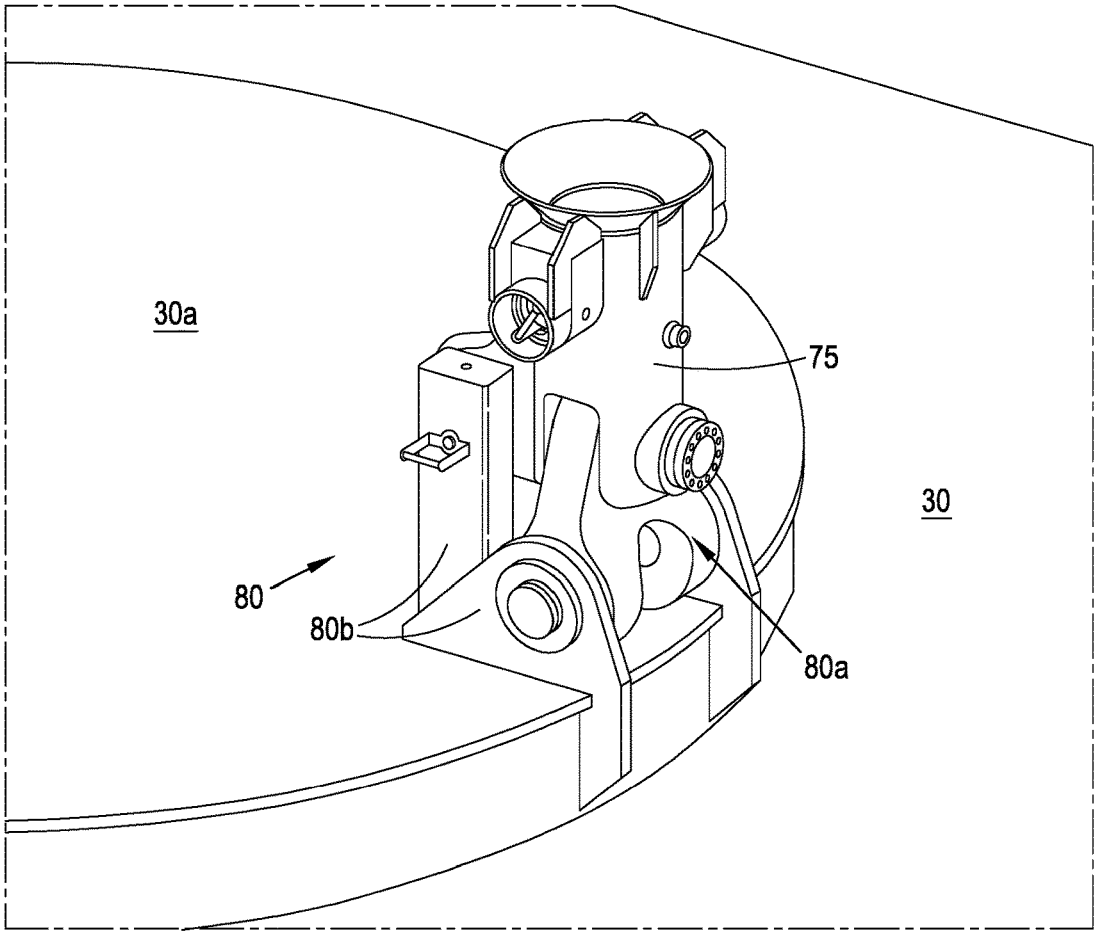
FIGS. 7(*a*) and (*b*) isometric views of the further structure on seabed of FIG. 6(*b*)
Figure 7B:
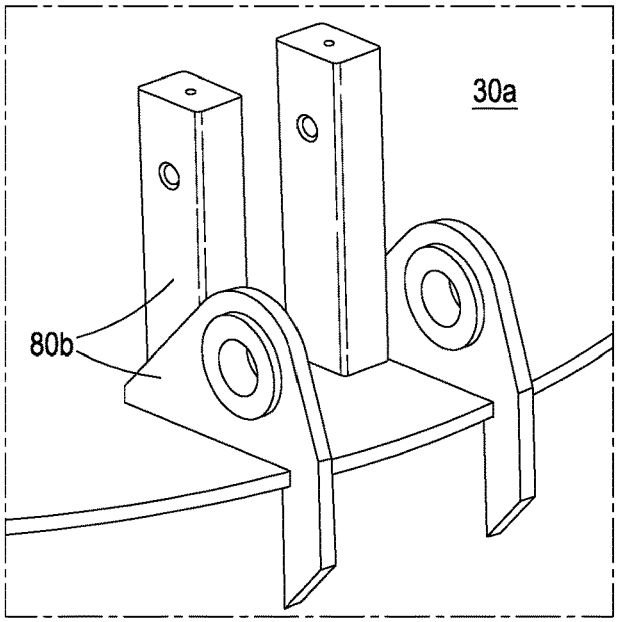

Referring to FIGS. 5(*a*) to 7(*b*), the mooring tensioner 10 can include a first connector portion 70. In this example the first connector portion 70 is part of the second portion 45 and it moveably connected thereto. The first connector portion 70 can be provided for complementary mating with a corresponding second connector portion 75. The first and second connector portions 70, 75 are part of a subsea or underwater connector, e.g. a subsea or underwater mooring connector. An example of such a connector is disclosed in WO 2013/186553 (by the present applicant), which is hereby incorporated by reference. The second connector portion 75 is configured to be connected or connectable to the further structure 30*a* located on the seabed 30. The second connector portion 75 may be configured to moveably connected to the further structure 30*a*, e.g. by a first connection arrangement 80. The first connection arrangement 80 may be provided in the form of a joint or uni-joint arrangement and/or be configured to permit rotational movement of the second connector portion 75, e.g. in at least one direction, relative to the further structure 30*a*. A first part 80*a* of the first connection arrangement may be part of the second connector portion 75 and another part 80*b* of the first connection arrangement may be part of the further structure 30*a*. The connection arrangement 80 may be configured to be operated or switchable between a first configuration, in which the first part 80*a* of the connection arrangement 80 is maintained in stationary position, e.g. as shown in FIG. 6(*a*), and a second configuration, in which the first part 80*a* of the connection arrangement 80 and/or the mooring tensioner 10 or a portion thereof is permitted to move relative to the second part 80*b* of the connection arrangement 80 and/or the further structure 30*a*, e.g. as shown in FIG. 6(*b*). The first part 80*a* of the connection arrangement 80 may be maintained in a stationary position by one or more locking element(s) 90. For example, in use, removal of the one or more locking elements permits movement of the first part 80*a* of the connection arrangement 80 and/or the mooring tensioner 10 or a portion thereof relative to the second part 80*b* of the connection arrangement 80 and/or the further structure 30*a*.

In the examples shown in FIGS. 5(*a*) to 6(*b*), the first connector portion 70 is provided in the form of a male part 70*a* and the second connector portion 75 is provided in the form of a female part 75*a*. The female part 75*a* is configured for receiving the male part 70*a*. The male part 70*a* is lowered towards the female part 75*a* to enable connection of the male part 70*a* to the female part 75*a*. During the lowering of the male part 70*a* into the female part 75*a*, the male part 70*a* may be aligned, such as rotationally aligned, relative to the female part 75*a*. Once the male and female parts 70*a*, 75*a* are aligned relative to each other, the male part 70*a* can be fully inserted into the female part 75*a* and secured to the female part 75*a* by a yet further elongate member, which may be provided in the form of a fourth load pin or pin 85.

Referring back to the exemplary system 5 shown in FIGS. 2(*a*), 3(*a*) and 3(*b*), the second portion 45 can be configured to connect the mooring tensioner 10 to the further mooring line 25, which in turn is connected to the seabed 30 and/or the further structure 30*a* located thereon. The second portion 45 can be configured to be moveably connected to the further mooring line 25 or a portion thereof. For example, the system 5 can include a second connection arrangement 95 for moveably connecting the mooring tensioner 10, e.g. the second portion 45, to the further mooring line 25.

Figure 8:
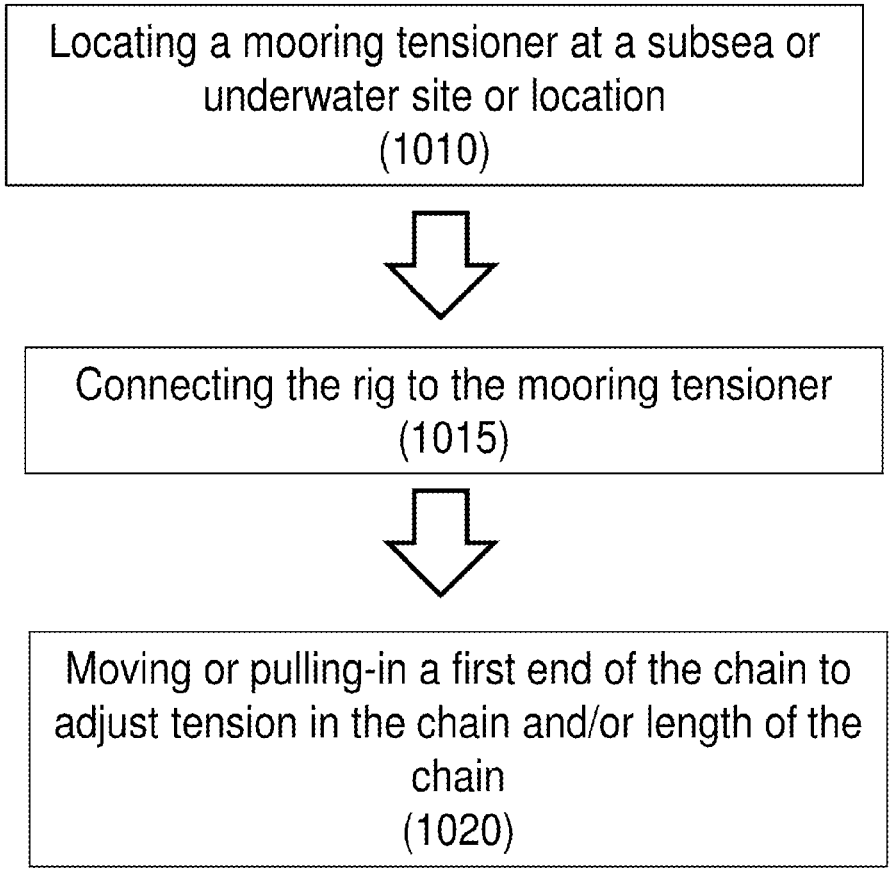
FIG. 8 a flow diagram of a method for mooring a structure according to one or more described example(s)
Figure 9:
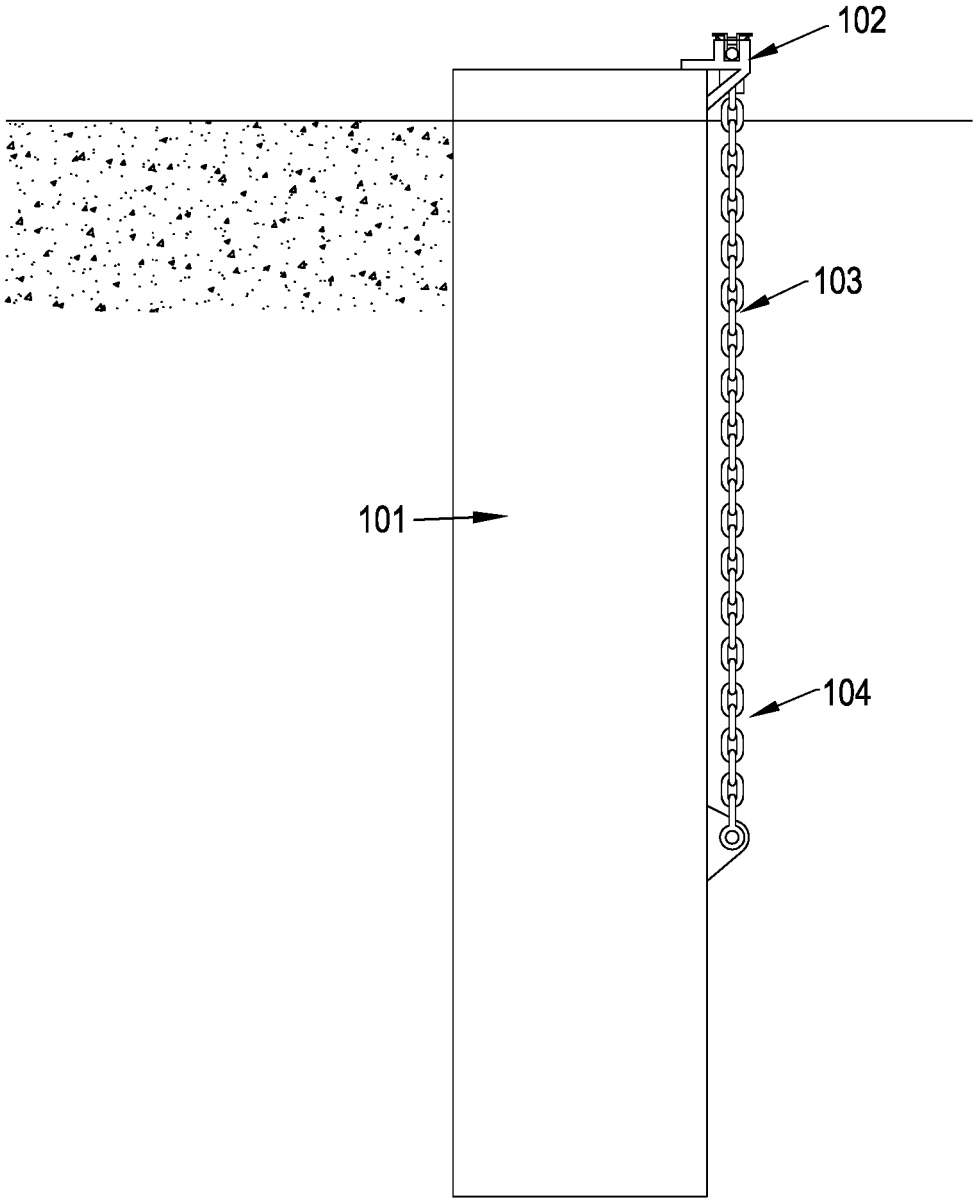
FIG. 9 an anchor for use in a method of installing a mooring line according to an embodiment of the present invention.

FIG. 8 shows a flow diagram of an exemplary method for mooring a structure. As described above, the structure may be provided as a rig 20. The method can include the step of providing the mooring tensioner 10 and/or the system 5. In step (1010), the mooring tensioner 10 is located at a site or location e.g. a subsea or underwater site or location. Subsequently to locating the mooring tensioner 10, the mooring tensioner 10 is connected to the rig 20, e.g. threading the chain 15 through the mooring tensioner 10 and connecting the first end 15*a* of the chain 15 to the rig 20.

The method can include the step of connecting or coupling the mooring tensioner 10 to the seabed 30 or a further structure 30*a* located thereon. This may be done by utilising the further mooring line 25 to connect, e.g. indirectly connect, the mooring tensioner 10 to the seabed 30 or a further structure 30*a* located thereon. In some examples the mooring tensioner 10 may be connected, e.g. directly connected, the seabed 30 or a further structure 30*a* located thereon, by utilising the connector or mooring connector, e.g. first and second connector portions 70, 75.

In step 1020 the method includes moving or pulling-in the second end 15*c* of the chain 15 to adjust tension in the chain 15 and/or length the chain 15 or a portion of the chain 15 extending between the mooring tensioner 10 and the rig 20, e.g. using a pulling or tensioning arrangement, e.g. a winch and/or motor or the like, or an Remotely Operated Vehicle (ROV). As described above, the yet further line may be connected to the second end 15*c* of the chain 15, e.g. the mounting element 65, and/or tension can be applied to the yet further line, e.g. by the pulling and/or tensioning arrangement on the vessel 22. The step of moving or pulling second end 15*c* of the chain 15 can include moving, actuating and/or operating the mooring tensioner 10 from first configuration into the second configuration.

There will now be described a method of installing a mooring line or mooring line assembly according to the present invention. There will also be described a method of mooring, such as offshore mooring, e.g. of a buoyant structure.

An installation sequence for a mooring line assembly or subsea tensioner according to the present invention is as follows. An anchor 101 is installed with one half (female) of a subsea mooring connector 102. In FIG. 1 this is shown as suction pile anchor, but the installation method is suitable for other anchor types. A length of chain 103 connects the half of the mooring connector 102) which should be kept above the seabed to a padeye 104 located in a beneficial location on the pile in order to maximise load holding capacity.

Figure 10A:
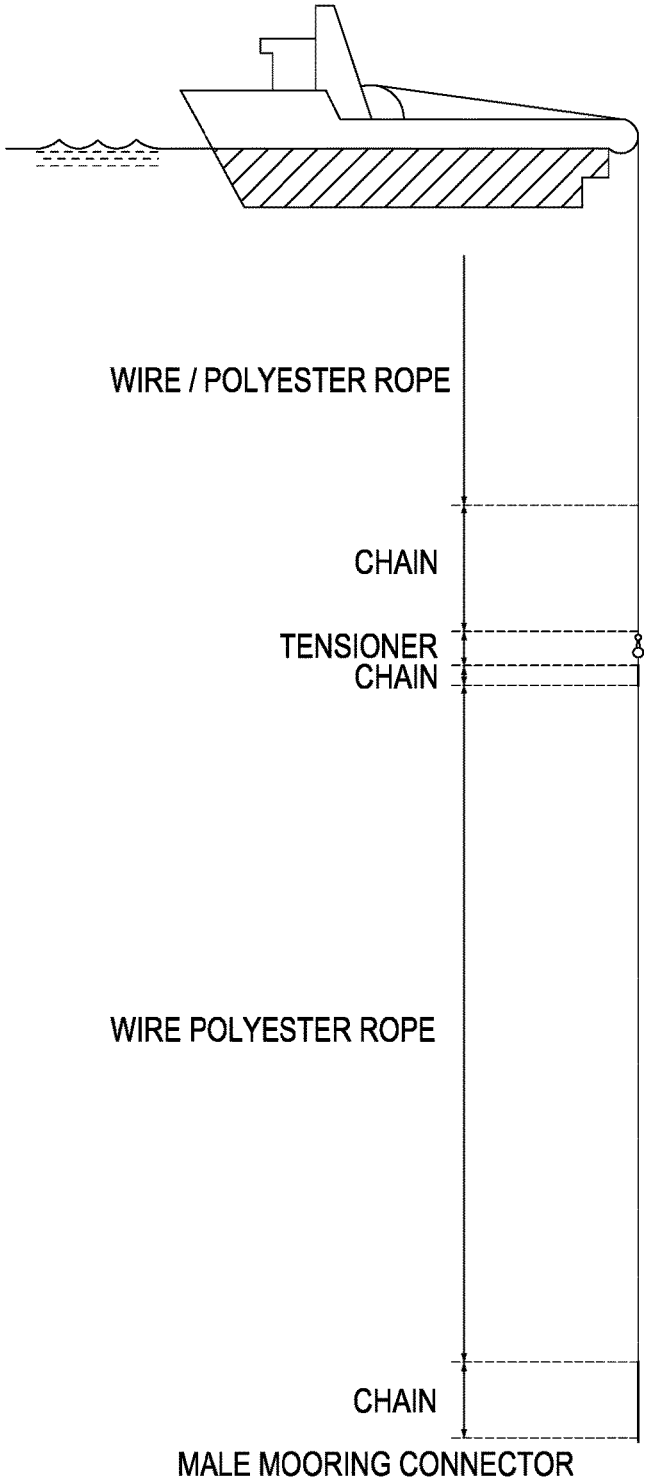
FIGS. 10(*a*) and 10(*b*) a mooring line assembly used in the method of installing a mooring line of FIG. 9.
Figure 10B:
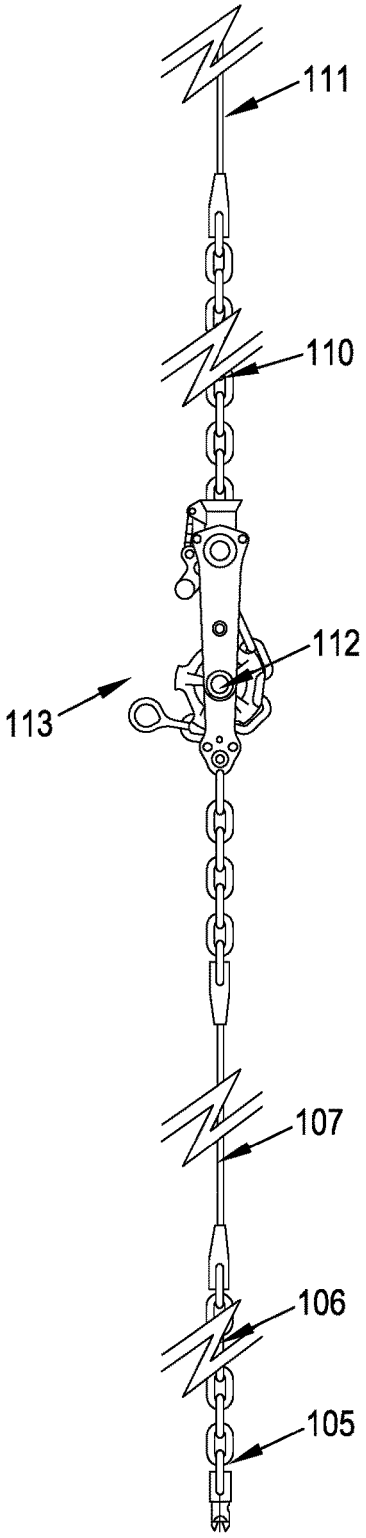
Figures 11A, 11B, 11C:
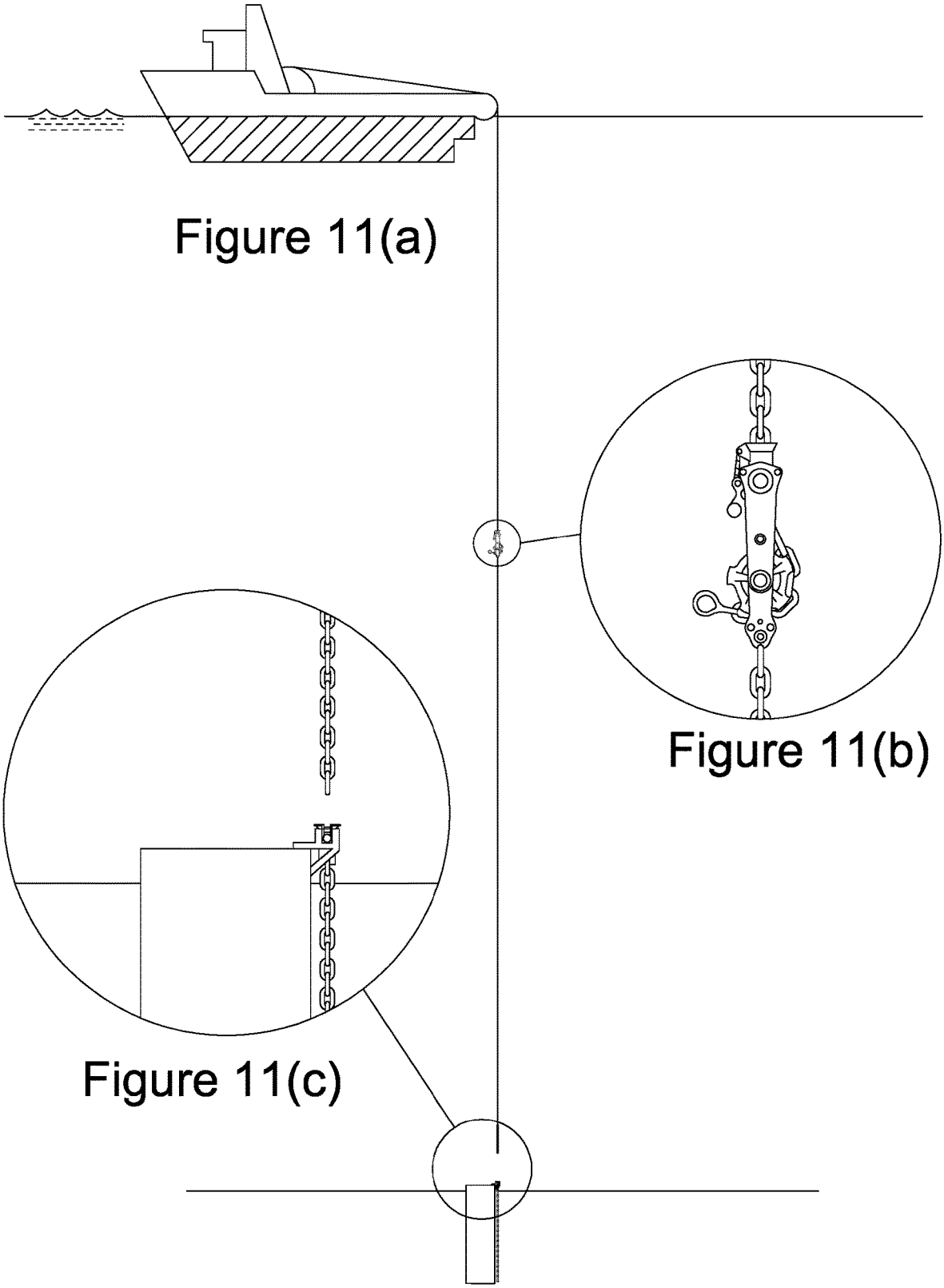
FIGS. 11(*a*) to (*c*) a series of views showing the mooring line assembly of FIGS. 10(*a*) and 10(*b*) being deployed to the anchor of FIG. 9.

A mooring line is deployed from an Anchor Handling Vessel (AHV) or other suitable construction vessel as shown in FIG. 10. At a bottom of the mooring line is a male half of the subsea mooring connector 105. The female half 102 is located on the pre-installed anchor 101. Above the male mooring connector 105 is a length of chain 106 sufficient to keep the more easily damaged wire or polyester rope section of the mooring line 107 clear of the seabed during the mooring systems service life. Above the wire/polyester rope there is a short length of chain 108 leading to a tensioner apparatus 109. Pre-installed into the tensioner 109 is sufficient length of chain 110 to adjust the tension of the mooring system accordingly. Above this length of chain 110 there is further wire or polyester rope 111. The length of chain 110 passes through the chain stopper of the tensioner (the chain flapper is secured in the down position), partially around the wheel of the tensioner where such is held in place with a pin 112. The length of chain 110 terminates with a rope sling 113 or other suitable lifting gear to allow later connection of the AHV work wire to chain 110 for the purpose of tensioning the mooring line.

It should be noted that the above description covers one possible mooring line configuration. However, it will be appreciated that the tensioner can be positioned in any location in the mooring line above the male subsea mooring connector 105. For instance, chains 106 and 108 may be one short length of chain, rope 107, may be removed and rope 111 longer, such that the tensioner 109 would now be located closer to the anchor 101. This may be of benefit in positioning the tensioner (109) at sufficient depth to prevent marine growth that could foul the mechanism of the flapper. The use of a subsea mooring connector 102,105 provides flexibility and technical and/or commercial advantage.

With the mooring line deployed from the installation vessel as described above, the line is positioned to allow the male mooring connector 105 at the end of the mooring line to be lowered into the female mooring connector 102 mounted on the suction pile. The procedure for installing the male mooring connector into the female and connecting the two halves, is described in detail in GB 2 517 873 B (by the present Applicant)

Figure 12:
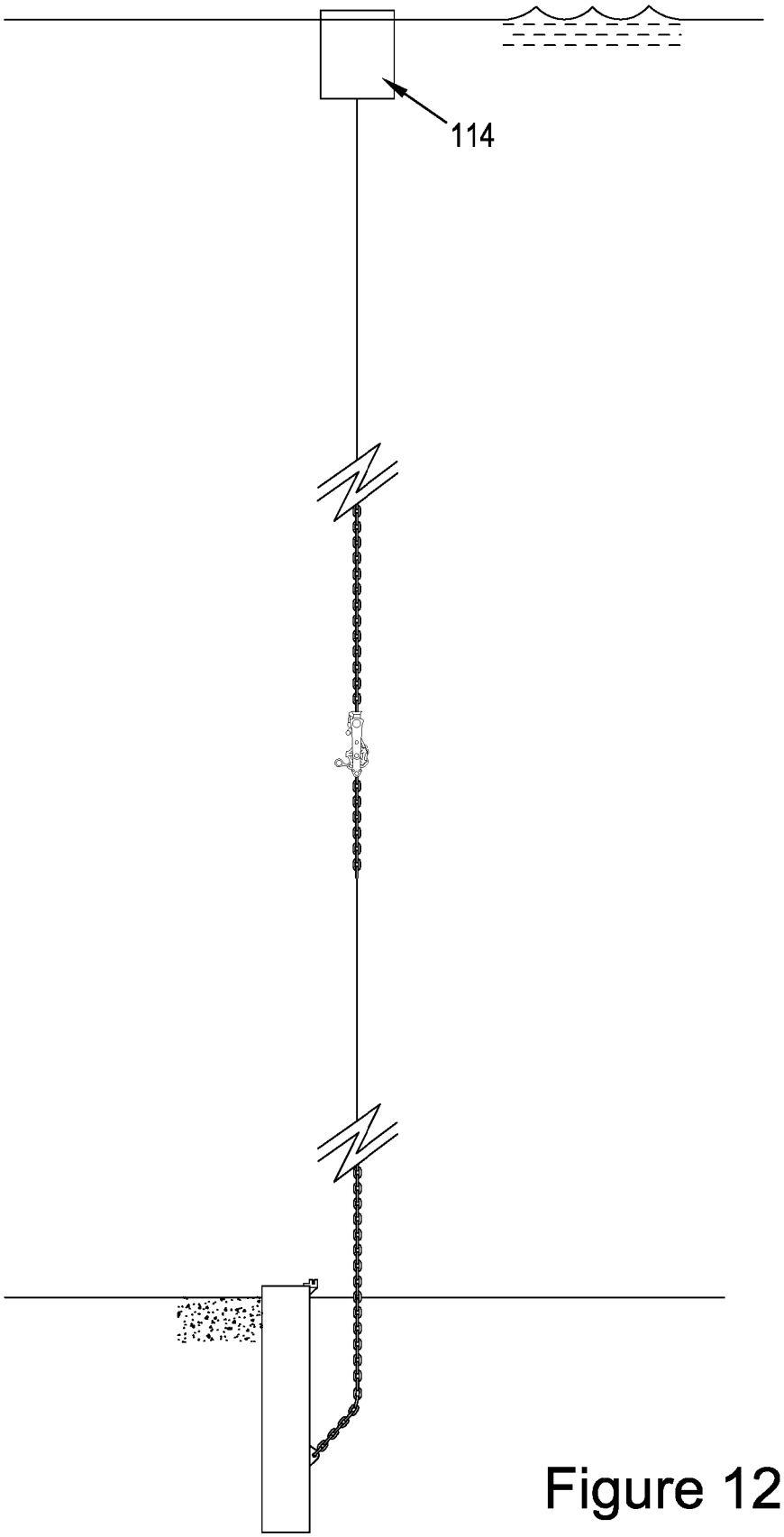
FIG. 12 a view of the mooring line assembly of FIGS. 10(*a*) and 10(*b*) connected to the anchor of FIG. 9.
Figure 13:
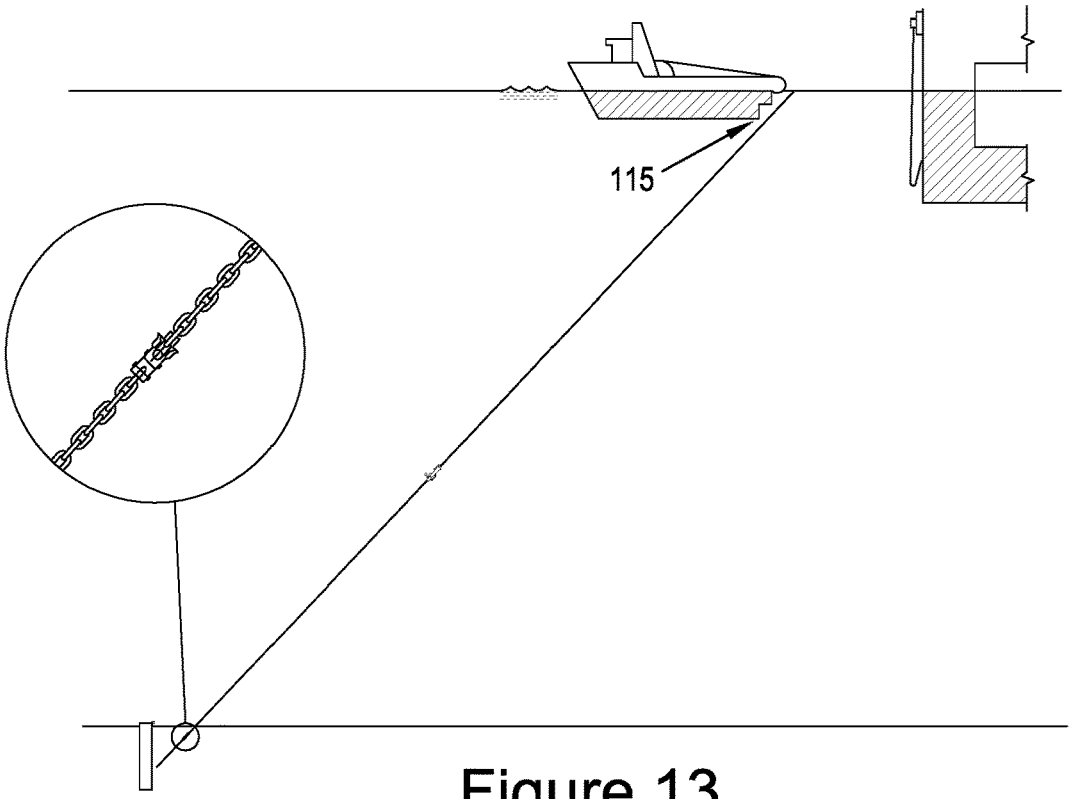
FIGS. 13 to 16 steps in a method of mooring according to an embodiment of the present invention.
Figure 14:
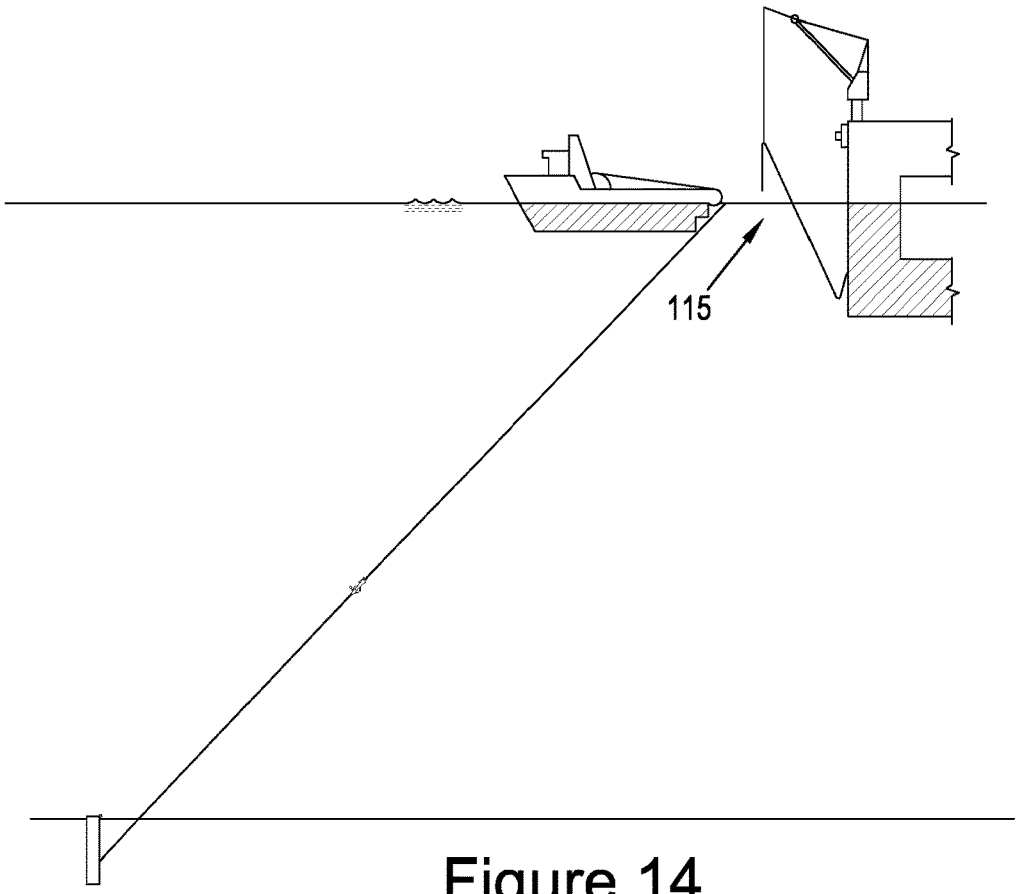

With the Subsea Mooring Connector (SMC) fully connected, the SMC can be lifted from the deployment frame incorporated into the suction pile fabrication and laid onto the seabed. At this point it may be suitable to connect a buoyancy module (114) to the top end of the mooring line and to lower the buoyancy module into the water with the mooring line suspended below it. This would allow the mooring system to be pre-set prior to the arrival on location of a buoyant structure, e.g. a floating platform, to be moored. This would reduce the amount of time between arrival on location of the floating platform and the platform being tethered in a safe condition. This pre-set mooring line assembly with buoyancy module is as shown in FIG. 12.

When the floating platform is present on location and ready to be moored, the installation vessel can recover the buoy back onto the deck, disconnect the buoy from the mooring line assembly, and approach the floating platform. Using a crane on the floating platform, a pre-installed short top section of the mooring line assembly 115 can be handed over to the installation vessel.

Figure 15:
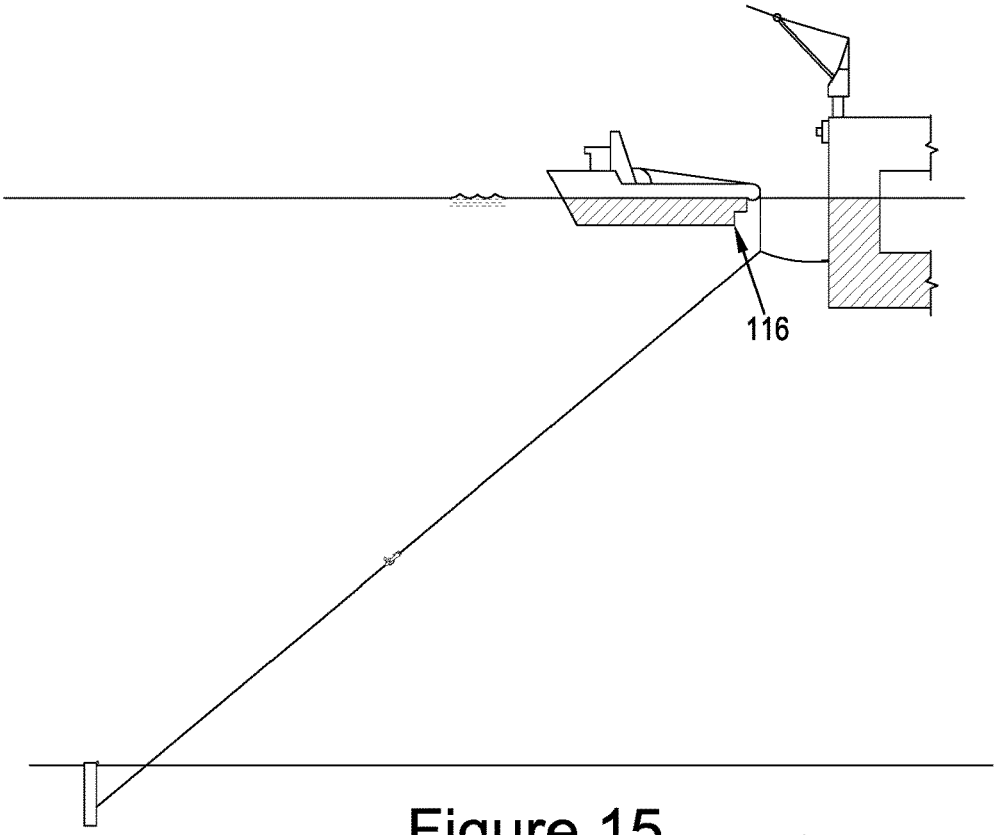
Figure 16:
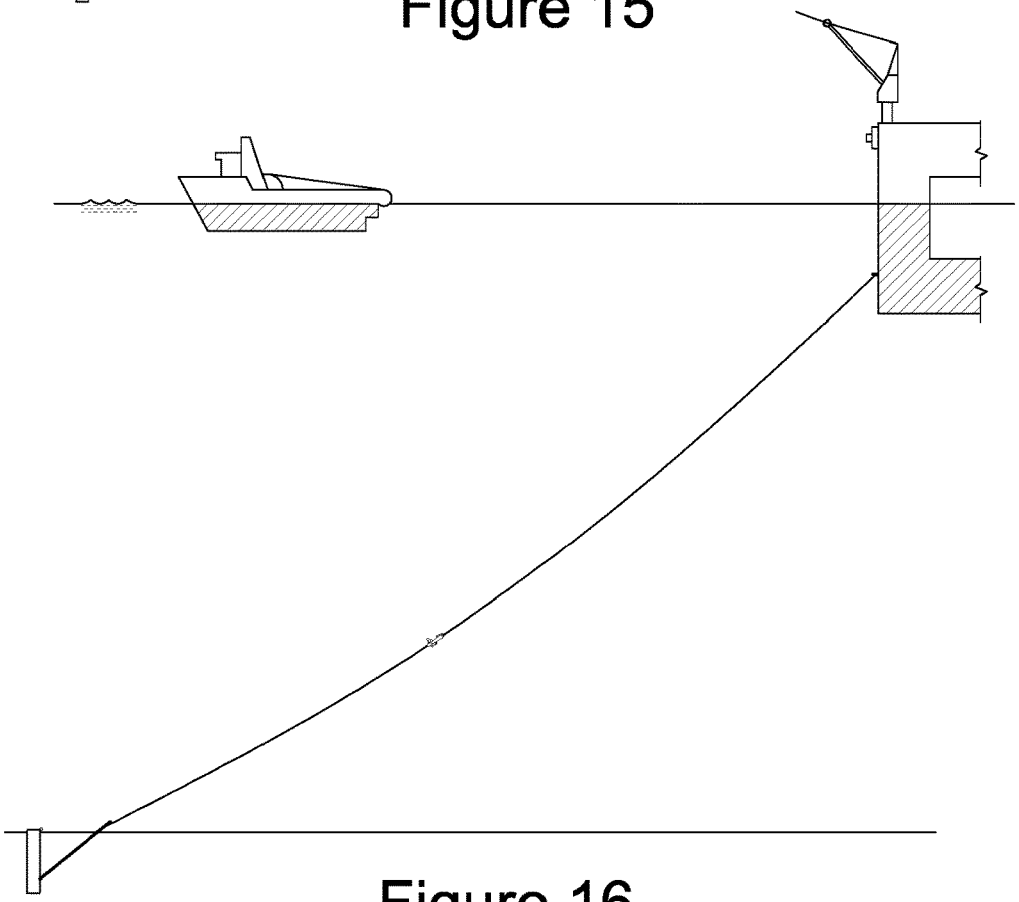

When both the mooring line bottom section running to the anchor and the mooring line top section from the floating platform are on the deck of the installation vessel, both ends can be connected using an H-Link or similar joining method. The mooring line can then be lowered subsea using a work wire 116 from the installation vessel—see FIG. 15.
With the mooring line assembly hanging relatively slack, the work wire from the installation can be disconnected from the mooring line assembly using a Remotely Operated Vehicle (ROV). When the work wire is disconnected it is recovered to the vessel, the mooring line assembly is now fully connected and appears as in FIG. 16.

Figure 17:
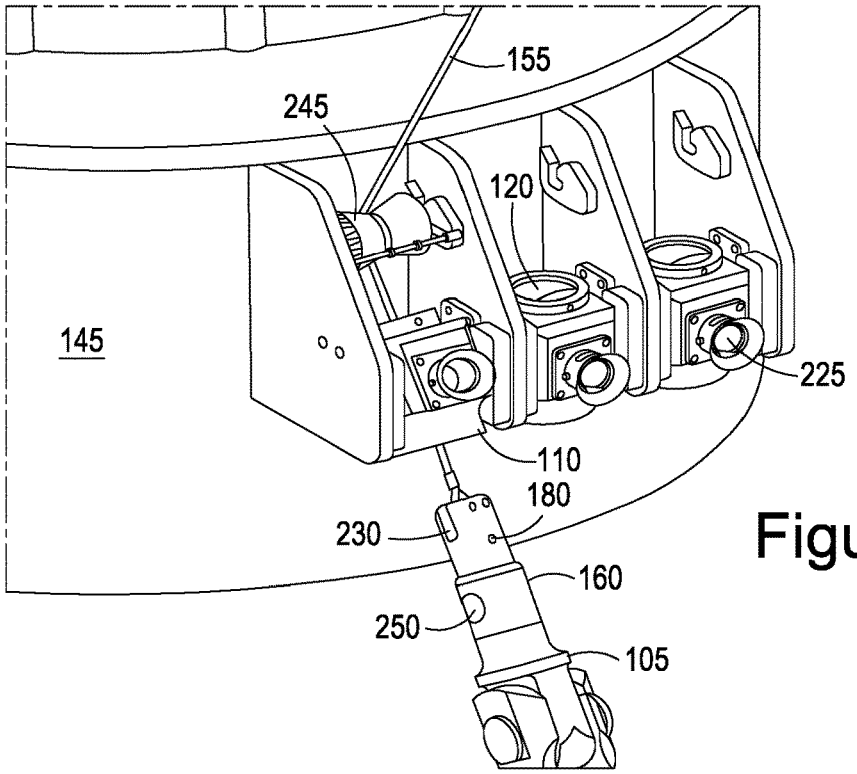
FIG. 17 a modification to the method of FIGS. 13 to 16.
Figure 18:
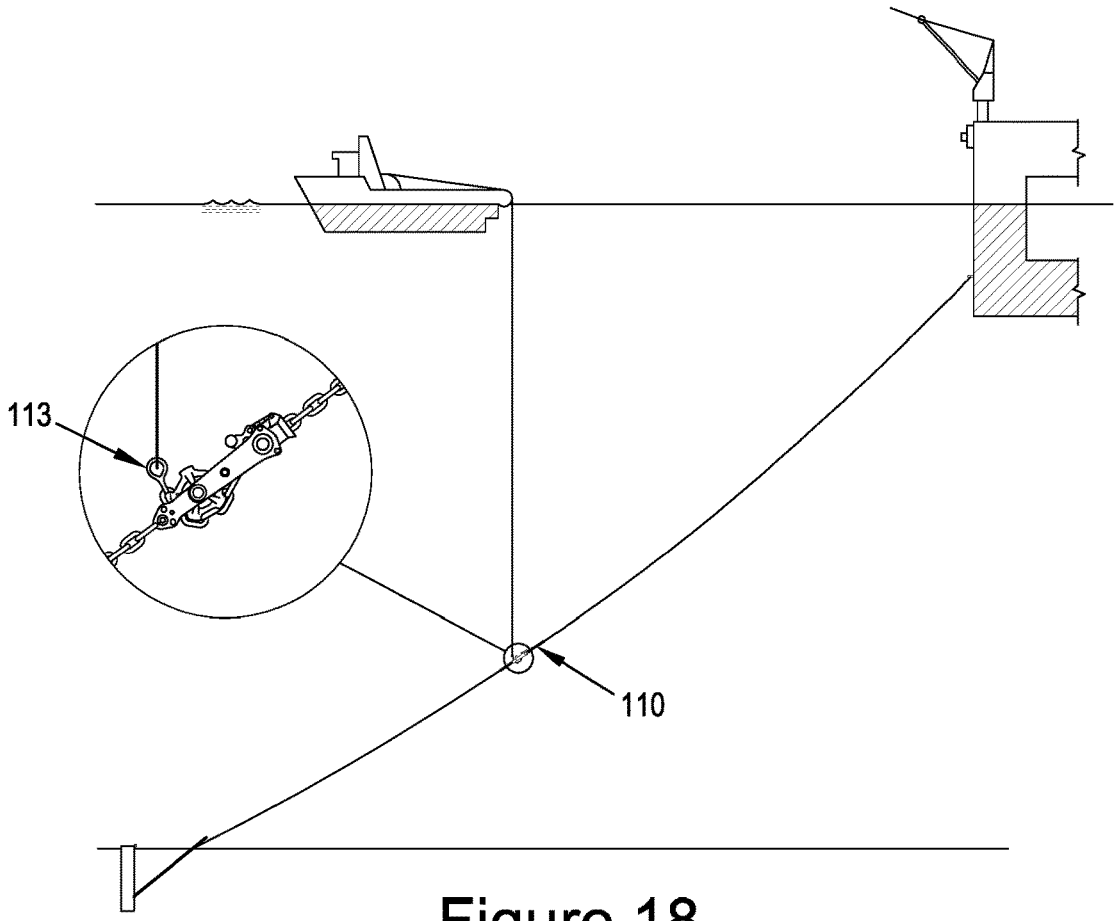
FIGS. 18 and 19 further steps in the method of mooring of FIGS. 13 to 16.
Figure 19:
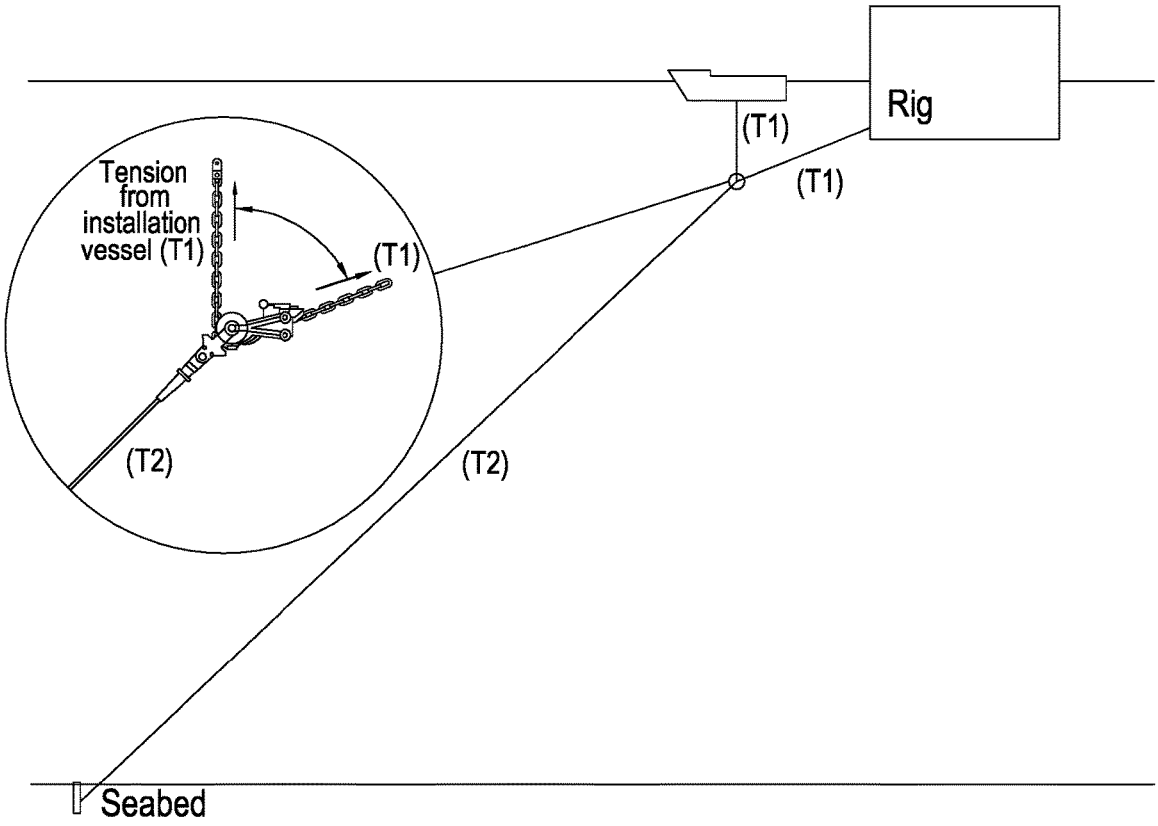

A possible variation on this installation method would be to remove the pre-installed section of mooring line attached to the floating platform that is used to hand over to the installation vessel. GB 2 512 312 A (also by the present Applicant), shows a device for the connection under tension of a mooring line to a floating structure—the connection being made directly at the interface between hull and mooring line. (See FIG. 17).

The details of this connection method are disclosed in further detail in GB 2 512 312 A. This connection method could easily be incorporated into the overall mooring installation procedure outlined herein. The mooring line would be deployed by the installation vessel with the male connector from GB 2 512 312A. The pull-in rope 115 (see FIG. 17) would be connected to the floating platform crane which would perform the pull-in.

With the mooring line fully connected, the installation vessel can now lower a work wire to be connected to the rope sling 113 that is attached to the end of the chain that passes through the tensioner and chain stopper 110.

With the work wire attached to the chain that passes through the tensioner and chain stopper, the vessel can pull upwards on the wire to increase tension in the mooring line. The chain stopper engages should the work wire be slackened locking in the tension generating in the mooring line by previously pulling upwards.

During tensioning the tension generated in the section of mooring line below the tensioner will be greater than the tension applied from the surface vessel. The extent to which the load from the vessel is magnified will depend upon the wrap angle of the chain around the 5 pocket wheel (see FIG. 1(*c*).

Once the required tension has been reached the work wire is lowered until the chain stopper automatically engages with the chain 110 and the work wire goes slack. The mooring chain that has been pulled through the tensioner will be slack in service. It can be locked in position using the pin 112 provided. Excess slack chain could be removed using an ROV operated saw. With the slack chain secured by the pin, an ROV can disconnect the work wire from the rope sling 113. This completes the installation and tensioning of the mooring line.

Figure 20A:
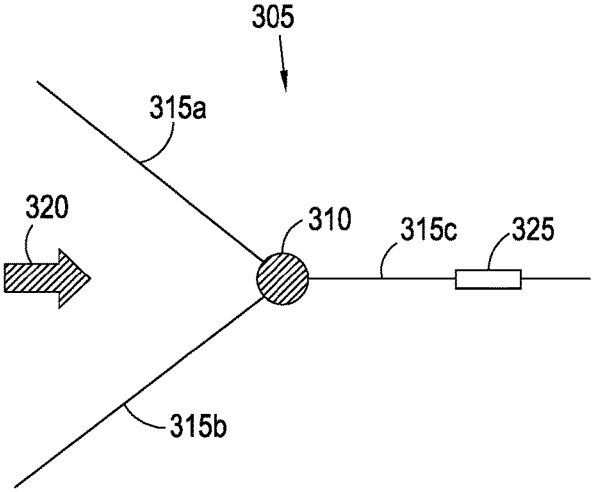
FIG. 20*a* an exemplary representation of a mooring configuration for a structure.

Referring to FIG. 20*a*, there is shown an exemplary representation of a mooring configuration for a structure, the mooring configuration generally denoted 5. The mooring configuration is representative of a wind application, i.e. mooring of a wind turbine 310. The wind turbine 310 is moored by three mooring lines 315*a*, 315*b*, 315*c*. A predominant direction of the wind is denoted by arrow 320. As can be seen from FIG. 20*a*, in such a mooring configuration, a tensioner 325 may only be used in one of the mooring lines.

Figure 20B:
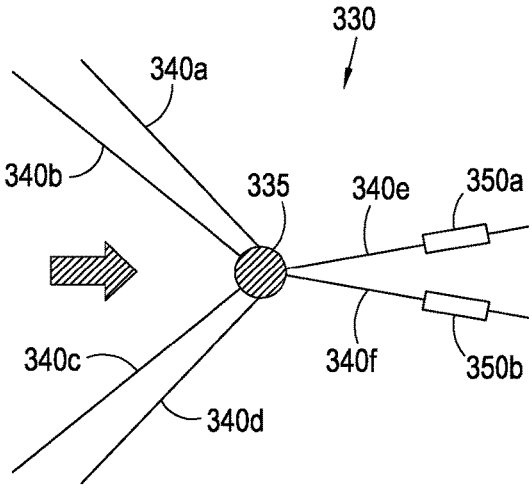
FIG. 20*b* a further exemplary representation of a mooring configuration for a structure.

Similarly, FIG. 20*b* shows a further exemplary representation of a mooring configuration for a structure, the mooring configuration generally denoted 330. The mooring configuration is representative of a wind application, i.e. mooring of a wind turbine 335. The wind turbine 335 is moored by six mooring lines 340*a*, 340*b*, 340*c*, 340*d*, 340*e*, 340*f*. A predominant direction of the wind is denoted by arrow 345. As can be seen from FIG. 20*b*, in such a mooring configuration, tensioners 350*a*, 350*b* may only be used in two of the mooring lines.

Figure 21:
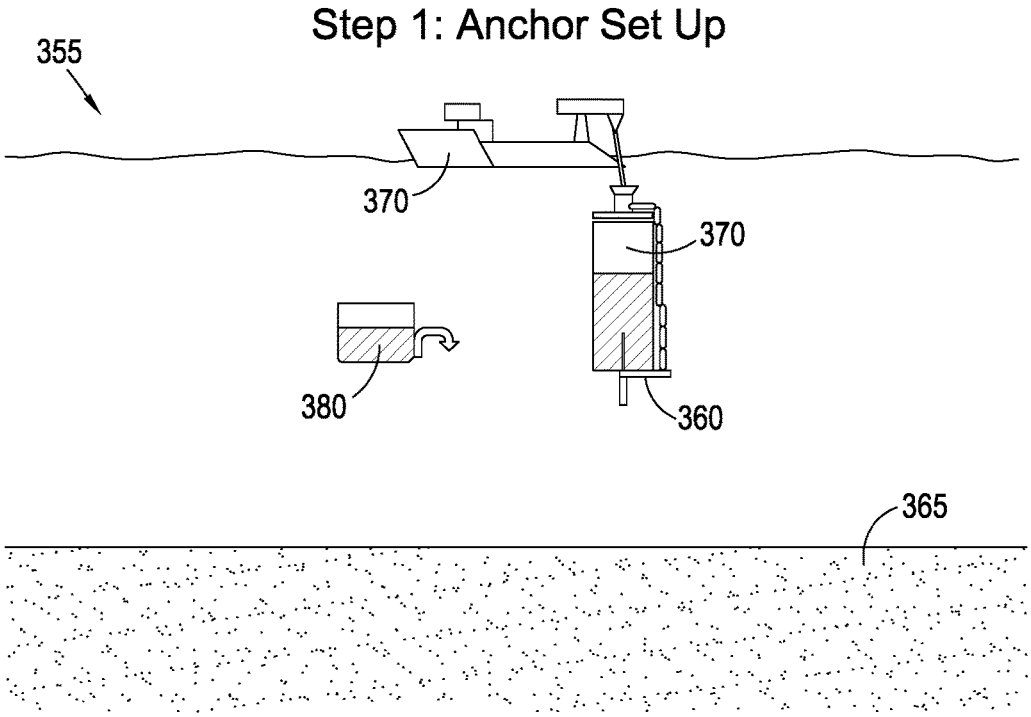
FIG. 21 a representation of a step in a mooring method, according to an embodiment of the present invention.

Referring to FIG. 21, there is shown a representation of a first step in a mooring method, generally denoted 355, according to a first embodiment of the present invention. The step 355 comprises installing a subsea anchor 360. In the embodiment shown, the anchor 360 is a Suction Embedded Plate Anchor (SEPLA). One would appreciate that in other embodiments encompassing the inventive concept of the present invention, the anchor 360 may be, or may comprise, a pile, such as a suction pile or the like. In the embodiment shown, the anchor 360 is installed on a seabed 365 by a pile vessel 370. The anchor 360 is adapted for use on the seabed 365. The step 355 of installing the subsea anchor 360 comprises a step of driving the anchor into the seabed 365 by means of a pile 375. Further, the step 355 of installing the subsea anchor 360 comprises a step of removing the pile 375, as can be seen with reference to FIG. 22. An ROV (Remotely Operated Vehicle) 380 may be used to adapt or configure the pile 375 and/or anchor 360 as required during the installation step 355.

Figure 22:
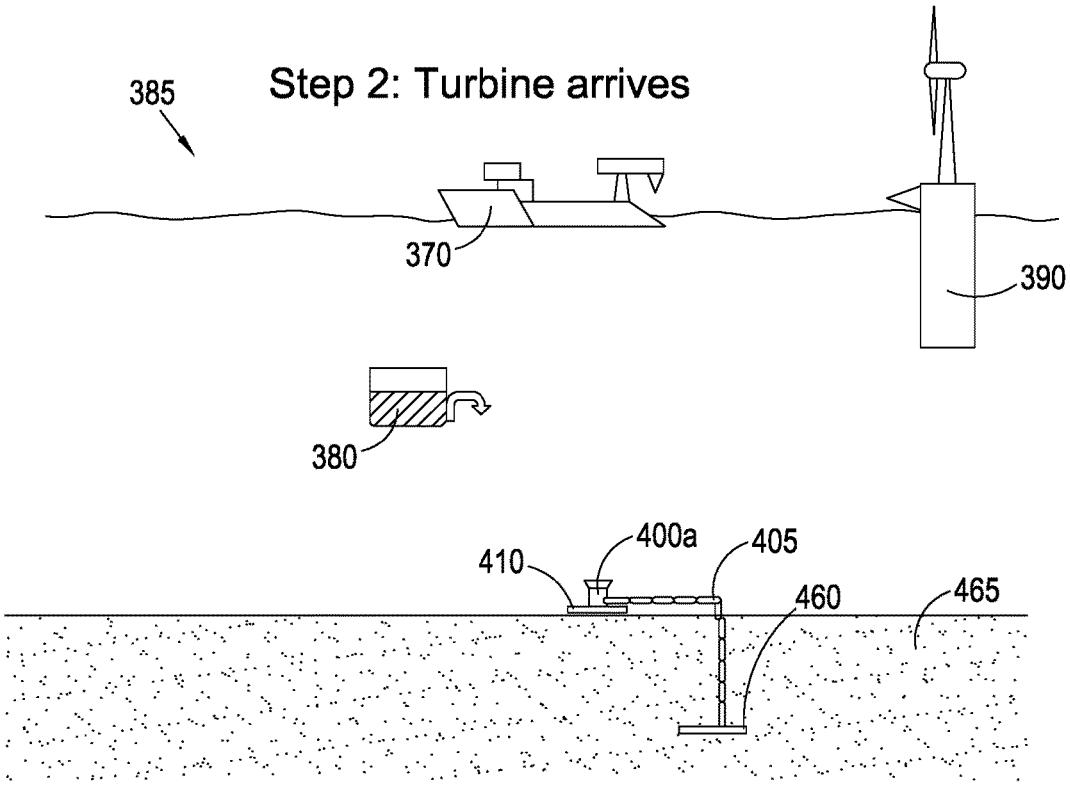
FIG. 22 a representation of a further step in a mooring method, according to an embodiment of the present invention.

Referring to FIG. 22, there is shown a representation of a second step in a mooring method, generally denoted 385, according to a first embodiment of the present invention. The step 385 comprises providing a buoyant structure 390. The buoyant structure 390 is a structure to be moored. The structure 390 is a wind turbine. One would appreciate that in other embodiments encompassing the inventive concept of the present invention, the buoyant structure 390 may be a ship, a rig, a floating platform, a portion of a wind turbine, a buoy, such as a submersible buoy, a semisubmersible buoy, a submerged turret production buoy, a submerged turret loading buoy or the like. One would appreciate that numerous wind turbine configurations are possible, such as fully installed, or just a floating pedestal. The anchor 360 can be seen embedded in the seabed 365. The anchor is connected to a second portion 400*a* of a connector, as will be described in more detail with reference to FIGS. 40 to 42. The second portion 400*a* is connected to the anchor by means of a chain 405. The second portion 405*a* is located within a holder 410. The holder 410 holds the second portion 400*a* at a substantially vertical disposition.

Figure 23:
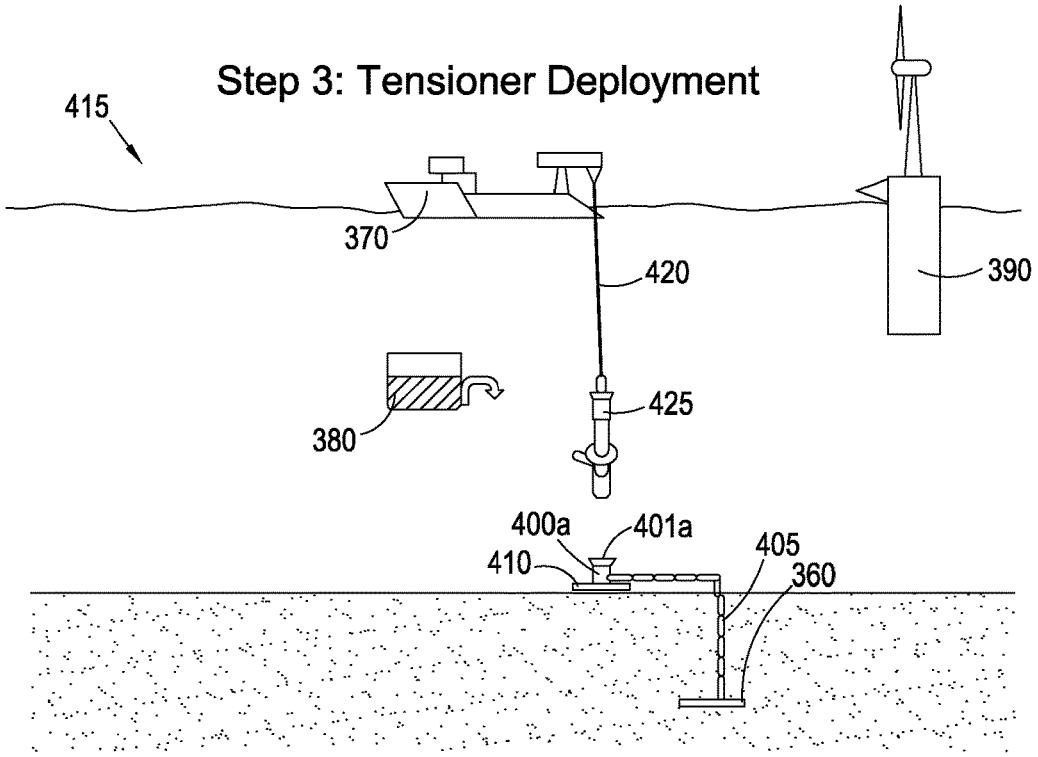
FIG. 23 a representation of a further step in a mooring method, according to an embodiment of the present invention.

Referring to FIG. 23, there is shown a representation of a third step in a mooring method, generally denoted 415, according to a first embodiment of the present invention. The step 415 comprises lowering a mooring line 420 and a device 425 from the vessel 370. The device 425 comprises a first portion 400*b* of the connector. The first portion of the connector comprises a male connector portion 401*b*. The second portion 400*a* of the connector comprises a female connector portion 401*a*. The first portion 400*b* of the connector is positioned at a distal end of the device 425. Notably, the device 425 is loaded with a portion of the mooring line 120 before it is lowered into the body of water.

Figure 24:
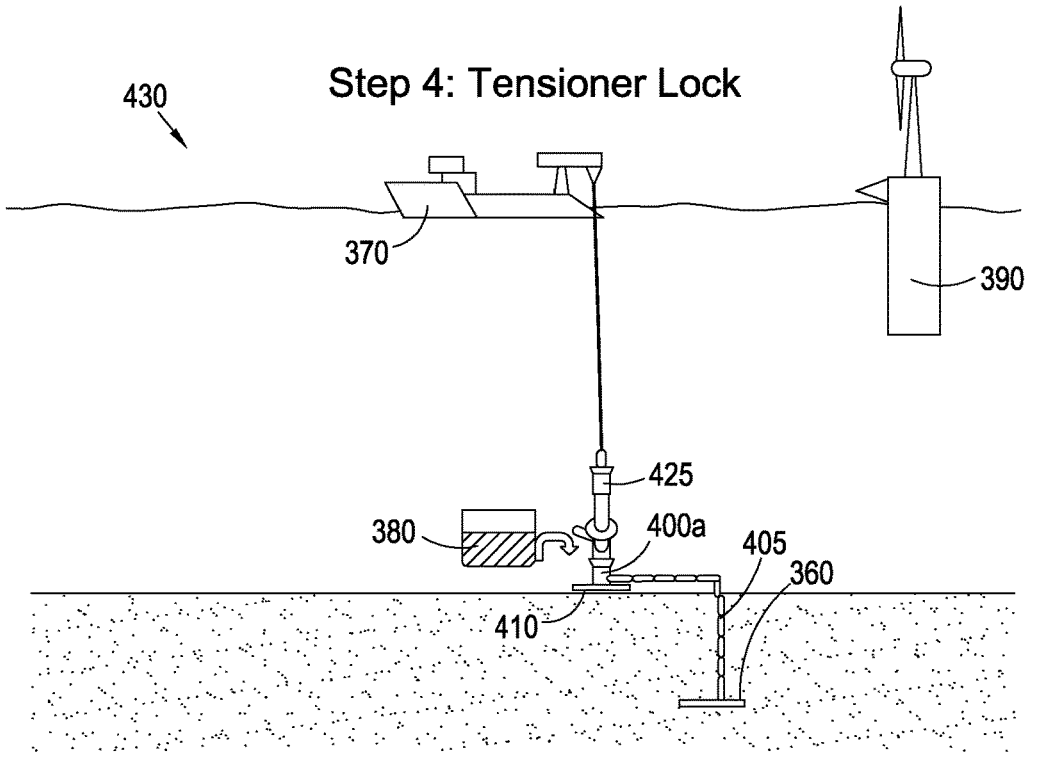
FIG. 24 a representation of a further step in a mooring method, according to an embodiment of the present invention.

Referring now to FIG. 24, there is shown a representation of a fourth step in a mooring method, generally denoted 430, according to a first embodiment of the present invention. The step 430 comprises retaining the first portion 400*b* of the connector by the second portion 400*a* of the connector. The first portion of the connector comprises a male connector portion. The male connector portion 401*b* is shown inserted vertically into the female connector portion 401*a*. The ROV 380 is used to mate the first and second connection portions 400*a*, 400*b* by inserting a pin 405 (shown in FIG. 41).

Figure 25:
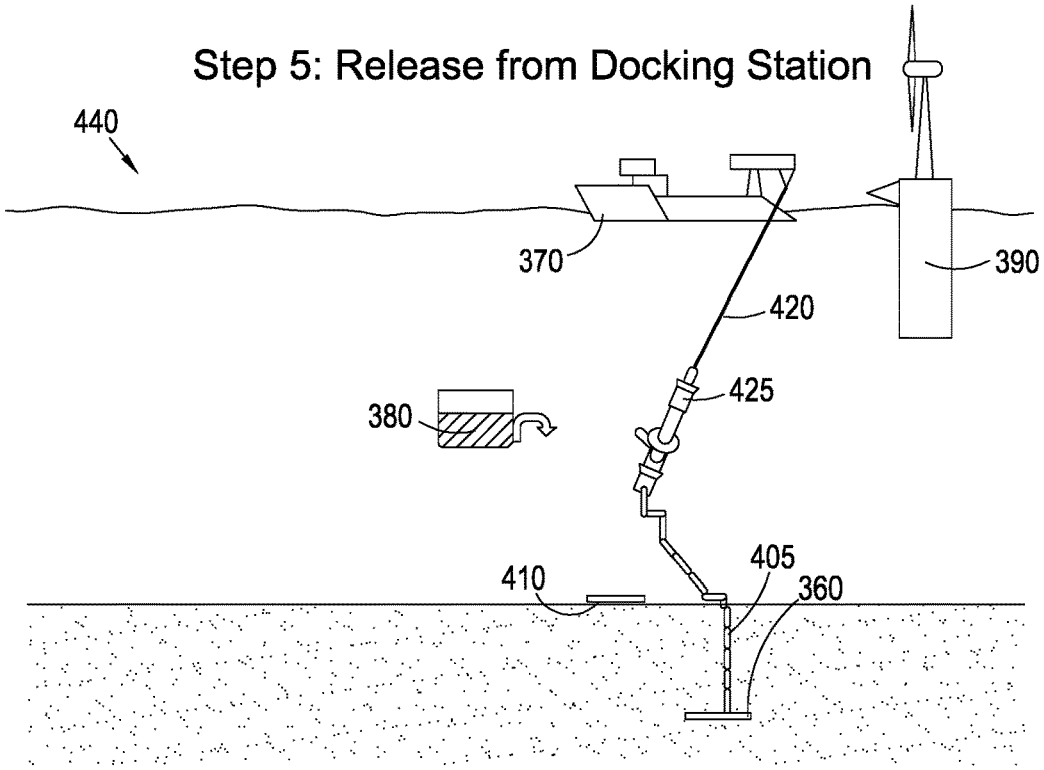
FIG. 25 a representation of a further step in a mooring method, according to an embodiment of the present invention.

Referring to FIG. 25, there is shown a representation of a fifth step in a mooring method, generally denoted 440, according to a first embodiment of the present invention. The step 440 comprises raising the device 425 and the mooring line 420 assembly within the body of water. The raising of the device 425 and the mooring line 420 Is achieved by relocating the vessel 370 to which the mooring line 420 is attached. However, one would appreciate that in other embodiments encompassing the inventive concept of the present invention, the raising of the device 425 may be achieved by applying a pulling force to the mooring line 420 by winching the mooring line 420 onto the vessel 370.

In the embodiment shown in FIG. 24, wherein the anchor 360 is a Suction Embedded Plate Anchor (SEPLA), the step 440 of raising the device 425 and the mooring line 420 within the body of water detaches the second connector 400*a* from the holder 410.

Figure 26:
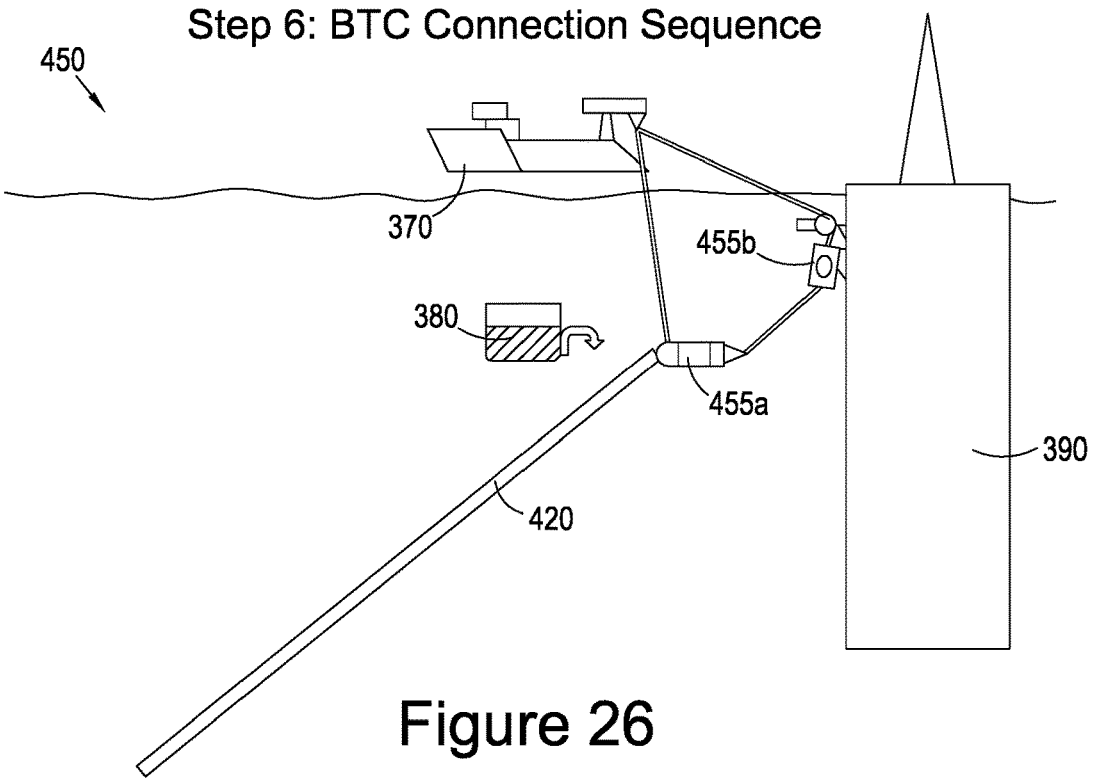
FIG. 26 a representation of a further step in a mooring method, according to an embodiment of the present invention.

Referring to FIG. 26, there is shown a representation of a sixth step in a mooring method, generally denoted 440, according to a first embodiment of the present invention. The step 440 comprises attaching a second portion of the mooring line 420 to the buoyant structure 390. The mooring line 420 is attached to the buoyant structure by means of a connector apparatus 455*a*, 455*b*. A first portion 455*a* of the mooring line connector apparatus 455*a*, 455*b* comprises means for connecting to the mooring line 420. One would appreciate that the first portion 455*a* of the mooring line connector 455*a*, 455*b* may comprise a universal joint, or the like. That is, the first portion 155*a* of the mooring line connector 455*a*, 455*b* allows rotational movement around or about a transverse axis of the first portion 455*a* of the mooring line connector 455*a*, 455*b* with respect to the mooring line 420. The second portion 455*b* of the mooring line connector 455*a*, 455*b* comprises means for connecting to the structure 390 allowing rotational movement around or about a transverse axis of the second portion 455*b* of the mooring line connector 455*a*, 455*b* with respect to the structure 390.

Figure 27:
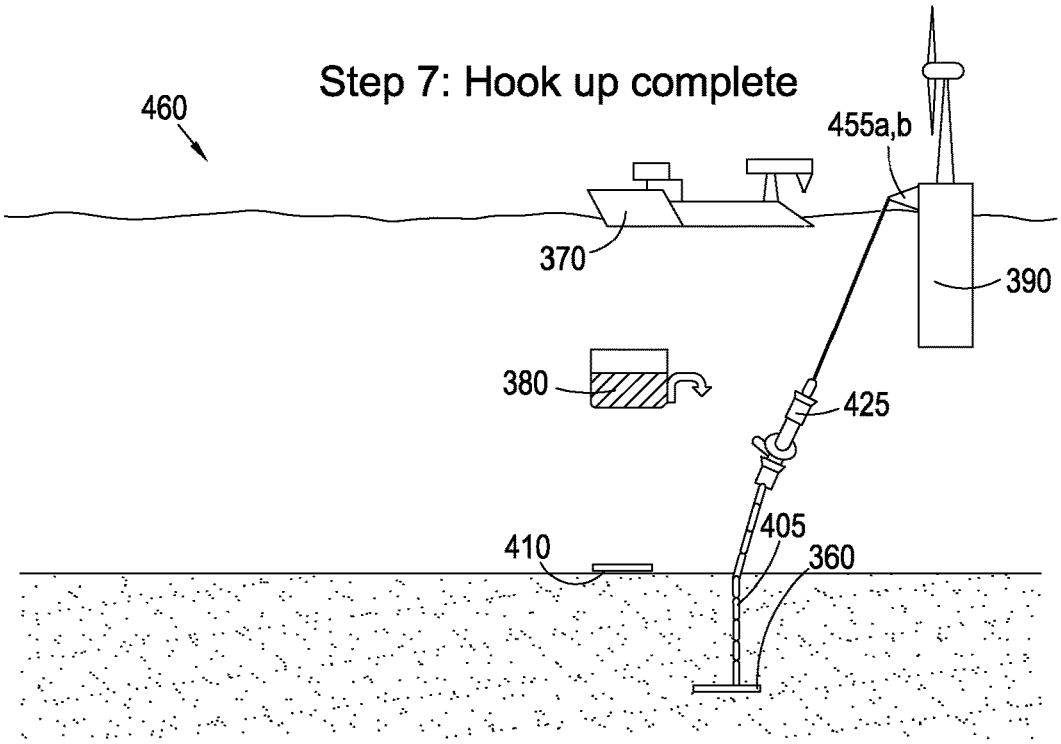
FIG. 27 a representation of an intermediate stage in the execution of the mooring method, according to an embodiment of the present invention.

Referring to FIG. 27, there is shown a representation of an intermediate stage, generally denoted 460, in the execution of the mooring method. The mooring line 420 is connected to the anchor 365 and the structure 390.

Figure 28:
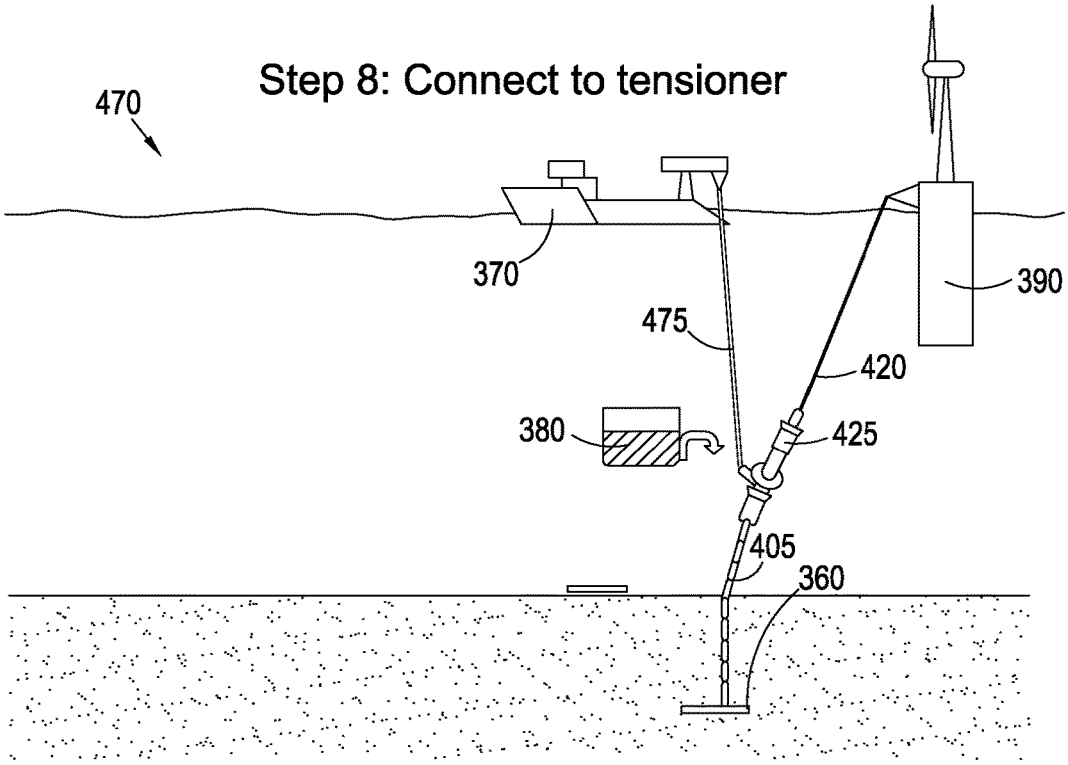
FIG. 28 a representation of a further step in a mooring method, according to an embodiment of the present invention.

Referring to FIG. 28, there is shown a representation of an eighth step in a mooring method, generally denoted 470, according to a first embodiment of the present invention. The step 470 comprises connecting a first portion of the mooring line 420*a* to a third line 475. The first portion of the mooring line 420*a* may comprise a mounting element (not shown). The mounting element may be configured to permit connecting of the first portion of the mooring line 420*a* to the third line 475. One would appreciate that at least a portion of the third line 475 may be a chain, wire, rope, or the like, or may comprise at least in part a polymeric material, e.g. polyester, or the like. The ROV 380 performs the operation of connecting the first portion of the mooring line 420*a* to the third line 475.

Figure 29:
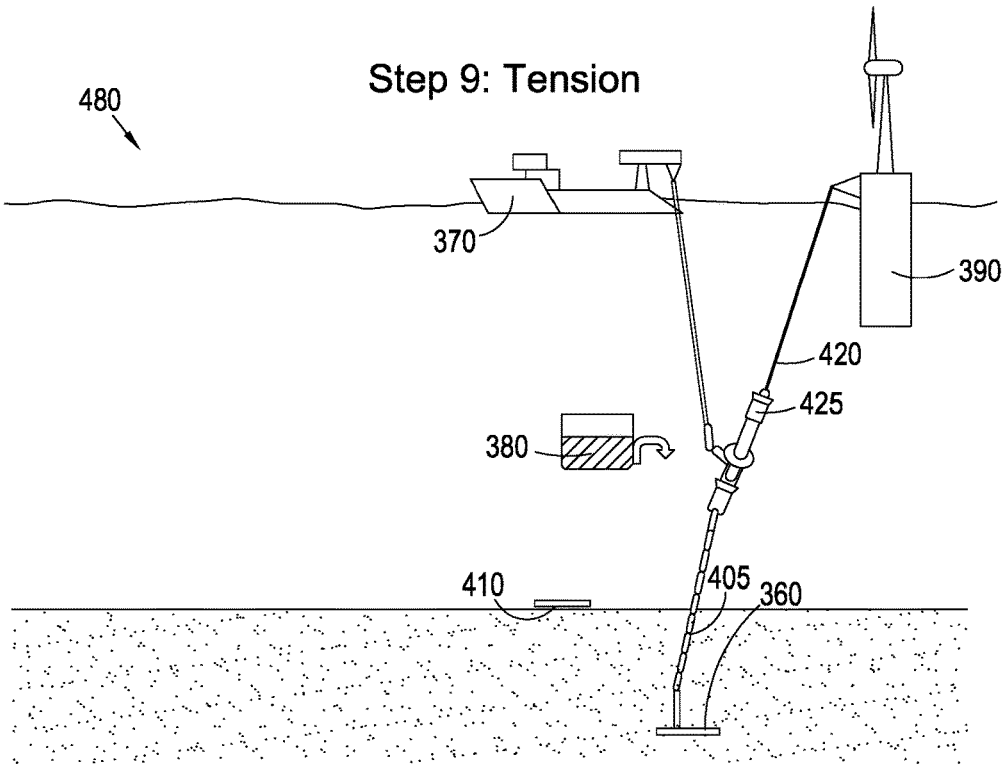
FIG. 29 a representation of a further step in a mooring method, according to an embodiment of the present invention.

Referring to FIG. 29 there is shown a representation of a ninth step in a mooring method, generally denoted 480, according to a first embodiment of the present invention. The step 480 comprises applying a tension to the third line 475. As such, the step 480 applies a tension to the mooring line 420. Tension is applied to the third line 475 and the mooring line 420 by means of a winch, motor, pulley or the like located on the vessel 370. The step 480 may also comprise a step of adapting the device 425 such that a line engaging device restrict or inhibits movement of at least a portion of the mooring line 420 relative to the device 425 in a first direction, as will be described in more detail with reference to FIGS. 40, 41 and 42.

Figure 30:
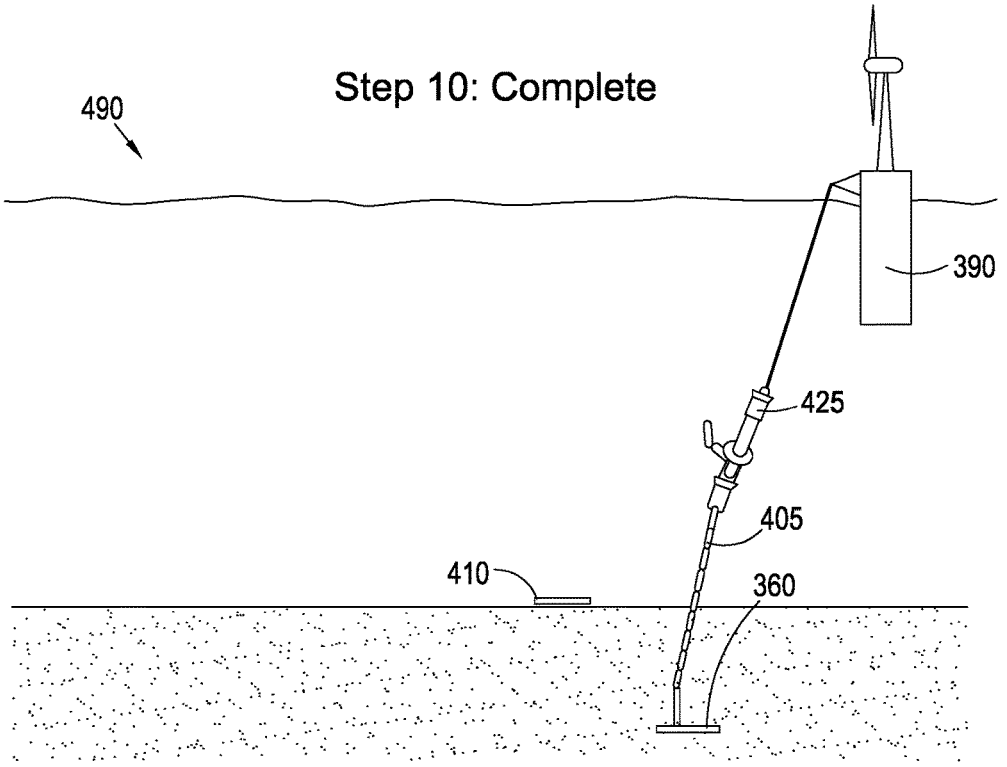
FIG. 30 a representation of a moored structure.

Referring to FIG. 30 there is shown a representation, generally denoted 490 of the moored structure 390, following completion of the aforementioned steps. It will be appreciated that the method may comprise a step of removing a portion of the mooring line 420, such as the first portion 420*a* of the mooring line 420. The removal may be by means of cutting or the like, by means of the ROV or by use of one or more divers. One would also appreciate that in other embodiments encompassing the inventive concept of the present invention, the method may comprise a step of attaching a portion of the mooring line 420, such as the first portion of the mooring line 420*a*, to a floatation device (not shown), such as a buoy or the like.

Figure 31:
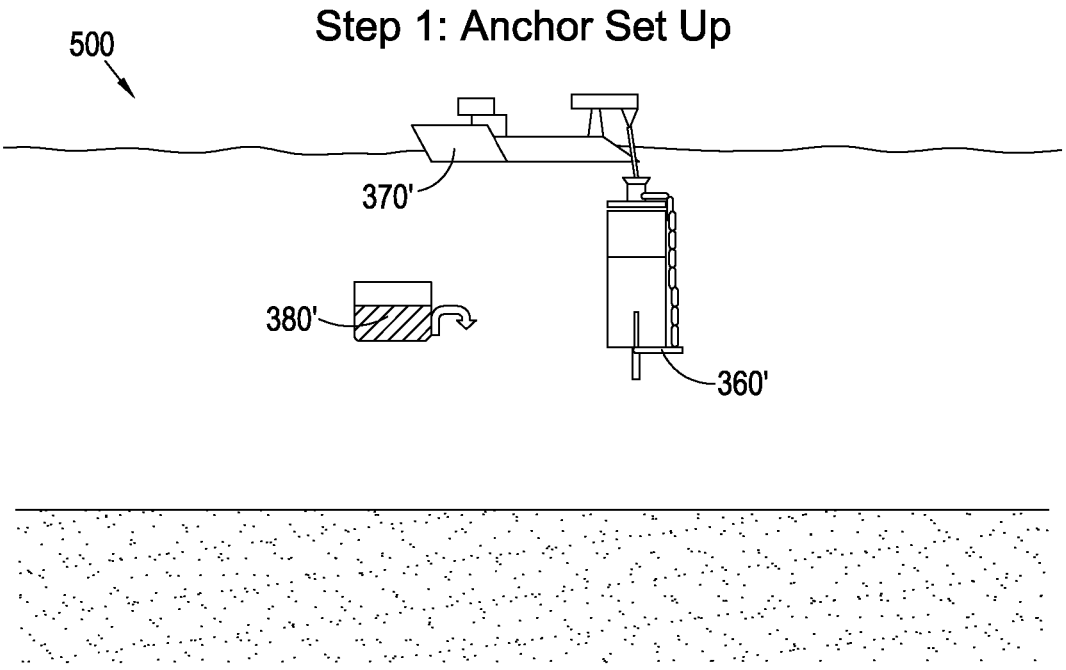
FIG. 31 a representation of a step in a mooring method, according to a further embodiment of the present invention.

Referring now to FIG. 31, there is shown a representation of a first step in a mooring method, generally denoted 500, according to a second embodiment of the present invention. The step 500 comprises installing a SEPLA 360'. The step corresponds to the first step 350 of the first in the mooring method according to the first embodiment as shown in FIG. 21.

Figure 32:
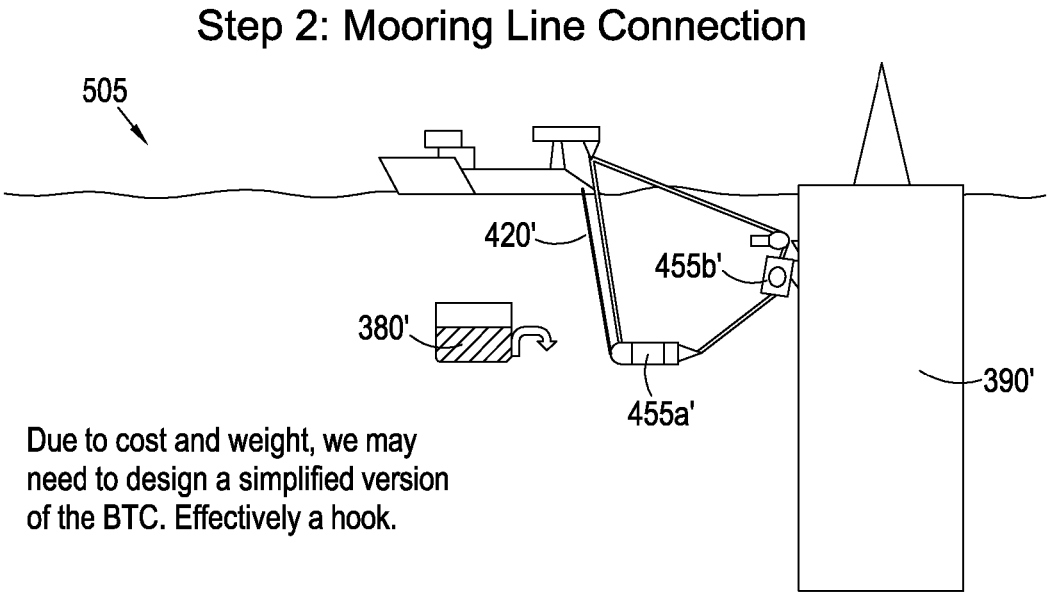
FIG. 32 a representation of a further step in a mooring method, according to the further embodiment of the present invention.

Referring to FIG. 32 there is shown a representation of a second step in a mooring method, generally denoted 505, according to a second embodiment of the present invention. The step 505 comprises attaching a second portion of the mooring line 420' to a buoyant structure 390'. The mooring line 420' is attached to the buoyant structure by means of a connector apparatus 455*a*', 455*b*'. A first portion 455*a*' of the mooring line connector apparatus 455*a*', 455*b*' comprises means for connecting to the mooring line 420'. One would appreciate that the first portion 455*a*' of the mooring line connector 455*a*', 455*b*' may comprise a universal joint, or the like. That is, the first portion 155*a*' of the mooring line connector 455*a*', 455*b*' allows rotational movement around or about a transverse axis of the first portion 455*a*' of the mooring line connector 455*a*', 455*b*' with respect to the mooring line 420'. The second portion 455*b*' of the mooring line connector 455*a*', 455*b*' comprises means for connecting to the structure 390' allowing rotational movement around or about a transverse axis of the second portion 455*b*' of the mooring line connector 455*a*', 455*b*' with respect to the structure 390'. The step 505 shown in FIG. 32 is similar to the step 450 shown in FIG. 26, with an exception that in FIG. 32 the mooring line 420' is connected to the vessel 370', whereas in FIG. 26 the mooring line 420 is connected to the subsea anchor 360, as described with reference to FIGS. 21 to 25.

Figure 33:
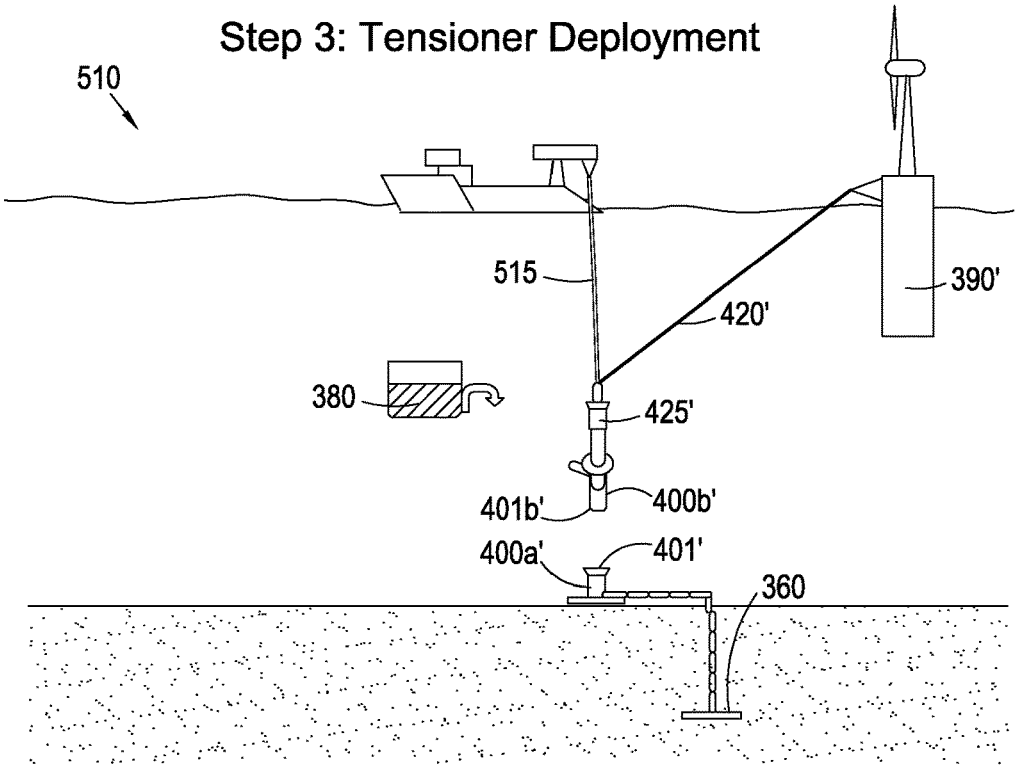
FIG. 33 a representation of a further step in a mooring method, according to the further embodiment of the present invention.

Referring to FIG. 33 there is shown a representation of a third step in a mooring method, generally denoted 510, according to a second embodiment of the present invention. The step 510 comprises lowering a further line 515 and a device 425' from the vessel 370'. One would appreciate that in a variant of the second embodiment that encompasses the inventive concept the present invention, the mooring line 320' is also extended/lowered in conjunction with the lowering of further line 515, such that the device 425' is lowered in the body of water. Alternatively, the mooring line 420 may feed through a connection, hook, loop of the like of the device 425', such that only the further line 515 is a portion of the mooring line 420'. The device 425' comprises a first portion 400*b*' of the connector. The first portion of the connector comprises a male connector portion 401*b*'. The second portion 400*a*' of the connector comprises a female connector portion 401*a*'. The first portion 400*b*' of the connector is positioned at a distal end of the device 425'. Notably, the device 425' is loaded with a portion of the mooring line 420' before it is lowered into the body of water.

Figure 34:
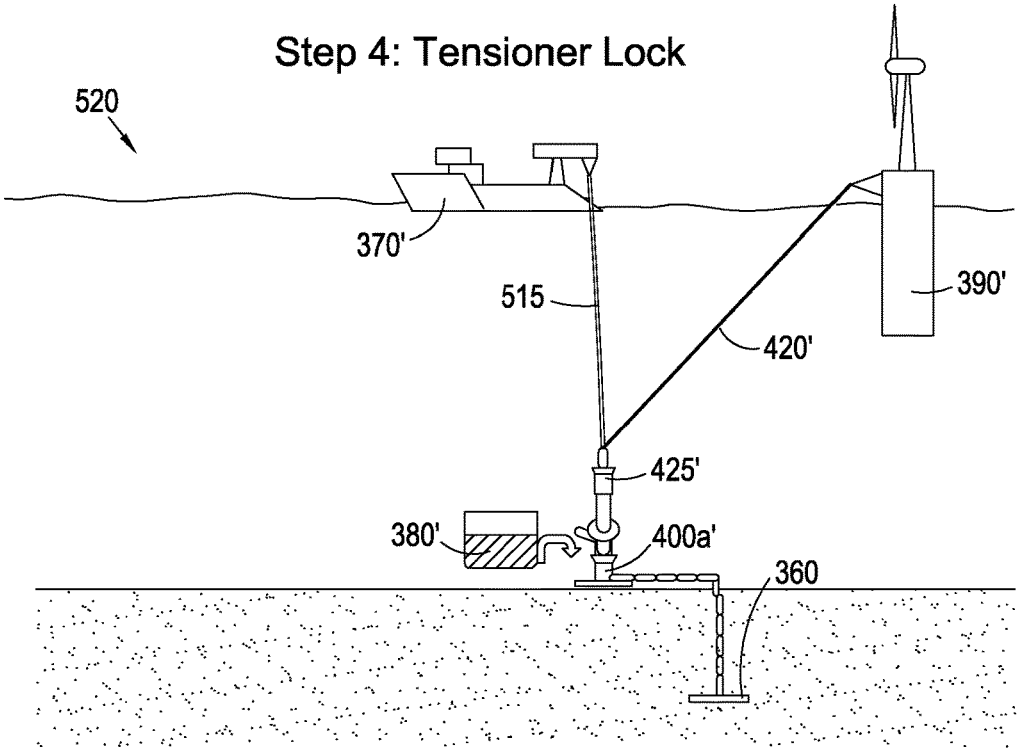
FIG. 34 a representation of a further step in a mooring method, according to the further embodiment of the present invention.

Referring to FIG. 34, there is shown a representation of a fourth step in a mooring method, generally denoted 520, according to a second embodiment of the present invention. The step 520 comprises retaining the first portion 400*b*' of the connector by the second portion 400*a*' of the connector. The first portion of the connector comprises a male connector portion. The male connector portion 401*b*' is shown inserted vertically into the female connector portion 401*a*'. The ROV 380' is used to mate release the first and second connection portions 400*a*, 400*b* by inserting a pin 705 (see FIG. 41).

Figure 35:
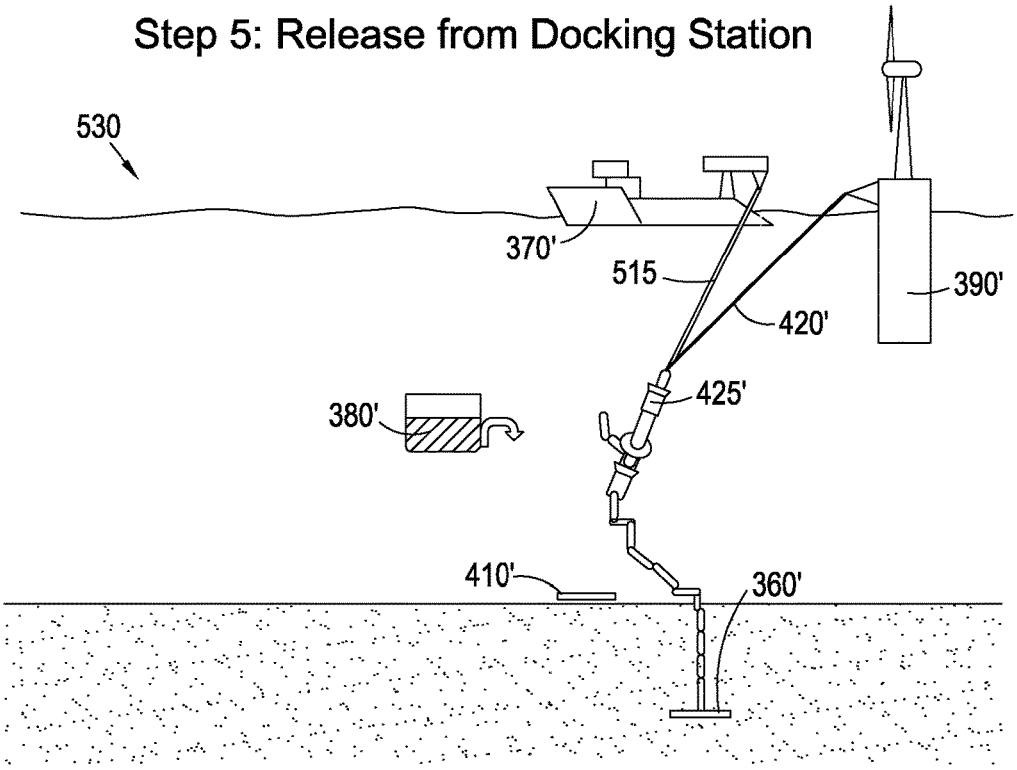
FIG. 35 a representation of a further step in a mooring method, according to the further embodiment of the present invention.

Referring to FIG. 35, there is shown a representation of a fifth step in a mooring method, generally denoted 530, according to a second embodiment of the present invention. The step 530 comprises raising the device 425' within the body of water. The raising of the device 425' and/or the line 515' is achieved by relocating the vessel 370' to which the line 515' is attached. However, one would appreciate that in other embodiments encompassing the inventive concept of the present invention, the raising of the device 425' may be achieved by applying a pulling force to the mooring line 420' by winching the mooring line 420' onto the structure 390'.

In the embodiment shown in FIG. 35, wherein the anchor 360' is a Suction Embedded Plate Anchor (SEPLA), the step 530 of raising the device 425' and the mooring line 420' and the line 515 within the body of water detaches the second connector 400*a*' from the holder 410'.

Figure 36:
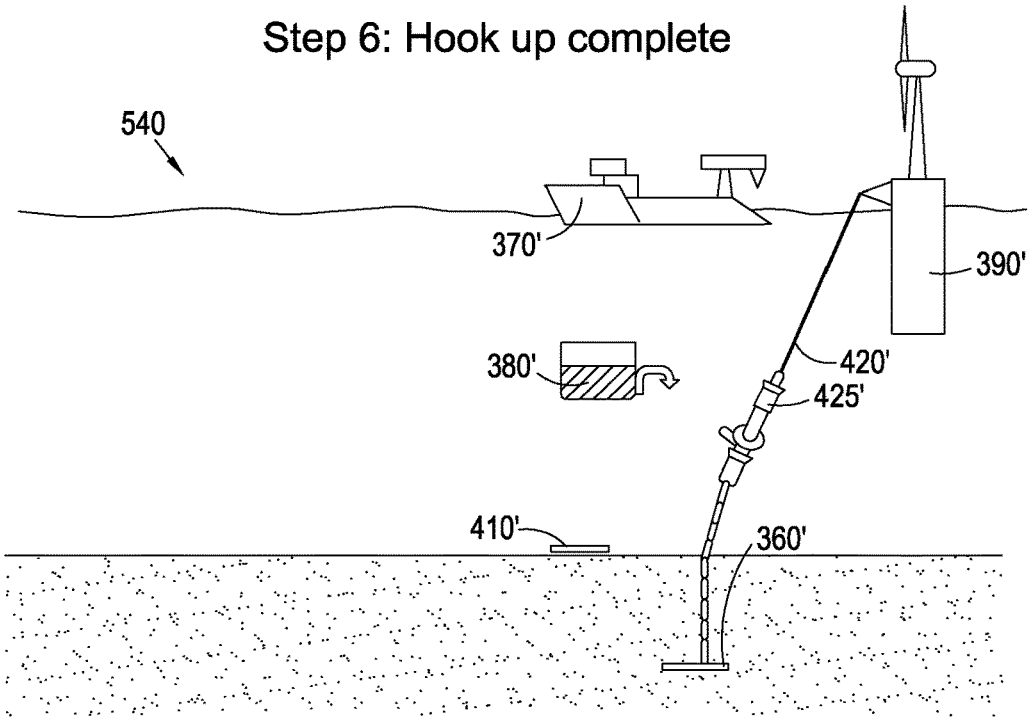
FIG. 36 a representation of a further step in a mooring method, according to the further embodiment of the present invention.

Referring to FIG. 36, there is shown a representation of an intermediate stage, generally denoted 540, in the execution of the mooring method. The mooring line 420' is connected to the anchor 365' and the structure 390'. The line 515 (as shown in FIG. 35) has been removed. One would appreciate that steps to remove line 515 may have included using the ROV 380' to detach the line 515 from the mooring line 420' or the device 425', and winching or pulling the line 515 onto the vessel 370'.

Figure 37:
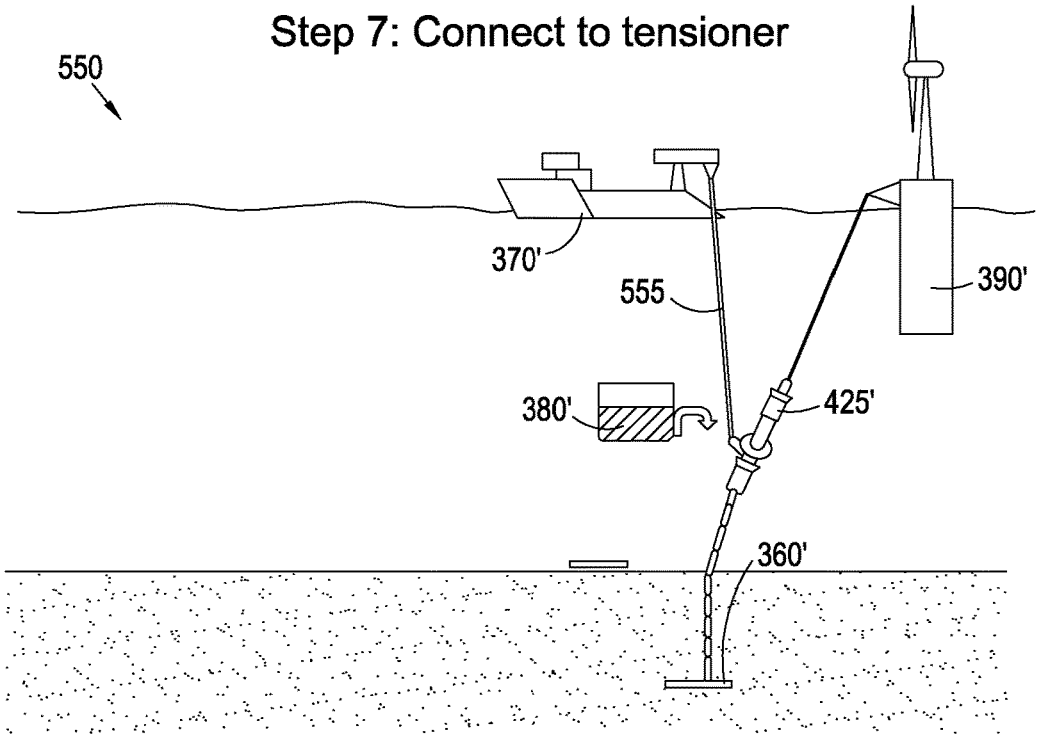
FIG. 37 a representation of a further step in a mooring method, according to the further embodiment of the present invention.

Referring to FIG. 37, there is shown a representation of a seventh step in a mooring method, generally denoted 550, according to a second embodiment of the present invention. The step 550 comprises connecting a first portion of the mooring line 420*a*' to a line 555. The first portion of the mooring line 420*a*' may comprise a mounting element (not shown). The mounting element may be configured to permit connecting of the first portion of the mooring line 420*a*' to the line 555. One would appreciate that at least a portion of the line 555 may be a chain, wire, rope, or the like, or may comprise at least in part a polymeric material, e.g. polyester, or the like. The ROV 380' performs the operation of connecting the first portion of the mooring line 420*a*' to the line 555.

Figure 38:
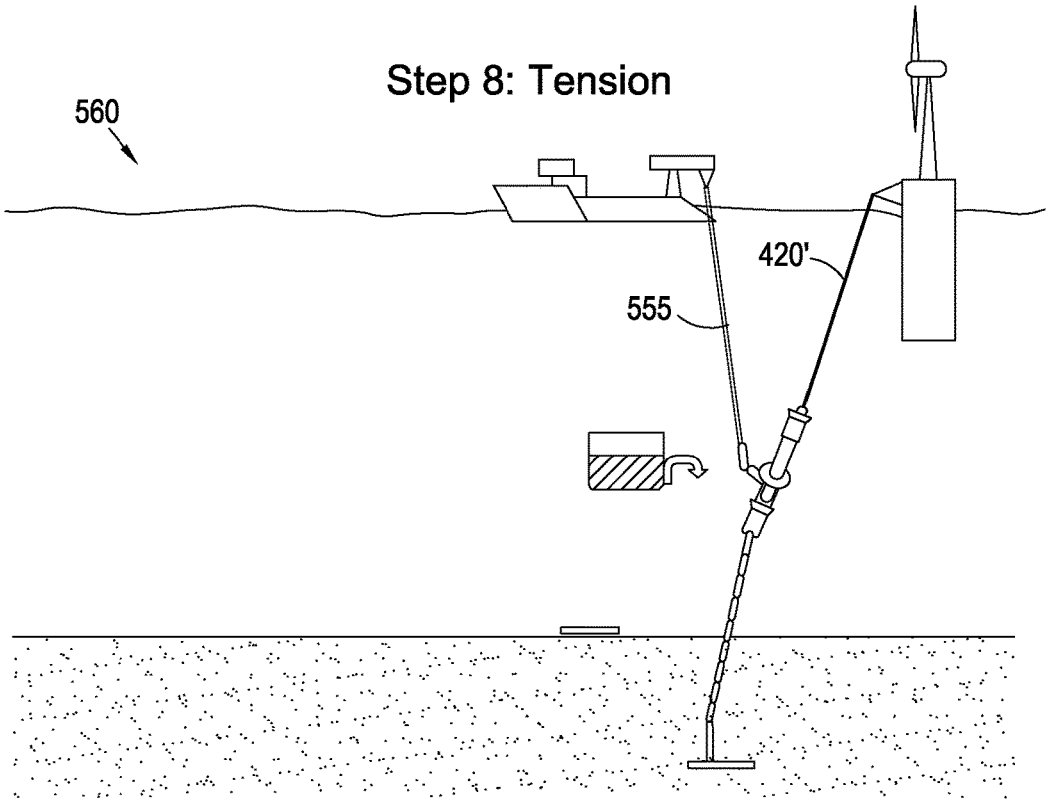
FIG. 38 a representation of a further step in a mooring method, according to the further embodiment of the present invention.

Referring to FIG. 38 there is shown a representation of an eighth step in a mooring method, generally denoted 560, according to a first embodiment of the present invention. The step 560 comprises applying a tension to the line 555. As such, the step 560 applies a tension to the mooring line 520'. Tension is applied to the line 555 and the mooring line 520' by means of a winch, motor, pulley or the like located on the vessel 370'. The step 560 may also comprise a step of adapting the device 425' such that a line engaging device restrict or inhibits movement of at least a portion of the mooring line 420' relative to the device 425' in a first direction, as will be described in more detail with reference to FIGS. 40, 41 and 42.

Figure 39:
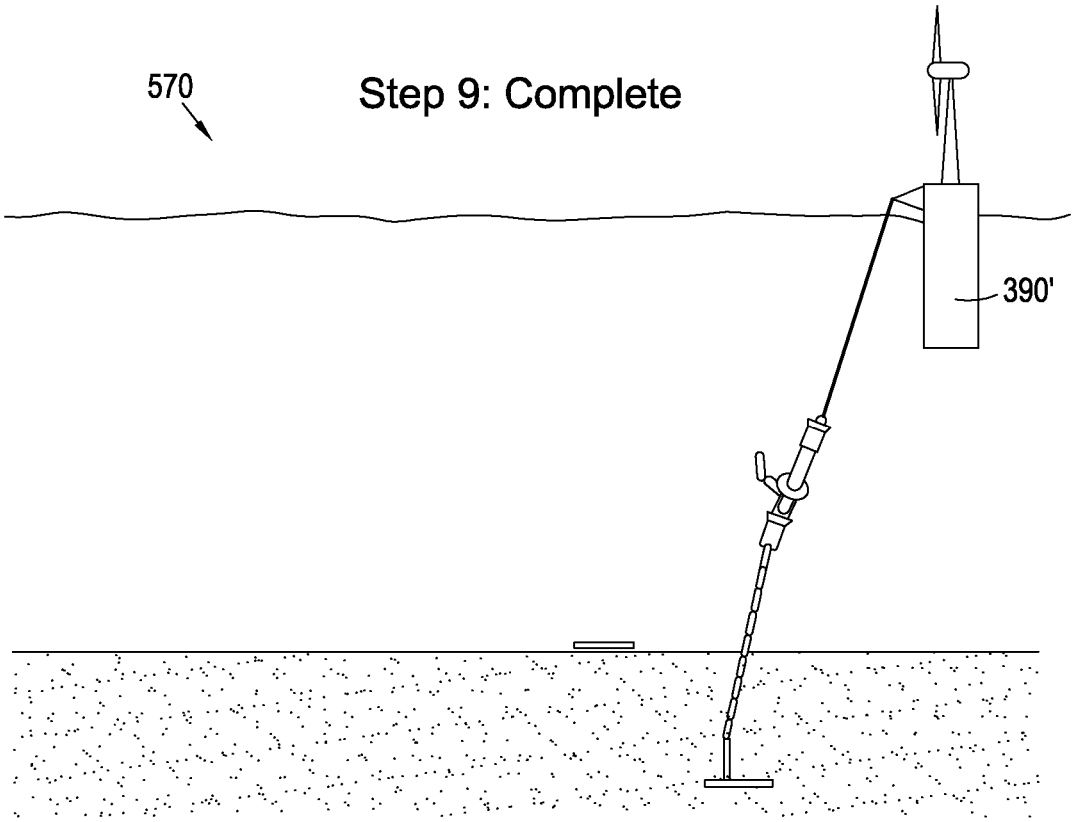
FIG. 39 a representation of a moored structure.

Referring to FIG. 39 there is shown a representation, generally denoted 570 of the moored structure 90', following completion of the aforementioned steps. It will be appreciated that the method may comprise a step of removing or retaining an excess portion of the mooring line 420', as already described with reference to FIG. 30.

Figure 40:
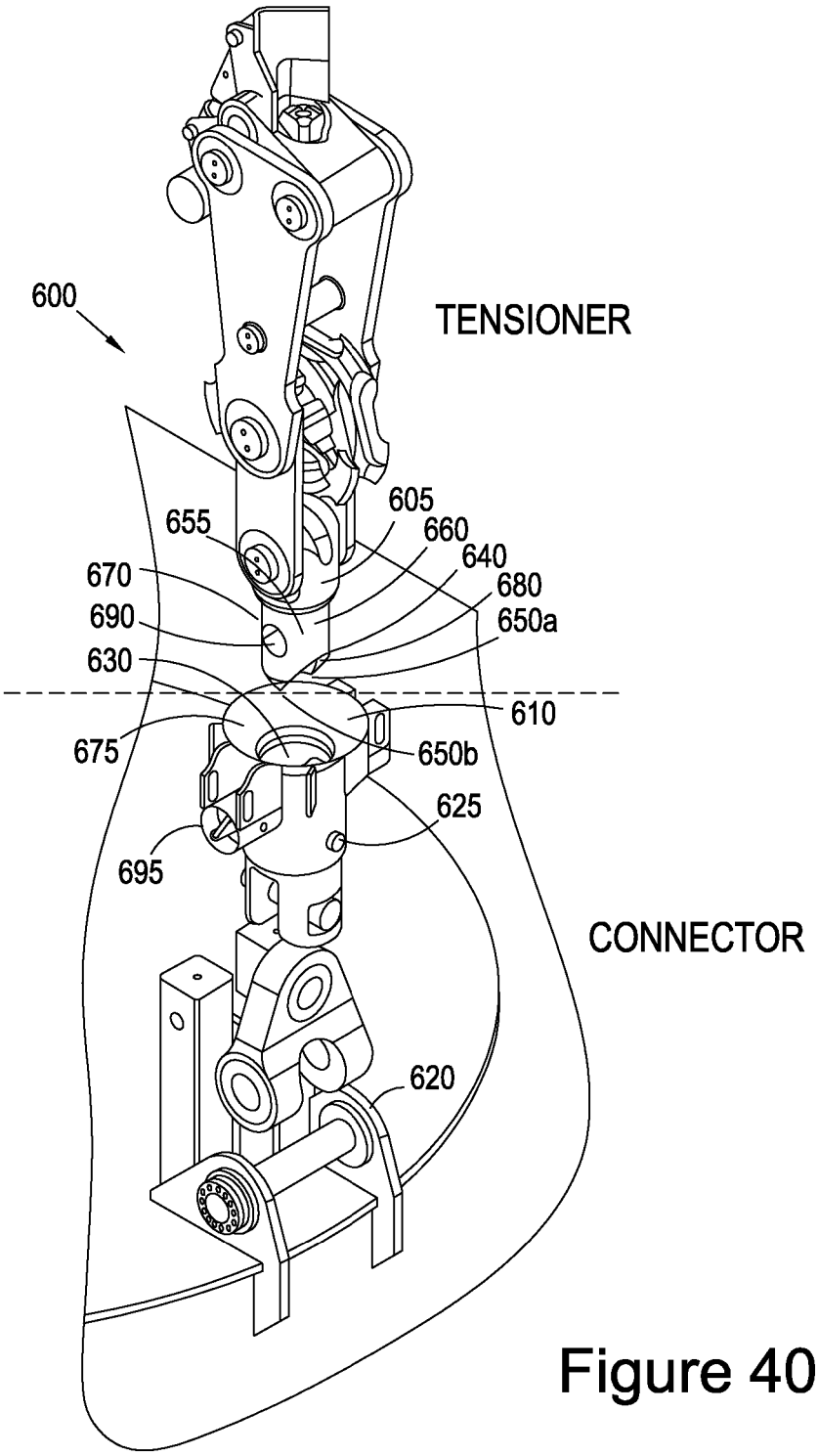
FIG. 40 a perspective view of the retention and tensioning device, according to the embodiment, and the the further embodiment of the present invention.

Referring to FIG. 40, there is shown a perspective view of the retention and tensioning device, generally denoted 600, according to the first and second embodiments of the present invention. The device comprises a first portion of a connector 605. The connector comprises the first portion 605, a second portion 610 and a means for connecting the first portion 605 and the second portion 610, and a means for rotationally aligning the first portion 605 with the second portion 610, as will now be described.

Figure 41:
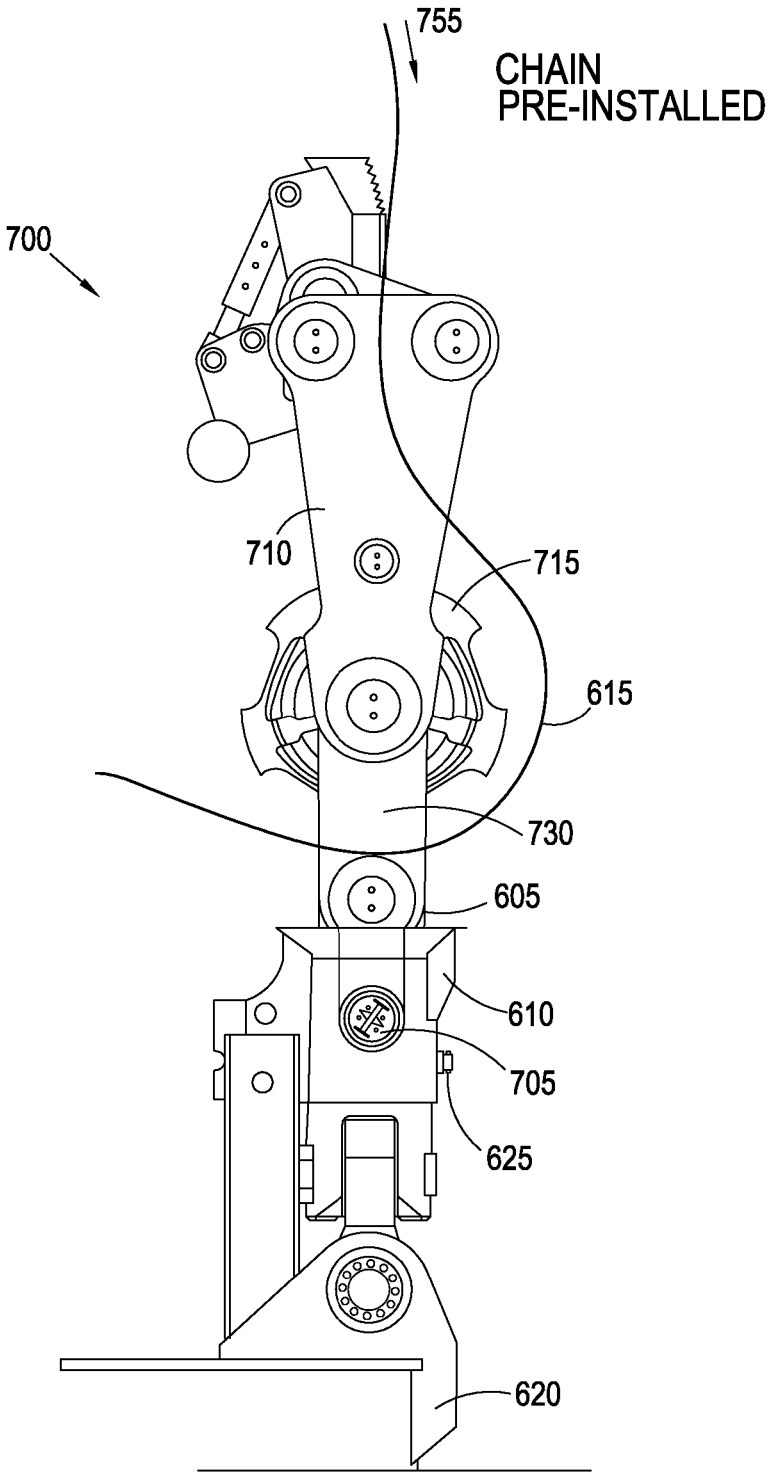
FIG. 41 a side view of a retention and tensioning device, according to the the embodiment and the further embodiment of the present invention.

The first portion 605 is adapted to be connected to a respective line, such as a respective mooring line 615 (shown in FIG. 41). The second portion 610 is adapted to sit in a cradle 620.

The means for rotationally aligning the first and second portions 605, 610 comprises means provided on the first and second portions 605, 610. The means for rotationally aligning comprises a first alignment member 625 at least partly spanning across an internal bore 630 of the second portion 610. The first alignment member 625 is transverse to the bore 630 with respect to a longitudinal axis of the second portion 610. The first portion 605 comprises a male part 670. The second portion 610 comprises a female part. The means for connecting comprises means for releasably connecting. The first and second means co-act, in use, when the first 605 and second 610 portions are mated.

The first means comprises a first surface 640. The second means comprises a second surface (not shown). The first surface 640 and the second surface abut one another and may rotate with respect to one another around a longitudinal axis when the first 605 and second 610 portions are longitudinally brought together or mated.

The first means comprises first and second prongs 650*a*, 650*b*. The first and second prongs 650*a*, 650*b* are diametrically opposite one another. A recess portion 355 is provided between the first and second prongs 650*a*, 650*b*.

The male part 670 may comprise a cylindrical mid-portion 660. The female part 675 may comprise a cylindrical bore 630. The cylindrical portion 660 is received in a substantially tight or snug fit.

The second means comprise the alignment member 625, which is an elongate bar. The alignment member 625 diametrically spans the bore 630. The alignment member 625 comprises an upper facing curved surface (not shown). One would appreciate that the alignment member 625 may be a bolt, or other substantially cylindrical element.

In use, insertion of the male part 670 into the female part 675 may cause the first means and second means to rotationally co-act or ride over one another, thereby relatively (longitudinally) rotating the male part 670 and the female part 675 into a pre-selected or pre-determined rotational disposition.

In the embodiment shown in FIG. 40, the first prong 650*a* and second prong 650*b* provide a first surface. Each prong comprises one a first chamfered and sloping surface and a second chamfered and sloping surface, disposed symmetrically with the first side surface. A flat planar surface 680 tapers outwards towards an end of the prong. A first side surface of the first prong 650*a* is continuous with a first side surface of the second prong 650*b*. A second side surface of a first prong 550*a* is continuous with a second side surface 650*b* of the second prong.

The alignment member 625 provides the second surface, which comprises an outer surface thereof, e.g. said outer (upper) facing curved surface.

Once in a pre-selected rotational disposition, the first and second prongs 650*a*, 650*b* are disposed on respective first and second sides of the elongate member 625. A portion of the male part 670 between the prongs 650*a*, 650*b*, e.g. base of the slot portion, is adjacent to the alignment member 625.

The means for connecting the first portion 605 and the second portion 610 comprises a first aperture 690 in the male part 670, e.g. diametrically and width-wise spanning the cylindrical portion 660 of the male part 670.

The means for connecting the first portion 605 and the second portion 610 comprises a pair of diametrically opposed apertures 695 in the female part 675.

The means for connecting the first portion 605 and the second portion 610 comprises a pin 705, e.g. a load (bearing) pin 705, removably receivable within the first 690 and second 695 apertures, when such are aligned.

Figure 42:
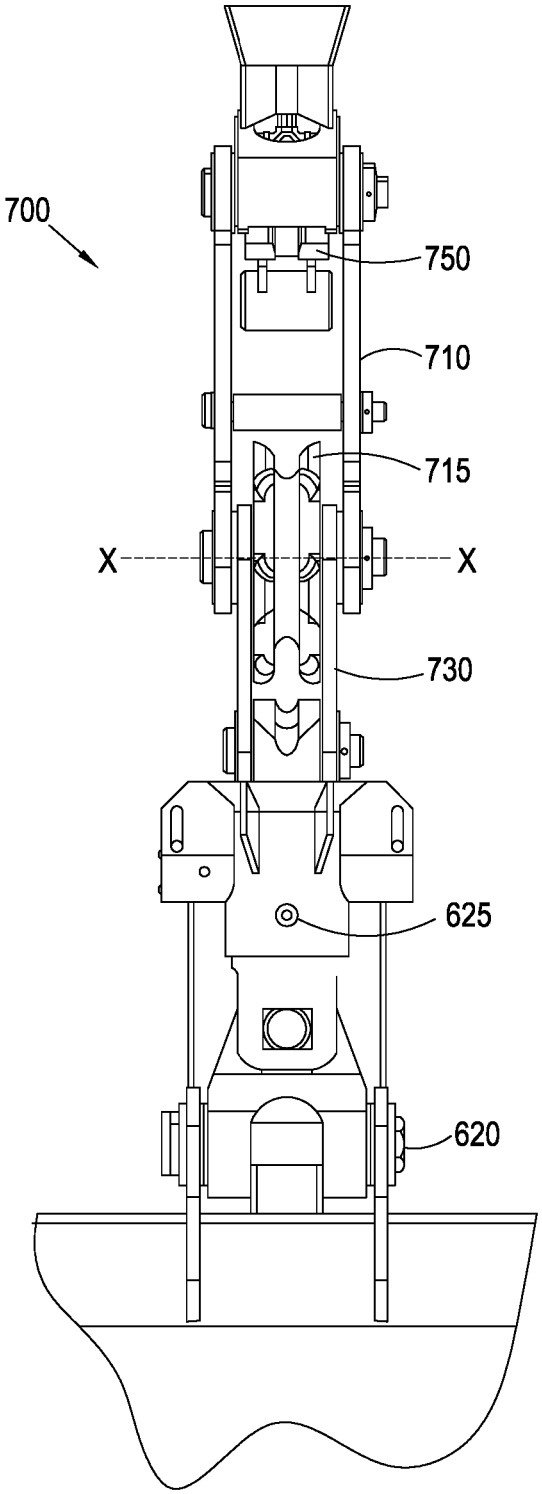
FIG. 42 a front view of the retention and tensioning device, according to the embodiment and the further embodiment of the present invention.

The retention and tensioning device of FIG. 40 will now be described with reference to FIGS. 41 and 42. In FIG. 41, there is shown a side view of the retention and tensioning device of FIG. 40, generally denoted 700, according to the first and second embodiments of the present invention. In FIG. 41, the first connector portion 605 and the second connector portion 610 are shown mated. Further, the device 700 is loaded with a portion of a mooring line 615. In FIG. 42, there is shown a front view of the device of FIG. 40, also generally denoted 700, according to the first and second embodiments of the present invention. In FIG. 41, the first connector portion 605 and the second connector portion 610 are shown mated. For purposes of clarity, the mooring line 615 is omitted from FIG. 42.

The device comprise a first portion 710, e.g. for receiving the portion of the mooring line 615 extending from a structure.

The device comprises a guide portion 715 for guiding the portion of the line 615 received by the first portion 710. The guide portion 715 is rotatably connected to the first portion 710.

The device 700 comprises a second portion 730 for connecting the device 700 to a further structure, as described above with reference to FIG. 40.

The apparatus comprises an axis X. The first portion 710, the second portion 730 and the guide portion 715 are arranged to be rotatable around the axis X of the device 700. In other words, the first portion 710, the guide portion 715 and the second portion 730 are coaxially arranged relative to each other. The coaxial arrangement of the first portion 710, guide portion 715 and the second portion 730 permits the first portion 710, guide portion 715 and second portion 730 to be aligned relative to each other during pull-in and/or tensioning the line 615

The device 700 comprises a line engaging device 750. In the embodiment shown, the line 615 is a chain. The line engaging device 750 comprises a means for engaging a chain 615. The line engaging device 750 may be configured to permit movement of the line 615, in a first direction 755 relative to the device 700, e.g. in a direction towards the guide portion 615. The line engaging device 750 may be configured to prohibit movement of the line 615. The line engaging device 750 is movably connected to the first portion 710. That is, the line engaging device 750 is connected to the first portion 710 so that the line engaging device 750 is pivotable, relative to the first portion 710. The guide portion 715 is connected or connectable to the first portion 710, such that the axis X of the device 700 extends in a direction substantially perpendicular to a longitudinal axis of the first portion 710.

It will be appreciated that the embodiments of the present invention herebefore described are given by way of example only and are not meant to limit the scope of thereof in any way It will be appreciated that embodiments of the present invention provide benefits over the prior art.

The invention claimed is:

1. An apparatus for mooring a structure, the apparatus comprising:

a first portion configured to receive a mooring line extending from the structure to the apparatus;

a guide portion configured to guide the mooring line received by the first portion, the guide portion being movably connected to the first portion; and a second portion configured to connect the apparatus to a seabed or to a further structure located thereon, the second portion being movably connected to the first portion and to the guide portion, wherein the apparatus comprises an axis and the first portion, the second portion and the guide portion being movable about the axis of the apparatus, and wherein in a first configuration of the apparatus the first and second portions are arranged relative to each other such that a longitudinal axis of the first portion is substantially in line, collinear or coaxial with a longitudinal axis of the second portion.

2. The apparatus according to claim 1, wherein the apparatus is configured or arranged such that in the first configuration a longitudinal axis of the apparatus is substantially in line, collinear or coaxial with a longitudinal axis of a portion of a line extending from the structure.

3. The apparatus according to claim 1, wherein the second portion comprises a groove and/or a protrusion, the groove and/or the protrusion being configured to support a mounting element connected to at least one end of the mooring line.

4. The apparatus according to claim 1, wherein the first portion, the second portion and the guide portion are spin rotationally movable about the axis of the apparatus.

5. The apparatus according to claim 1, wherein the apparatus comprises a line engaging device being movably connected to the first portion.

6. The apparatus according to claim 5, wherein the line engaging device is connected to the first portion, the line engaging device being movable, actuatable and/or operable between a first position and a second position.

7. The apparatus according to claim 1, wherein the apparatus is configured or arranged such that in the first configuration an axis of the apparatus is substantially coplanar with a longitudinal axis of a line extending from a structure and/or the axis of the apparatus extends in a direction substantially perpendicular to a longitudinal axis of a line extending from a structure.

8. The apparatus according to claim 1, wherein in a second configuration of the apparatus, the first and second portions are arranged relative to each other such that the longitudinal axis of the first portion extends at an angle relative to the longitudinal axis of the second portion.

9. The apparatus according to claim 1, wherein the guide portion is connected to the first portion such that an axis of the apparatus extends in a direction substantially perpendicular to the longitudinal axis of the first portion and/or that the longitudinal axis of the first portion intersects the axis of the apparatus.

10. The apparatus according to claim 1, wherein the second portion is configured to receive, mount and/or support a mounting element connected to at least one end of a line.

11. The apparatus according to claim 1, wherein the second portion is configured to align a mounting element connected to at least one end of a line received in or threaded through the apparatus and/or at least one end of a line received in or threaded through the apparatus relative to the apparatus.

12. The apparatus according to claim 1, wherein the second portion comprises a first connector portion for complementary mating with a corresponding second connector portion.

13. The apparatus according to claim 12, wherein the first connector portion is movably connected or connectable to the second connector portion.

14. The apparatus according to claim 1, wherein the second portion is configured to connect the apparatus to a further mooring line extending from the seabed or to a further structure located on the seabed.

15. The apparatus according to claim 14, the second portion being movably connected or connectable to the further line or the further structure.

16. A system for mooring a structure, the system comprising an apparatus for mooring the structure according to claim 1.

17. A method for mooring a structure, the method comprising:

locating an apparatus for mooring the structure according to claim 1 at a site or location, such as a subsea or underwater site or location; and connecting the structure to the apparatus or a portion thereof.

18. A portion of an apparatus for mooring a structure according to claim 1, wherein the portion is configured to receive, support and/or mount a mounting element of a line.

19. A mounting element of a line, the mounting element being mountable on the portion of the apparatus for mooring a structure according to claim 18.

20. An apparatus according to claim 1, wherein an end of the first portion, an end of the second portion and a center of the guide portion are provided on the axis.

* * * * *